US007553594B2

(12) United States Patent
Ogaki et al.

(10) Patent No.: US 7,553,594 B2
(45) Date of Patent: Jun. 30, 2009

(54) ELECTROPHOTOGRAPHIC PHOTOSENSITIVE MEMBER, METHOD OF MANUFACTURING ELECTROPHOTOGRAPHIC PHOTOSENSITIVE MEMBER, PROCESS CARTRIDGE, AND ELECTROPHOTOGRAPHIC APPARATUS

(75) Inventors: Harunobu Ogaki, Suntou-gun (JP); Nobumichi Miki, Suntou-gun (JP); Kazunori Noguchi, Suntou-gun (JP); Nobuo Kosaka, Nagareyama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/103,184

(22) Filed: Apr. 15, 2008

(65) Prior Publication Data

US 2008/0199795 A1 Aug. 21, 2008

Related U.S. Application Data

(63) Continuation of application No. PCT/JP2007/071161, filed on Oct. 24, 2007.

(30) Foreign Application Priority Data

| | | |
|---|---|---|
| Oct. 31, 2006 | (JP) | 2006-295883 |
| Oct. 31, 2006 | (JP) | 2006-295884 |
| Oct. 31, 2006 | (JP) | 2006-295887 |
| Oct. 31, 2006 | (JP) | 2006-295888 |
| Oct. 31, 2006 | (JP) | 2006-295891 |
| Oct. 1, 2007 | (JP) | 2007-257113 |

(51) Int. Cl.
*G03G 5/147* (2006.01)

(52) U.S. Cl. ..... 430/66; 430/132; 430/59.6; 399/159

(58) Field of Classification Search ..... 430/69, 430/59.6, 132, 66; 399/159
See application file for complete search history.

(56) References Cited

U.S. PATENT DOCUMENTS

| | | | | |
|---|---|---|---|---|
| 4,792,507 | A | 12/1988 | Yoshihara et al. | 430/58 |
| 5,582,943 | A * | 12/1996 | Kato et al. | 430/66 |
| 6,004,716 | A * | 12/1999 | Kato et al. | 430/125.31 |
| 6,410,808 | B1 | 6/2002 | Furukawa et al. | 568/842 |
| 2005/0019682 | A1 | 1/2005 | Inagaki et al. | 430/58.05 |

FOREIGN PATENT DOCUMENTS

| | | |
|---|---|---|
| JP | 58-164656 | 9/1983 |
| JP | 63065450 A * | 3/1988 |
| JP | 63-221355 | 9/1988 |

(Continued)

OTHER PUBLICATIONS

English language machine translation of JP 2000-275889 (2000).*

*Primary Examiner*—Christopher RoDee
(74) *Attorney, Agent, or Firm*—Fitzpatrick, Cella, Harper & Scinto

(57) ABSTRACT

An electrophotographic photosensitive member having excellent electrophotographic properties, a method of manufacturing the electrophotographic photosensitive member, and a process cartridge and an electrophotographic apparatus each having the electrophotographic photosensitive member are provided. The surface layer of the electrophotographic photosensitive member includes a polymer having a specific repeating structural unit and fluorine-atom-containing resin particles. The fluorine-atom-containing particles in the surface layer are dispersed so as to be provided with particle sizes almost up to those of primary particles.

10 Claims, 2 Drawing Sheets

FOREIGN PATENT DOCUMENTS

| | | | | |
|---|---|---|---|---|
| JP | 02176666 | A | * | 7/1990 |
| JP | 06-332219 | | | 12/1994 |
| JP | 2000-194147 | | | 7/2000 |
| JP | 2000-275889 | | | 10/2000 |
| JP | 2001-199953 | | | 7/2001 |
| JP | 2001-302571 | | | 10/2001 |
| JP | 2005-043398 | | | 2/2005 |
| JP | 2005-043765 | | | 2/2005 |
| JP | 2005-054020 | | | 3/2005 |
| JP | 2006-184745 | | | 7/2006 |

* cited by examiner

ELECTROPHOTOGRAPHIC PHOTOSENSITIVE MEMBER, METHOD OF MANUFACTURING ELECTROPHOTOGRAPHIC PHOTOSENSITIVE MEMBER, PROCESS CARTRIDGE, AND ELECTROPHOTOGRAPHIC APPARATUS

CROSS-REFERENCE TO RELATED APPLICATIONS

This application is a continuation of International Application No. PCT/JP2007/071161, filed Oct. 24, 2007, which claims the benefit of Japanese Patent Applications No. 2006-295883 filed on Oct. 31, 2006, No. 2006-295884 filed on Oct. 31, 2006, No. 2006-295887 filed on Oct. 31, 2006, No. 2006-295888 filed on Oct. 31, 2006, No. 2006-295891 filed on Oct. 31, 2006, and No. 2007-257113 filed on Oct. 1, 2007.

BACKGROUND OF THE INVENTION

1. Field of the Invention

The present invention relates to an electrophotographic photosensitive member, a method of manufacturing the electrophotographic photosensitive member, and a process cartridge and an electrophotographic apparatus each having the electrophotographic photosensitive member.

2. Description of the Related Art

Electrophotographic photosensitive members with organic photoconductive substances (organic electrophotographic photosensitive members) have been intensively studied and developed in recent years.

The electrophotographic photosensitive member basically includes a support and a photosensitive layer formed on the substrate. In the case of the organic electrophotographic photosensitive member, a photosensitive layer is prepared using a charge-generating substance and a charge-transporting substance as photoconductive substances and a resin for binding these substances (binder resin).

There are two types of layer structure of the photosensitive layer: a multilayer type and a monolayer type. In the multilayer type, the function of charge generation and the function of charge transfer are assigned (functionally separated) respectively to a charge-generating layer and a charge-transporting layer. In contrast, in the monolayer type, both the function of charge generation and the function of charge transfer are assigned to one layer.

Most of electrophotographic photosensitive members employ multilayer type photosensitive layers. In many cases, charge-transporting layers are provided as the surface layers of the electrophotographic photosensitive members. In addition, for enhancing the durability of the surface of an electrophotographic photosensitive member, a protective layer may be provided as the surface layer of the electrophotographic photosensitive member.

The surface layer of the electrophotographic photosensitive member requires various types of properties. Among the various properties, wear resistance is particularly important because the surface layer is brought into contact with various types of members and paper sheets.

In many cases, various types of measures have been taken to the surface layers of electrophotographic photosensitive members to improve the wear resistance of the electrophotographic photosensitive members. For improving the wear resistance by providing the surface with low friction, for example, Japanese Patent Application Laid-Open No. H06-332219 (Patent Document 1) discloses the technology of including (dispersing) fluorine-atom-containing resin particles made of, for example, a tetrafluoroethylene resin into the surface layers of the particles.

At the time of dispersing the fluorine-atom-containing resin particles, a method of using a dispersing agent for increasing dispersibility has been known (see, for example, Patent Document 1). In the case of using the dispersing agent to disperse the fluorine-atom-containing resin particles, the dispersing agent requires a surface-activating function (function of dispersing the fluorine-atom-containing resin particles so that the particles are provided with fine particle sizes). It has been conventionally desired to satisfy both of the surface-activating function and the property of being inactive to electrophotographic properties (property of not obstructing charge transfer), and thus various studies have been conducted.

SUMMARY OF THE INVENTION

Patent Document 1 discloses a compound having excellent properties as a dispersing agent. At present, however, a further improvement in dispersibility and a further improvement in electrophotographic properties have been desired.

The present invention is aimed at providing an electrophotographic photosensitive member in which fluorine-atom-containing resin particles are dispersed so as to be provided with particle sizes almost up to those of primary particles and which has good electrophotographic properties; a method of manufacturing the electrophotographic photosensitive member; and a process cartridge and an electrophotographic apparatus each having the electrophotographic photosensitive member.

The inventors of the invention have made further investigation on the dispersing agent for the graft fluoropolymer as described in Patent Document 1. As a result of the investigation, the inventors of the present invention have attained improvements in dispersibility and electrophotographic property by providing the fluoroalkyl site of the dispersing agent with a specific structure. To be specific, a surface-layer coating solution containing a compound having a certain repeating structural unit is used to form the surface layer of an electrophotographic photosensitive member, thereby completing the electrophotographic photosensitive member that satisfies both of the dispersibility of fluorine-atom-containing resin particles and electrophotographic property in a high level.

That is, according to one aspect of the present invention, an electrophotographic photosensitive member includes a support and a photosensitive layer formed on the substrate, the surface layer of which contains a polymer having repeating structural units each represented by the following formula (1):

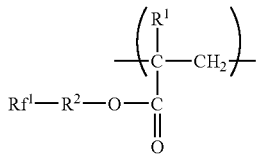

(1)

(where $R^1$ represents a hydrogen atom or a methyl group, $R^2$ represents a single bond or a divalent group, and $Rf^1$ represents a monovalent group having at least one of a fluoroalkyl group and a fluoroalkylene group), and fluorine-atom-containing resin particles, wherein 70 to 100% by number of the repeating structural units each represented by the above formula (1) in the polymer are represented by at least one of the following formulae (1-1) to (1-6):

(1-1)

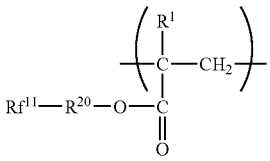

(1-2)

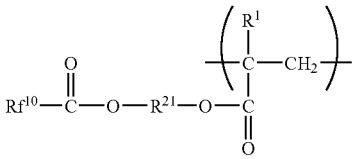

(1-3)

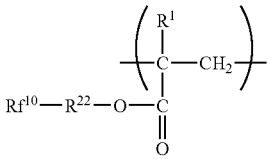

(1-4)

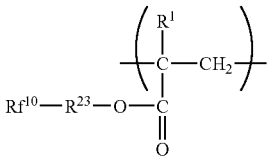

(1-5)

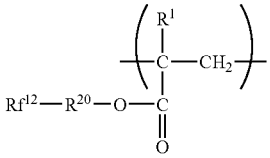

(1-6)

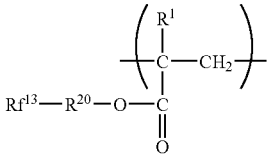

(where $R^1$ represents a hydrogen atom or a methyl group, $R^{20}$ represents a single bond or an alkylene group, $R^{21}$ represents an alkylene group having a branched structure with a carbon-carbon bond, $R^{22}$ represents a —$R^{21}$— group or a —O—$R^{21}$— group, $R^{23}$ represents a —Ar— group, a —O—Ar— group or a —O—Ar—R— group (Ar represents an arylene group and R represents an alkylene group), $Rf^{10}$ represents a monovalent group having at least a fluoroalkyl group, $Rf^{11}$ represents a fluoroalkyl group having a branched structure with a carbon-carbon bond, $Rf^{12}$ represents a fluoroalkyl group interrupted with oxygen, and $Rf^{13}$ represents a perfluoroalkyl group having 4 to 6 carbon atoms).

The present invention is also a method of manufacturing the above electrophotographic photosensitive member which includes forming the surface layer of the electrophotographic photosensitive member using a surface-layer coating solution containing a polymer having repeating structural units each represented by the above formula (1) and the fluorine-atom-containing resin particles.

The present invention is also a process cartridge including the above electrophotographic photosensitive member, and at least one unit selected from the group consisting of a charging unit, a developing unit, and a cleaning unit, wherein the member and the at least one unit are integrally supported and detachably attached to the main body of an electrophotographic apparatus.

The present invention is also an electrophotographic apparatus including the electrophotographic photosensitive member, a charging unit, an exposing unit, a developing unit, and a transfer unit.

According to the present invention, it is possible to provide an electrophotographic photosensitive member in which fluorine-atom-containing resin particles are dispersed so as to be provided with particle sizes almost up to those of primary particles and which has good electrophotographic properties; a method of manufacturing the electrophotographic photosensitive member can be provided; and a process cartridge and an electrophotographic apparatus each having the electrophotographic photosensitive member can be provided.

DESCRIPTION OF THE EMBODIMENTS

Figure 1A:
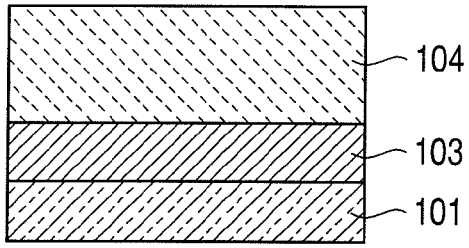
FIG. 1A, FIG. 1B, FIG. 1C, FIG. 1D, and FIG. 1E are diagrams that illustrate examples of the layer structure of an electrophotographic photosensitive member of the present invention.
Figure 1D:
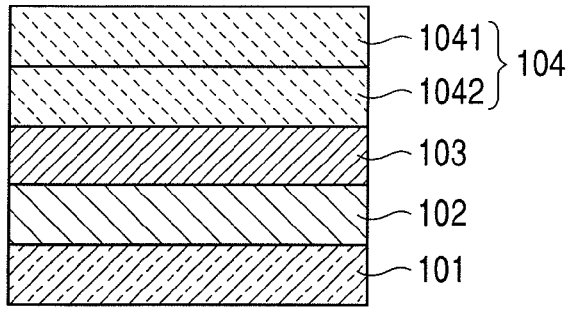
Figure 1B:
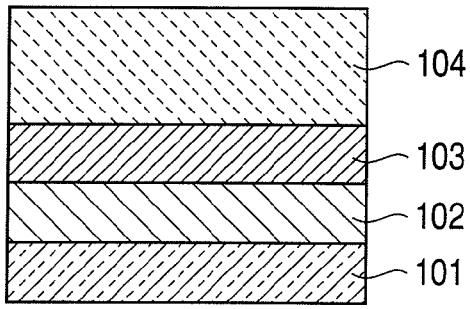

Hereinafter, the present invention will be described in more detail.

A polymer having the aforementioned repeating structural units, which is used in the present invention, keeps electrophotographic properties in a favorable condition. In addition, such a polymer disperses fluorine-atom-containing resin particles so that the particles can be provided with particle sizes almost up to those of primary particles. Further, the polymer can maintain those conditions. The present invention attains the aforementioned object by allowing the surface layer of an electrophotographic photosensitive member to include the polymer having the aforementioned specific repeating structural units in addition to the fluorine-atom-containing resin particles.

The above polymer having specific repeating structural units is a polymer having repeating structural units each represented by the following formula (1):

(1)

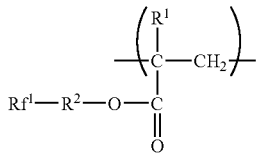

(where $R^1$ represents a hydrogen atom or a methyl group, $R^2$ represents a single bond or a divalent group, and $Rf^1$ represents a monovalent group having at least one of a fluoroalkyl group and a fluoroalkylene group), in which 70 to 100% by number of the repeating structural units each represented by the above formula (1) in the polymer are represented by at least one of the following formulae (1-1) to (1-6):

(1-1)

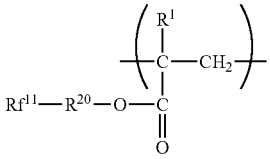

(1-2)

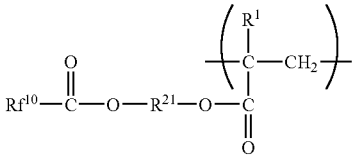

(1-3)

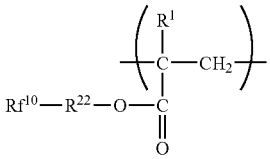

(1-4)

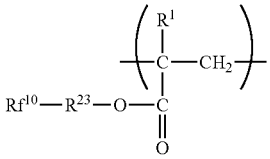

(1-5)

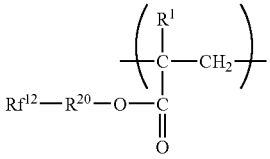

(1-6)

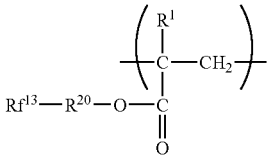

(where $R^1$ represents a hydrogen atom or a methyl group, $R^{20}$ represents a single bond or an alkylene group, $R^{21}$ represents an alkylene group having a branched structure with a carbon-carbon bond, $R^{22}$ represents a —$R^{21}$— group or a —O—$R^{21}$— group, $R^{23}$ represents a —Ar— group, a —O—Ar— group, or a —O—Ar—R— group (Ar represents an arylene group and R represents an alkylene group), $Rf^{10}$ represents a monovalent group having at least a fluoroalkyl group, $Rf^{11}$ represents a fluoroalkyl group having a branched structure with a carbon-carbon bond, $Rf^{12}$ represents a fluoroalkyl group interrupted with oxygen, and $Rf^{13}$ represents a perfluoroalkyl group having 4 to 6 carbon atoms).

Referring to Formula (1):

$R^1$ in the above formula (1) represents a hydrogen atom or a methyl group.

$R^2$ in the above formula (1) represents a single bond or a divalent group. The divalent group may be preferably one having at least an alkylene group or an arylene group in its structure. Examples of the alkylene group include: linear alkylene groups such as a methylene group, an ethylene group, a propylene group, a butylene group, a pentylene group, and a hexylene group; and branched alkylene groups such as an isopropylene group and an isobutylene group. Of those, the methylene group, the ethylene group, the propylene group, and the butylene group are preferable. Examples of the arylene group include a phenylene group, a naphthylene group, and a biphenylene group. Of those, the phenylene group is preferable.

In the above formula (1), $Rf^1$ represents a monovalent group having at least one of a fluoroalkyl group and a fluoroalkylene group. Examples of the fluoroalkyl groups include the following:

(CF-1)

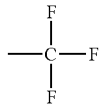

(CF-2)

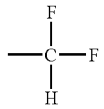

(CF-3)

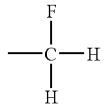

Examples of the fluoroalkylene group include the following:

(CF-4)

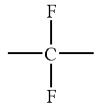

(CF-5)

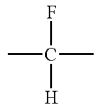

Referring to Formula (1-1):

$R^1$ in the above formula (1-1) represents a hydrogen atom or a methyl group.

$R^{20}$ in the above formula (1-1) represents a single bond or an alkylene group. Examples of the alkylene group include linear alkylene group such as a methylene group, an ethylene group, a propylene group, a butylene group, a pentylene group, and a hexylene group. Of those, the methylene group, the ethylene group, the propylene group, and the butylene group are preferable.

$Rf^{11}$ in the above formula (1-1) represents a fluoroalkyl group having a branched structure with a carbon-carbon bond. Here, the branched structure with a carbon-carbon bond refers to a structure in which the longest bonding chain and the side chain thereof are bonded with each other by a carbon-carbon bond. In addition, part or the whole of the longest bonding chain and/or the side chain may be substituted with fluorine.

Specific examples of $Rf^{11}$ in the above formula (1-1) will be represented below.
(Rf11-1)
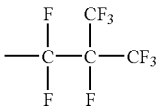
(Rf11-2)
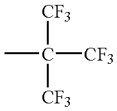
(Rf11-3)
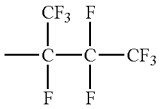
(Rf11-4)
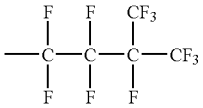
(Rf11-5)
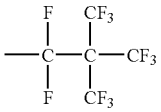
(Rf11-6)
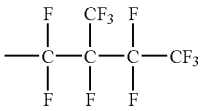
(Rf11-7)
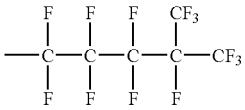
(Rf11-8)
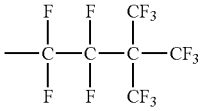
(Rf11-9)
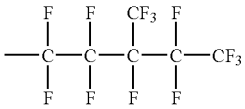
(Rf11-10)
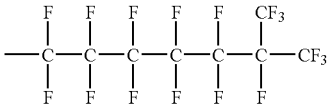
(Rf11-11)
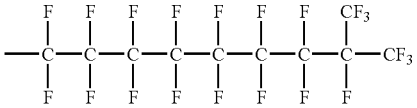
(Rf11-12)
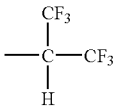
(Rf11-13)
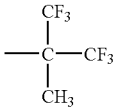
-continued
(Rf11-14)
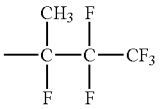
(Rf11-15)
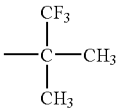
(Rf11-16)
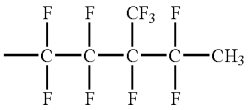
(Rf11-17)
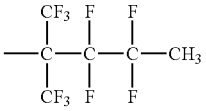
(Rf11-18)
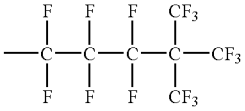
Of those, the fluoroalkyl groups represented by the above formulae (Rf11-1), (Rf11-7), (Rf11-17), and (Rf11-18) are preferable.
Specific examples of the repeating structural unit represented by the above formula (1-1) include the following:
(1-1-1)
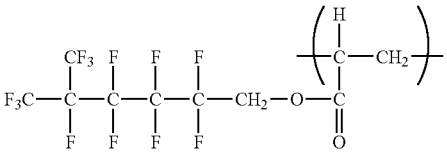
(1-1-2)
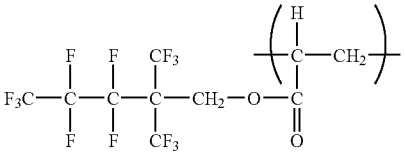
(1-1-3)
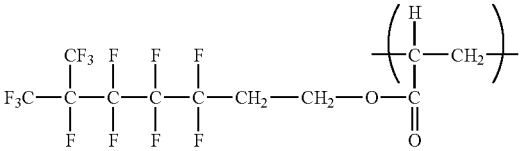
(1-1-4)
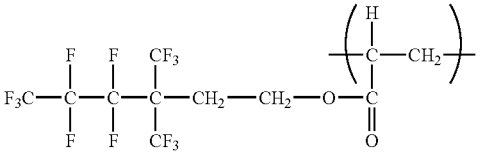

-continued (1-1-5)

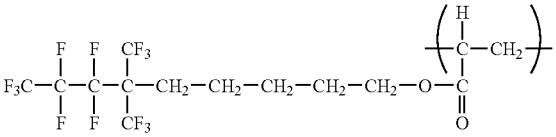

(1-1-6)

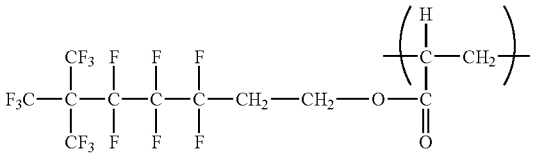

(1-1-7)

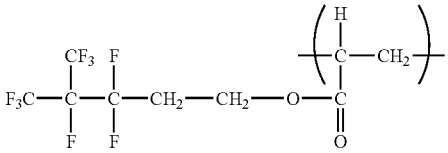

(1-1-8)

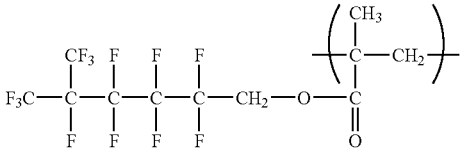

(1-1-9)

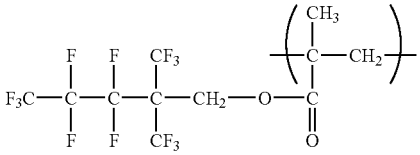

(1-1-10)

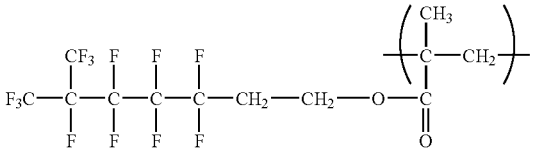

(1-1-11)

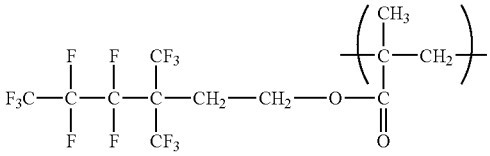

(1-1-12)

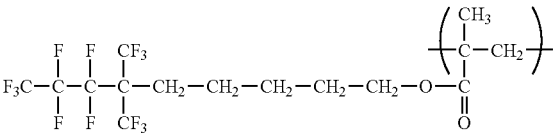

(1-1-13)

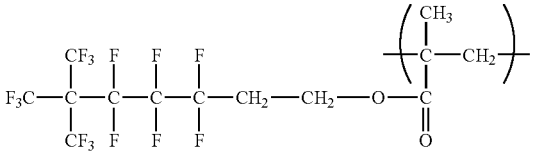

-continued (1-1-14)

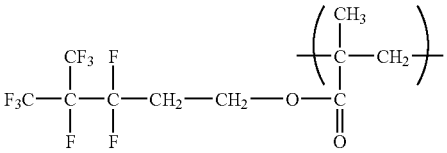

Of those, the repeating structural units represented by the above formulae (1-1-3), (1-1-4), (1-1-6), (1-1-7), (1-1-10), (1-1-11), (1-1-13), and (1-1-14) are preferable.

For favorably dispersing fluorine-atom-containing resin particles in the surface layer and stably maintaining such a dispersion state, it is important that a polymer having the repeating structural unit represented by the above formula (1) for the present invention is a polymer having at least one of the fluoroalkyl group and the fluoroalkylene group in the repeating structural unit. Further, the polymer having the repeating structural units represented by the above formula (1) for the present invention contains repeating structural units represented by at least one of the above formulae (1-1) to (1-6) in an amount of 70 to 100% by number.

In the case of the repeating structural unit represented by the above formula (1-1), the inventors of the present invention have an opinion that the effects of the present invention is due to an affinity between the fluoroalkyl group having a branched structure with a carbon-carbon bond and the fluorine-atom-containing resin particles included in the repeating structural unit represented by the above formula (1-1).

Further, the polymer having the repeating structural units represented by the above formula (1) for the present invention contains the repeating structural unit represented by the above formula (1-1) preferably in an amount of 70 to 100% by number, more preferably in an amount of 90 to 100% by number.

Referring to Formula (1-2):

$R^1$ in the above formula (1-2) represents a hydrogen atom or a methyl group.

$R^{21}$ in the above formula (1-2) represents an alkylene group having a branched structure with a carbon-carbon bond. The branched structure with a carbon-carbon bond refers to a structure in which the longest bonding chain and the side chain thereof are bonded by a carbon-carbon bond. The longest bonding chain is preferably formed of 2 to 6 carbon atoms. In addition, any substituent on the side chain portion may include an alkyl group and a fluoroalkyl group. The alkyl group may include a methyl group, an ethyl group, a propyl group, or a butyl group. Of those, the methyl group and the ethyl group are preferable. The fluoroalkyl group may include, for example, the groups represented by the above formulae (CF-1) to (CF-3). Of those, the group represented by the above formula (CF-1) is preferable.

$Rf^{10}$ in the above formula (1-2) represents a monovalent group with at least a fluoroalkyl group. Examples of the fluoroalkyl group include the groups represented by the above formulae (CF-1) to (CF-3). In addition, $Rf^{10}$ is not necessarily required to have a linear structure and may have a branched structure. Alternatively, $Rf^{10}$ may be a fluoroalkyl group interrupted with an oxygen atom.

Specific examples of $Rf^{10}$ in the above formula (1-2) will be represented below.
(Rf10-1)
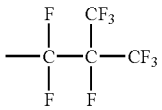
(Rf10-2)
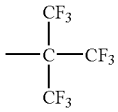
(Rf10-3)
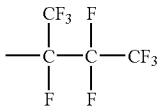
(Rf10-4)
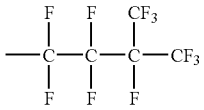
(RF10-5)
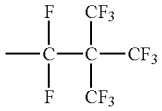
(Rf10-6)
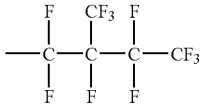
(Rf10-7)
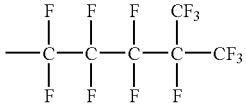
(Rf10-8)
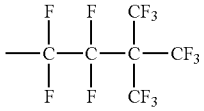
(Rf10-9)
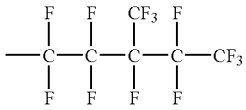
(Rf10-10)
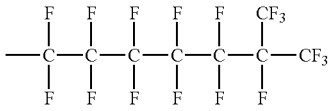
(Rf10-11)
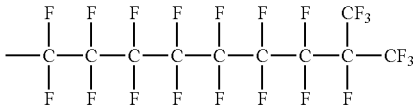
(Rf10-12)
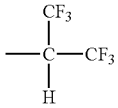
(Rf10-13)
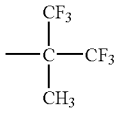
-continued
(Rf10-14)
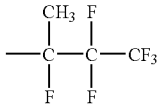
(Rf10-15)
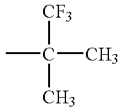
(Rf10-16)
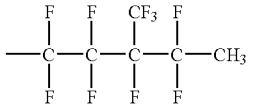
(Rf10-17)
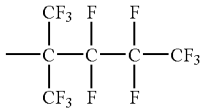
(Rf10-18)
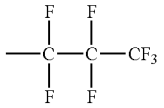
(Rf10-19)
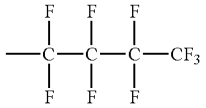
(Rf10-20)
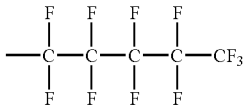
(Rf10-21)
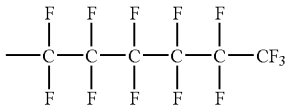
(Rf10-22)
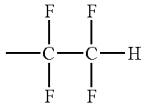
(Rf10-23)
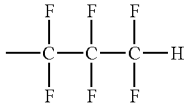
(Rf10-24)
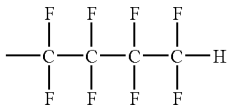
(Rf10-25)
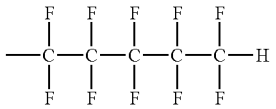
(Rf10-26)
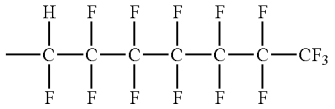

-continued
(Rf10-27)
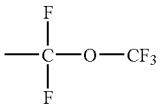
(Rf10-28)
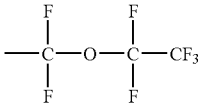
(Rf10-29)
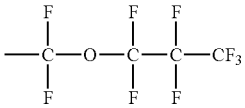
(Rf10-30)
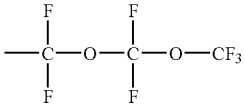
(Rf10-31)
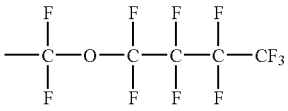
(Rf10-32)
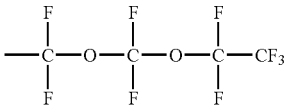
(Rf10-33)
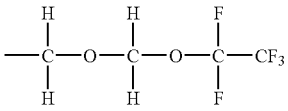
(RF10-34)
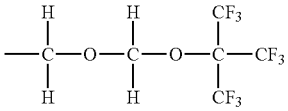
(Rf10-35)
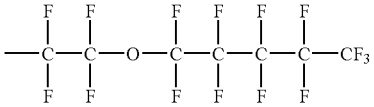
(Rf10-36)
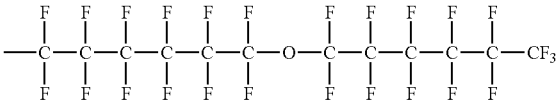
Of those, a monovalent group having a fluoroalkyl group represented by the above formula (Rf10-19) or (Rf10-24) is preferable.
Specific examples of the repeating structural unit represented by the above formula (1-2) include the following:
(1-2-1)
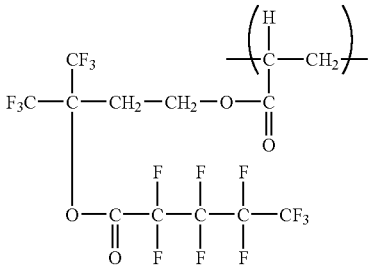
(1-2-2)
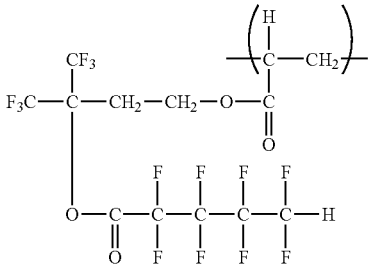
(1-2-3)
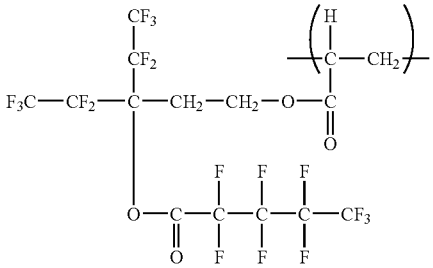
(1-2-4)
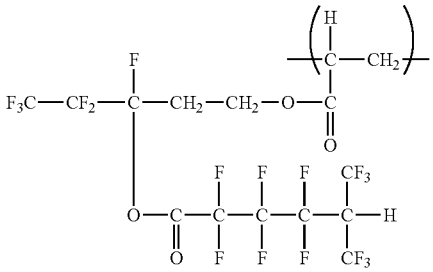
(1-2-5)
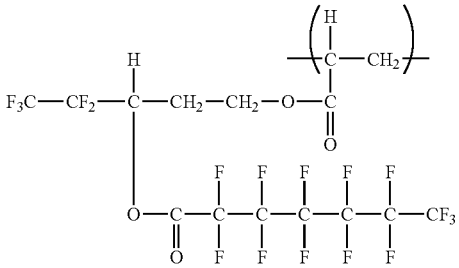

-continued (1-2-6)

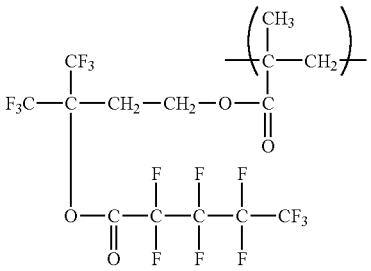

(1-2-7)

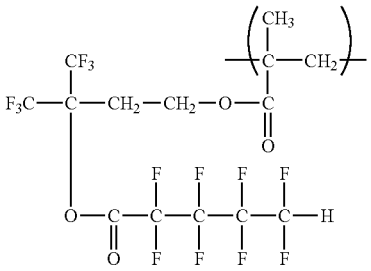

Of those, a repeating structural unit represented by the above formula (1-2-1) or (1-2-2) is preferable.

As described above, for favorably dispersing fluorine-atom-containing resin particles in the surface layer and stably maintaining such a dispersion state, it is important that a polymer having the repeating structural unit represented by the above formula (1) for the present invention is a polymer having at least one of the fluoroalkyl group and the fluoroalkylene group in the repeating structural unit. Further, the polymer having the repeating structural units represented by the above formula (1) for the present invention contains repeating structural units represented by at least one of the above formulae (1-1) to (1-6) in an amount of 70 to 100% by number.

In the case of the repeating structural unit represented by the above formula (1-2), the inventors of the present invention have an opinion that the effects of the present invention is due to an affinity among the fluoroalkyl group, the fluoroalkylene group, and the fluorine-atom-containing resin particles in the repeating structural unit represented by the above formula (1-2). In addition, the effect of the alkylene group having a branched structure with a carbon-carbon bond is considered to lead to an increase in the compatibility between the binder resin and the polymer having the repeating structural unit represented by the above formula (1) for the present invention, to thereby improve dispersion stability.

Further, the polymer having the repeating structural units represented by the above formula (1) for the present invention contains the repeating structural unit represented by the above formula (1-2) preferably in an amount of 70 to 100% by number, more preferably in an amount of 90 to 100% by number.

Referring to Formula (1-3):

$R^1$ in the above formula (1-3) represents a hydrogen atom or a methyl group.

$R^{22}$ in the above formula (1-3) represents a —$R^{21}$— group or a —O—$R^{21}$— group. To be specific, the —$R^{21}$— group represents an alkylene group having a branched structure with a carbon-carbon bond. The branched structure with a carbon-carbon bond refers to a structure in which the longest bonding chain and the side chain thereof are bonded by a carbon-carbon bond. The longest bonding chain is preferably formed of 2 to 6 carbon atoms. In addition, any substituent on the side chain portion may include an alkyl group and a fluoroalkyl group. The alkyl group may include a methyl group, an ethyl group, a propyl group, or a butyl group. Of those, the methyl group and the ethyl group are preferable. The fluoroalkyl group may include, for example, the groups represented by the above formulae (CF-1) to (CF-3). Of those, the group represented by the above formula (CF-1) is preferable. Further, a —O—$R^{21}$— group represents a structure in which the alkylene group having a branched structure with a carbon-carbon structure as described above is bonded to $Rf^{10}$ through an oxygen atom.

$Rf^{10}$ in the above formula (1-3) represents a monovalent group with at least a fluoroalkyl group. Examples of the fluoroalkyl group include the groups represented by the above formulae (CF-1) to (CF-3). In addition, $Rf^{10}$ is not necessarily required to have a linear structure, and may have a branched structure. Alternatively, $Rf^{10}$ may be a fluoroalkyl group interrupted with an oxygen atom.

Specific examples of $Rf^{10}$ in the above formula (1-3) include the above formulae (Rf10-1) to (Rf10-36). Of those, monovalent groups with fluoroalkyl groups represented by the above formulae (Rf10-10) and (Rf10-19) are preferable.

Specific examples of the repeating structural unit represented by the above formula (1-3) include the following:

(1-3-1)

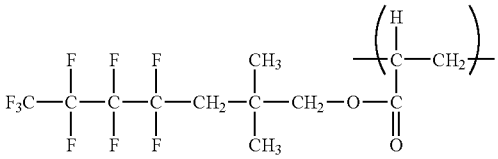

(1-3-2)

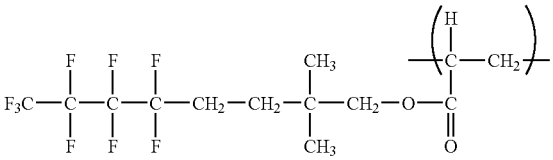

(1-3-3)

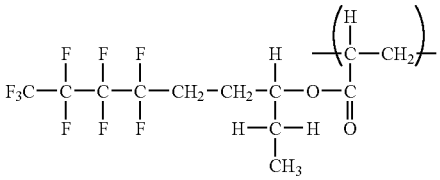

(1-3-4)

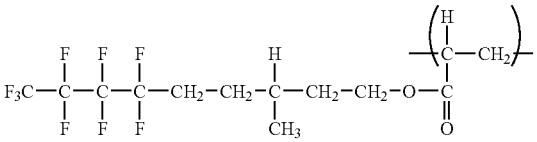

-continued (1-3-5)

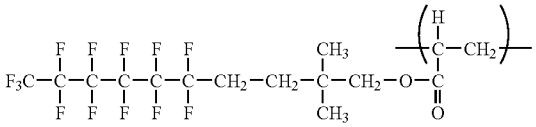

(1-3-6)

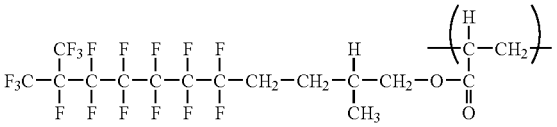

(1-3-7)

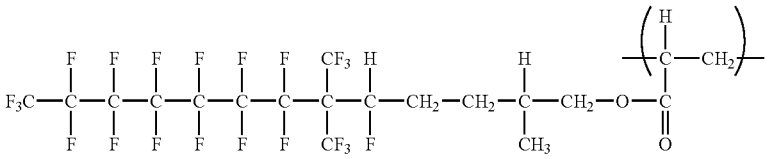

(1-3-8)

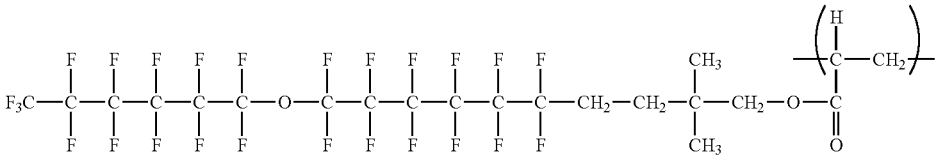

(1-3-9)

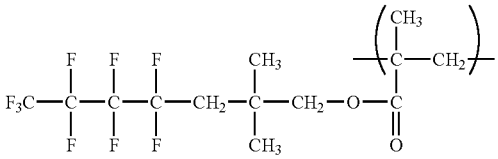

(1-3-10)

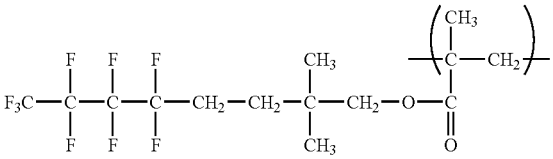

(1-3-11)

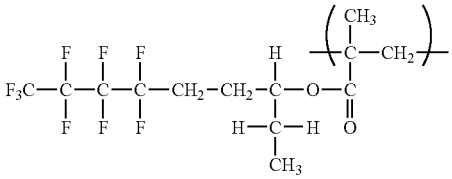

(1-3-12)

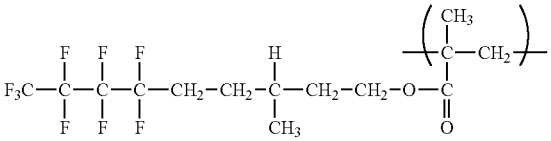

(1-3-13)

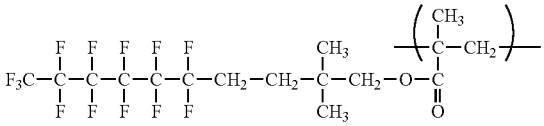

(1-3-14)

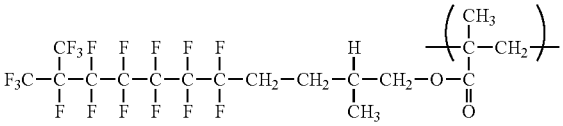

(1-3-15)

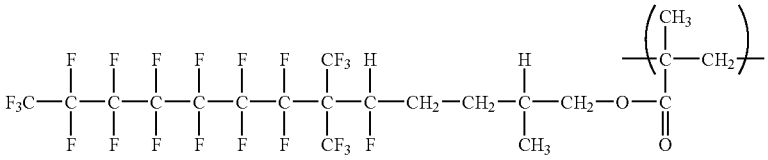

(1-3-16)

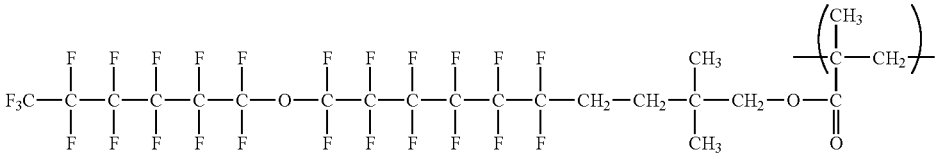

Of those, the repeating structural units represented by the above formulae (1-3-1), (1-3-2), (1-3-3), (1-3-4), (1-3-6), (1-3-9), (1-3-10), (1-3-11), (1-3-12), and (1-3-14) are preferable.

As described above, for favorably dispersing fluorine-atom-containing resin particles in the surface layer and stably maintaining such a dispersion state, it is important that a polymer having the repeating structural unit represented by the above formula (1) for the present invention is a polymer having at least one of the fluoroalkyl group and the fluoroalkylene group in the repeating structural unit. Further, the polymer having the repeating structural units represented by the above formula (1) for the present invention contains repeating structural units represented by at least one of the above formulae (1-1) to (1-6) in an amount of 70 to 100% by number.

In the case of the repeating structural unit represented by the above formula (1-3), the inventors of the present invention have an opinion that the effects of the present invention is due to an affinity between the fluoroalkyl group or the fluoroalkylene group included in the repeating structural unit represented by the above formula (1-3) and the fluorine-atom-containing resin particles. In addition, the effect of the alkylene group having a branched structure with a carbon-carbon bond leads to an increase in the compatibility between the binder resin and the polymer having the repeating structural unit represented by the above formula (1) for the present invention, to thereby improve dispersion stability.

Further, the polymer having the repeating structural units represented by the above formula (1) for the present invention contains the repeating structural unit represented by the above formula (1-3) preferably in an amount of 70 to 100% by number, more preferably in an amount of 90 to 100% by number.

Referring to Formula (1-4):

$R^1$ in the above formula (1-4) represents a hydrogen atom or a methyl group.

$R^{23}$ in the above formula (1-4) represents a —Ar— group, a —O—Ar— group, or a —O—Ar—R— group (Ar represents an arylene group and R represents an alkylene group). Examples of the arylene group of Ar include a phenylene group, a naphthylene group, and a biphenylene group. Of those, the phenylene group is preferable. Examples of the alkylene group of R include: linear alkylene groups such as a methylene group, an ethylene group, a propylene group, a butylene group, a pentylene group, and a hexylene group; and branched alkylene group, such as an isopropylene group and an isobutylene group. Of those, the methylene group, the ethylene group, the propylene group, and the butylene group are preferable. The —O—Ar— group or the —O—Ar—R— group represents a structure in which Ar is bonded to $Rf^{10}$ through an oxygen atom.

$Rf^{10}$ in the above formula (1-4) represents a monovalent group with at least a fluoroalkyl group. The fluoroalkyl group may include, for example, groups represented by the above formulae (CF-1) to (CF-3). Further, $Rf^{10}$ is not necessarily required to have a linear structure, and may have a branched structure. Alternatively, $Rf^{10}$ may be a fluoroalkyl group bonded with an oxygen atom.

Specific examples of $Rf^{10}$ in the above formula (1-4) include the above formulae (Rf10-1) to (Rf10-36). Of those, monovalent groups with fluoroalkyl groups represented by the above formulae (Rf10-21) and (Rf10-36) are preferable.

Specific examples of the repeating structural unit represented by the above formula (1-4) include the following:

(1-4-1)

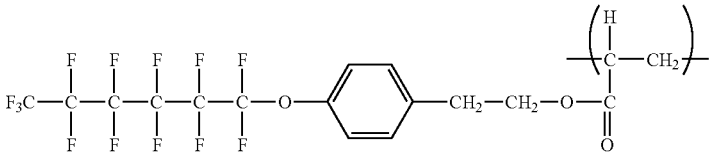

(1-4-2)

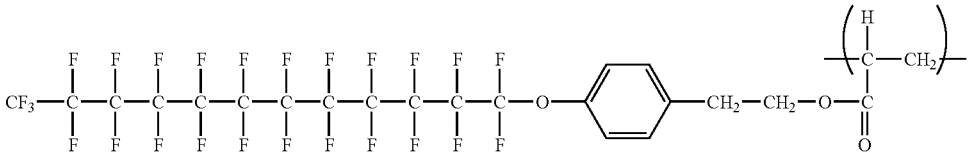

(1-4-3)

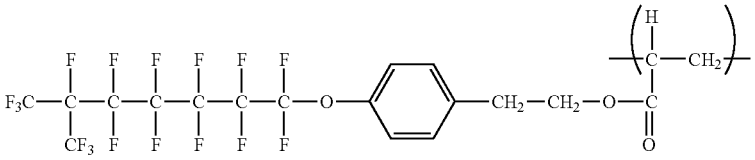

(1-4-4)

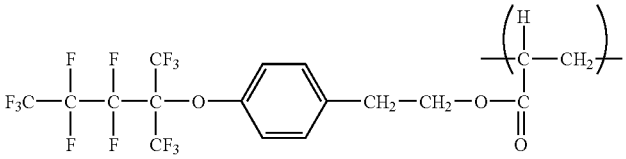

(1-4-5)

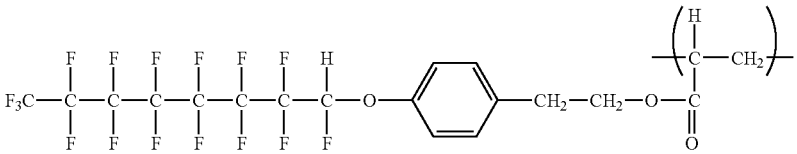

-continued
(1-4-6)
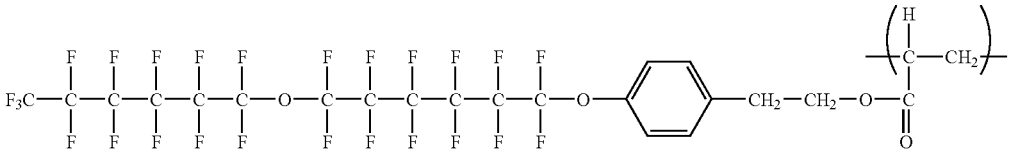
(1-4-7)
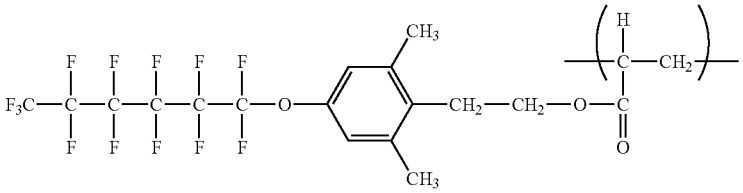
(1-4-8)
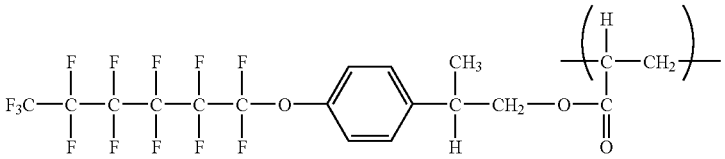
(1-4-9)
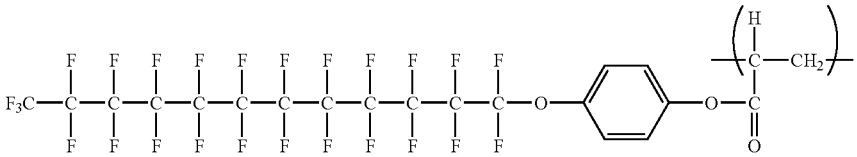
(1-4-10)
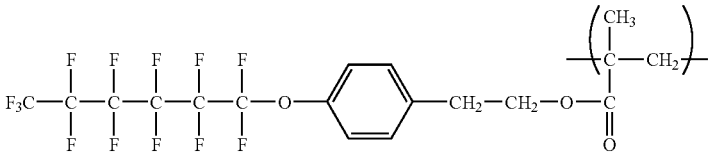
(1-4-11)
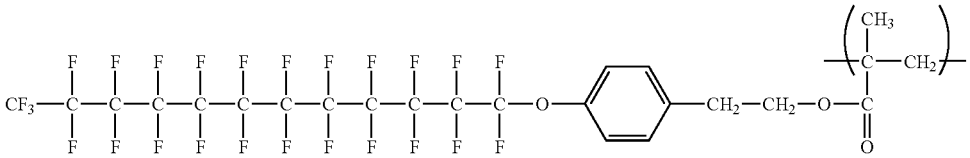
(1-4-12)
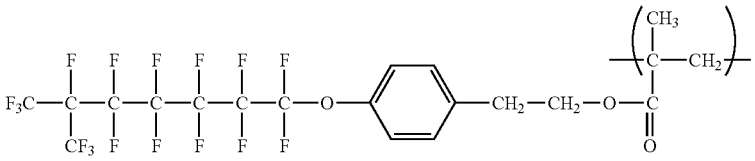
(1-4-13)
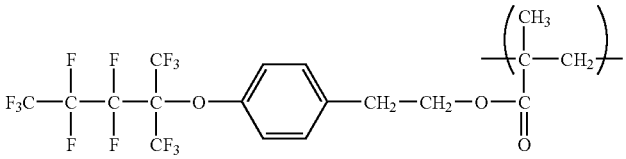
(1-4-14)
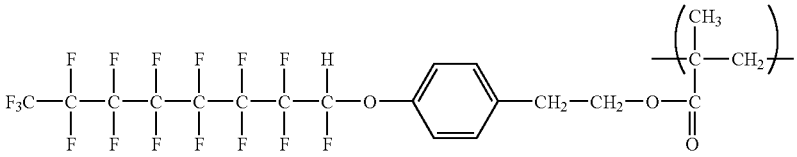

-continued (1-4-15)

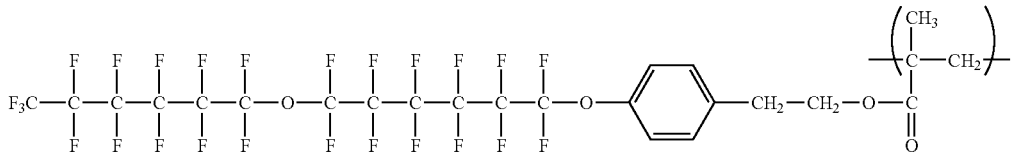

(1-4-16)

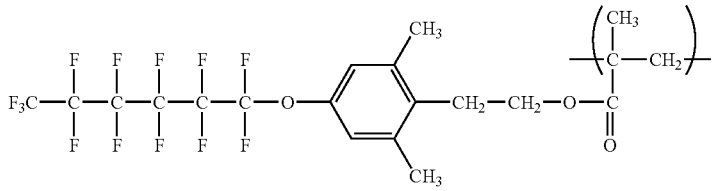

(1-4-17)

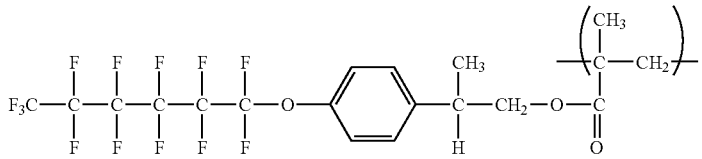

(1-4-18)

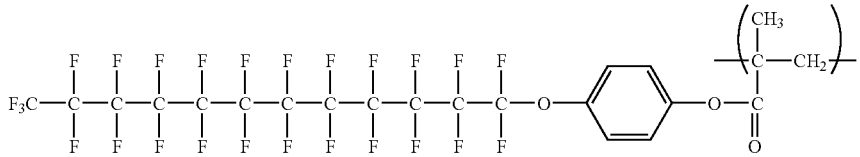

Of those, the repeating structural units represented by the above formulae (1-4-1), (1-4-6), (1-4-7), (1-4-8), (1-4-10), (1-4-15), (1-4-16), and (1-4-17) are preferable.

As described above, for favorably dispersing fluorine-atom-containing resin particles in the surface layer and stably maintaining such a dispersion state, it is important that a polymer having the repeating structural units represented by the above formula (1) for the present invention is a polymer having at least one of the fluoroalkyl group and the fluoroalkylene group in the repeating structural unit. Further, the polymer having the repeating structural units represented by the present formula (1) for the above invention contains repeating structural units represented by at least one of the above formulae (1-1) to (1-6) in an amount of 70 to 100% by number.

In the case of the repeating structural unit represented by the above formula (1-4), the inventors of the present invention have an opinion that the effects of the present invention is due to an affinity between the fluoroalkyl group or the fluoroalkylene group included in the repeating structural unit represented by the above formula (1-4) and the fluorine-atom-containing resin particles. In addition, the effect of the arylene group leads to an increase in the compatibility between the binder resin and the polymer having the repeating structural units represented by the above formula (1) for the present invention, to thereby improve dispersion stability.

Further, the polymer having the repeating structural units represented by the above formula (1) for the present invention contains the repeating structural unit represented by the above formula (1-4) preferably in an amount of 70 to 100% by number, more preferably in an amount of 90 to 100% by number.

Referring to Formula (1-5):

$R^1$ in the above formula (1-5) represents a hydrogen atom or a methyl group.

$R^{20}$ in the above formula (1-5) represents a single bond or an alkylene group. Examples of the alkylene group include linear alkylene groups such as a methylene group, an ethylene group, a propylene group, a butylene group, a pentylene group, and a hexylene group. Of those, the methylene group, the ethylene group, the propylene group, and the butylene group are preferable.

$Rf^{12}$ in the above formula (1-5) represents a fluoroalkyl group interrupted with oxygen. The fluoroalkyl group interrupted with oxygen refers to a group in which at least one oxygen atom is included in the longest bonding chain. Alternatively, a fluoroalkyl group or a fluoroalkylene group may be present on one side or both sides of the oxygen atom.

Specific examples of $Rf^{12}$ in the above formula (1-5) will be shown below.

(Rf12-1)

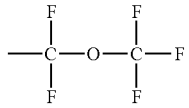

(Rf12-2)

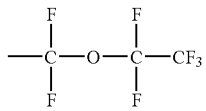

(Rf12-3)

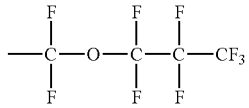

-continued
(RF12-4)
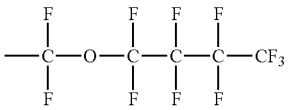
(RF12-5)
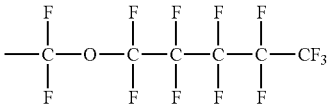
(Rf12-6)
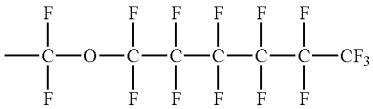
(Rf12-7)
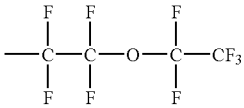
(Rf12-8)
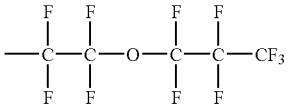
(Rf12-9)
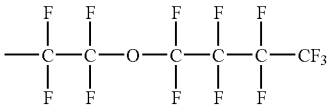
(Rf12-10)
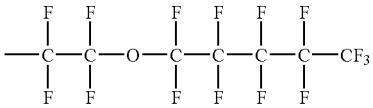
(Rf12-11)
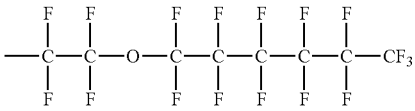
-continued
(Rf12-12)
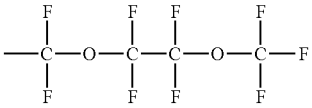
(Rf12-13)
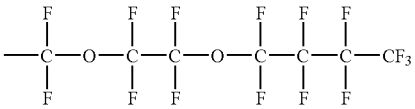
(Rf12-14)
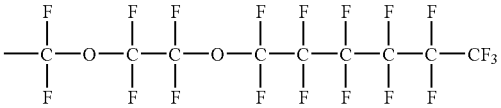
(Rf12-15)
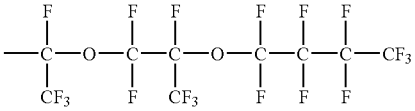
(Rf12-16)
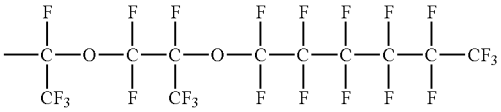
(Rf12-17)
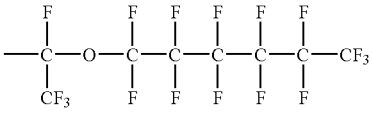
Of those, the groups represented by the above formulae (Rf12-13), (Rf12-14), (Rf12-16), and (Rf12-17) are preferable.
Specific examples of the repeating structural unit represented by the above formula (1-5) include the following:
(1-5-1)
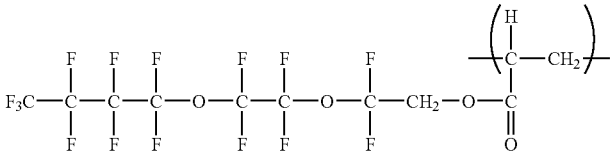
(1-5-2)
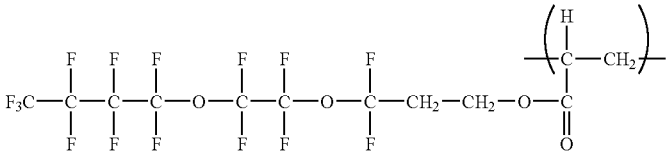
(1-5-3)
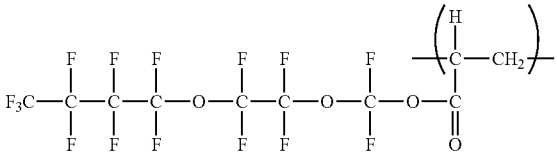

-continued (1-5-4)

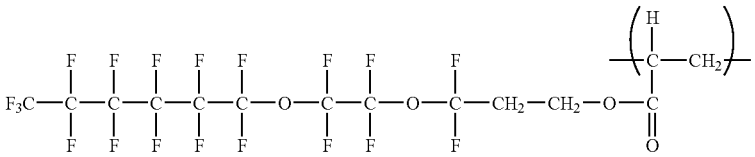

(1-5-5)

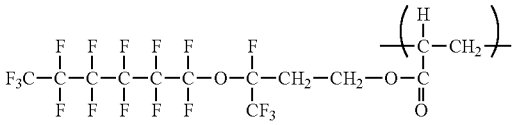

(1-5-6)

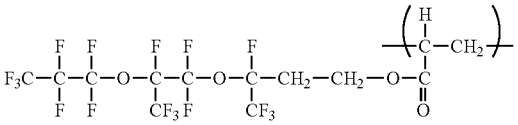

(1-5-7)

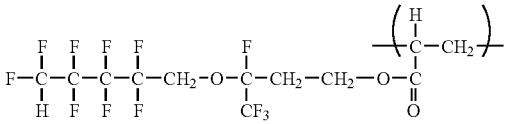

(1-5-8)

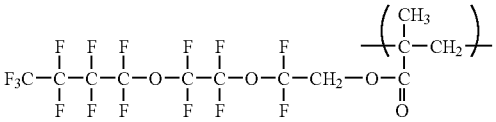

(1-5-9)

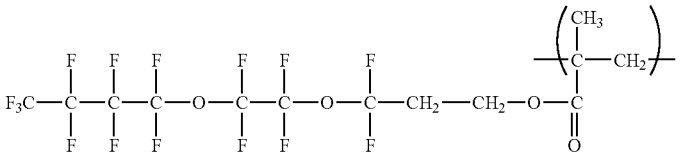

(1-5-10)

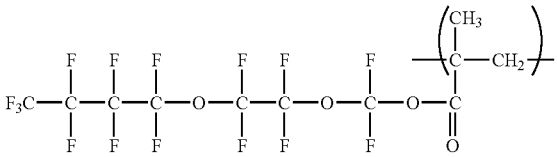

(1-5-11)

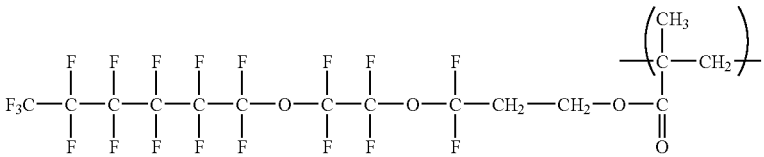

(1-5-12)

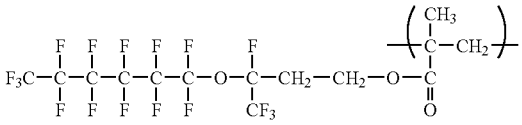

(1-5-13)

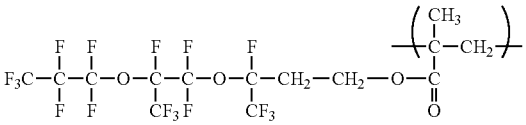

(1-5-14)

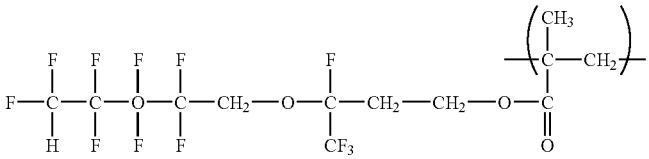

Of those, the repeating structural units represented by the above formulae (1-5-2), (1-5-4), (1-5-5), (1-5-6), (1-5-8), (1-5-11), (1-5-12), and (1-5-13) are preferable.

As described above, for favorably dispersing fluorine-atom-containing resin particles in the surface layer and stably maintaining such a dispersion state, it is important that a polymer having the repeating structural units represented by the above formula (1) for the present invention is a polymer having at least one of the fluoroalkyl group and the fluoroalkylene group in the repeating structural unit. Further, the polymer having the repeating structural units represented by the above formula (1) for the present invention contains repeating structural units represented by at least one of the above formulae (1-1) to (1-6) in an amount of 70 to 100% by number.

In the case of the repeating structural unit represented by the above formula (1-5), the inventors of the present invention have an opinion that the effects of the present invention is due to an affinity between the fluoroalkyl group interrupted with oxygen included in the repeating structural unit represented by the above formula (1-5) and the fluorine-atom-containing resin particles.

Further, the polymer having the repeating structural units represented by the above formula (1) for the present invention contains the repeating structural unit represented by the above formula (1-5) preferably in an amount of 70 to 100% by number, more preferably in an amount of 90 to 100% by number.

Referring to Formula (1-6):

$R^1$ in the above formula (1-6) represents a hydrogen atom or a methyl group.

$R^{20}$ in the above formula (1-6) represents a single bond or an alkylene group. Examples of the alkylene group include linear alkylene groups such as a methylene group, an ethylene group, a propylene group, a butylene group, a pentylene group, and a hexylene group. Of those, the methylene group, the ethylene group, the propylene group, and the butylene group are preferable.

$Rf^{13}$ in the above formula (1-6) represents a perfluoroalkyl group with 4 to 6 carbon atoms.

Specific examples of $Rf^{13}$ in the above formula (1-6) will be shown below.

(Rf13-1)

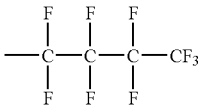

(Rf13-2)

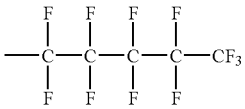

(Rf13-3)

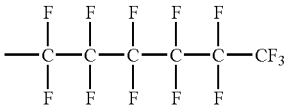

Of those, groups represented by the above formulae (Rf13-1) and (Rf13-3) are preferable.

Specific examples of the repeating structural unit represented by the above formula (1-6) include the following:

(1-6-1)

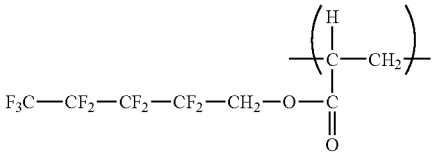

(1-6-2)

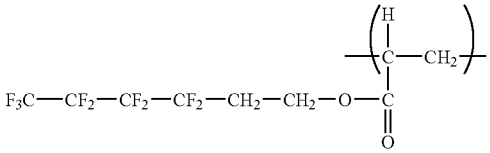

(1-6-3)

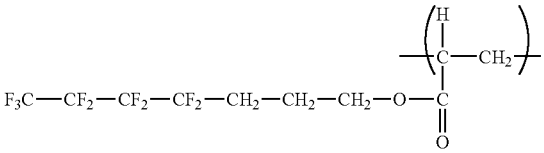

-continued (1-6-4)

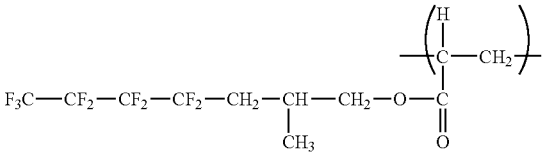

(1-6-5)

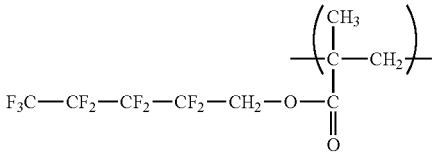

(1-6-6)

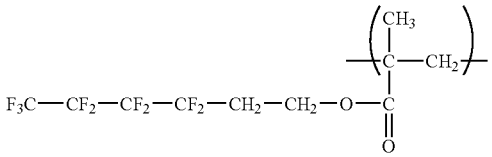

(1-6-7)

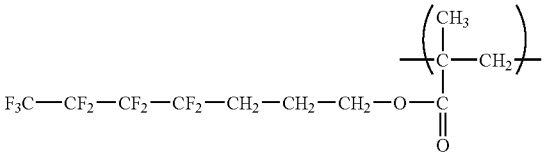

(1-6-8)

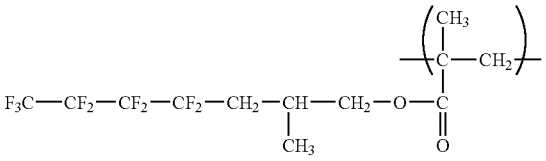

(1-6-9)

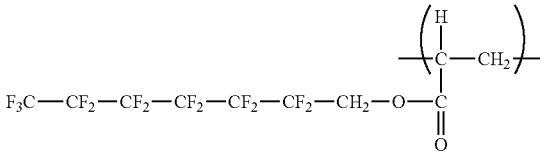

(1-6-10)

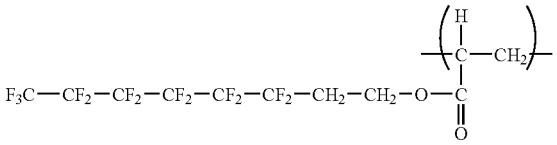

(1-6-11)

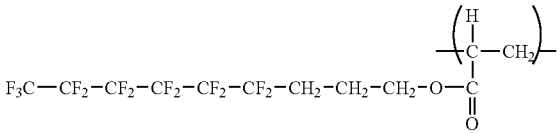

(1-6-12)

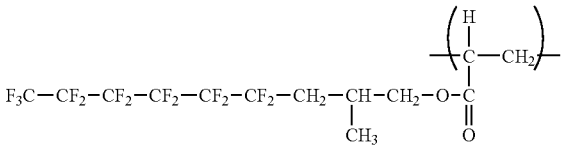

-continued (1-6-13)

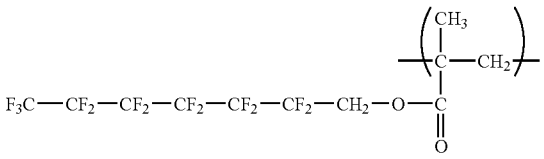

(1-6-14)

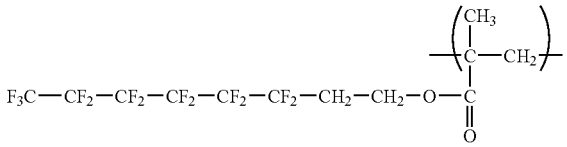

(1-6-15)

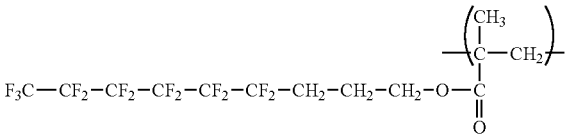

(1-6-16)

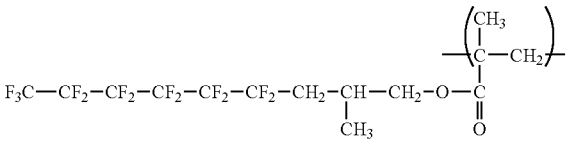

Of those, the repeating structural units represented by the above formulae (1-6-1), (1-6-2), (1-6-6), (1-6-7), (1-6-10), (1-6-11), (1-6-14), and (1-6-15) are preferable.

As described above, for favorably dispersing fluorine-atom-containing resin particles in the surface layer and stably maintaining such a dispersion state, it is important that a polymer having the repeating structural units represented by the above formula (1) for the present invention is a polymer having at least one of the fluoroalkyl group and the fluoroalkylene group in the repeating structural unit. Further, the polymer having the repeating structural units represented by the above formula (1) for the present invention contains repeating structural units represented by at least one of the above formulae (1-1) to (1-6) in an amount of 70 to 100% by number.

In the case of the repeating structural unit represented by the above formula (1-6), the inventors of the present invention have an opinion that the effects of the present invention is due to an affinity between the fluoroalkyl group included in the repeating structural unit represented by the above formula (1-6) and the fluorine-atom-containing resin particles.

Further, the polymer having the repeating structural unit represented by the above formula (1) for the present invention is preferably formed only of the repeating structural unit represented by the above formula (1-6).

Further, for keeping the dispersion state of the fluorine-atom-containing resin particles stable, in addition to the repeating structural unit represented by the above formula (1), any structure with an affinity for the binder resin of the surface layer may be included in the structure of the polymer having the repeating structural unit represented by the formula (1) for the present invention.

Examples of the structure having compatibility with the binder resin of the surface layer include polymer units made up of repeating structural units of an alkyl acrylate structure, an alkyl methacrylate structure, and a styrene structure. For further enhancing the effects of the present invention, the polymer having the repeating structural unit represented by the above formula (1) for the present invention is preferably a polymer having the repeating structural unit represented by the above formula (1) and the repeating structural unit represented by the following formula (a):

(a)

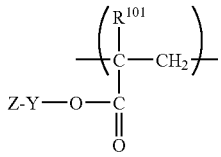

$R^{101}$ in the above formula (a) represents a hydrogen atom or a methyl group.

Y in the above formula (a), which is arbitrary as far as it is a divalent organic group, is preferably one represented by the following formula (c):

(c)

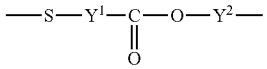

$Y^1$ and $Y^2$ in the above formula (c) each independently represent an alkylene group. Examples of the alkylene group include a methylene group, an ethylene group, a propylene group, a butylene group, a pentylene group, and a hexylene group. Of those, the methylene group, the ethylene group, and the propylene group are preferable. The substituents which those alkylene groups may have include alkyl groups, alkoxyl groups, hydroxyl groups, and aryl groups. The alkyl groups include a methyl group, an ethyl group, a propyl group, and a butyl group. Of those, the methyl group and the ethyl group are preferable. The alkoxyl groups include a methoxy group, an ethoxy group, and a propoxyl group. Of those, the methoxy group is preferable. The aryl groups include a phenyl group and a naphthyl group. Of those, the phenyl group is preferable. Further, of those, the methyl group and the hydroxyl group are more preferable.

Z in the above formula (a) is a polymer unit whose structure is not limited if only it is a polymer unit, but is preferably a polymer unit having a repeating structural unit represented by the following formula (b-1) or the following formula (b-2):

(b-1)

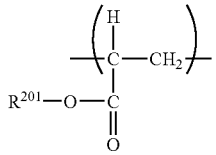

(b-2)

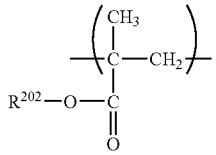

$R^{201}$ in the above formula (b-1) represents an alkyl group. Examples of the alkyl group include a methyl group, an ethyl group, a propyl group, a butyl group, a pentyl group, a hexyl group, a heptyl group, an octyl group, and a nonyl group. Of those, the methyl group, the ethyl group, the propyl group, the butyl group, the pentyl group, and the hexyl group are preferable.

$R^{202}$ in the above formula (b-2) represents an alkyl group. Examples of the alkyl group include a methyl group, an ethyl group, a propyl group, a butyl group, a pentyl group, a hexyl group, a heptyl group, an octyl group, and a nonyl group. Of those, the methyl group, the ethyl group, the propyl group, the butyl group, the pentyl group, and the hexyl group are preferable.

The terminal end of the polymer unit represented by Z in the above formula (a) may be terminated using an end-terminating agent or have a hydrogen atom.

The polymer having the repeating structural units represented by the above formula (1) for the present invention preferably has a structure in which both of a portion having a high affinity for the fluorine-atom-containing resin particles resulting from the fluoroalkyl group or the fluoroalkyl group and a portion having an affinity for the binder resin of the surface layer are included in the compound.

The repeating structural unit represented by the above formula (1) and the repeating structural unit represented by the above formula (a) may be copolymerized in any configuration. However, for allowing a fluoroalkyl portion and a fluoroalkylene portion each having a high affinity for the fluorine-atom-containing resin particles to more effectively exert their functions, a comb-type graft structure in which side chains have the repeating structural units represented by the above formula (a) is more preferable.

In addition, a copolymerization ratio between the repeating structural unit represented by the above formula (1) and the repeating structural unit represented by the above formula (a) is preferably 99:1 to 20:80, more preferably 95:5 to 30:70, in molar ratio for obtaining the effect of the present invention. The copolymerization ratio can be controlled by a molar ratio at the time of polymerizing a compound represented by the above formula (3) corresponding to the repeating structural unit represented by the above formula (1) and a compound represented by the above formula (d) corresponding to the repeating structural unit represented by the above formula (a).

The molecular weight of the polymer having the repeating structural unit represented by the above formula (1) for the present invention is preferably 1,000 to 100,000, more preferably 5,000 to 50,000, in weight-average molecular weight.

The polymer for the present invention having the repeating structural units represented by the formula (1) can be synthesized by polymerization of compounds each represented by the following formula (3):

(3)

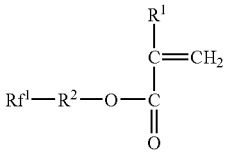

(where $R^1$ represents a hydrogen atom or a methyl group, $R^2$ represents a single bond or a divalent group, and $Rf^1$ represents a monovalent group having at least one of a fluoroalkyl group and a fluoroalkylene group.) However, 70 to 100% by number of the compounds represented by the above formula (3) should be composed of compounds represented by at least one of the following formulae (3-1) to (3-6):

(3-1)

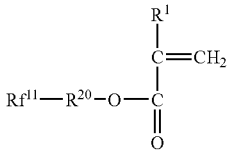

(3-2)

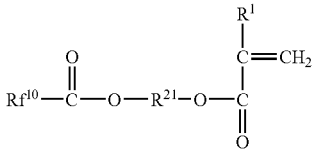

(3-3)

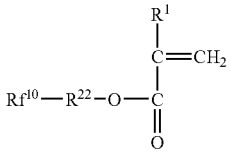

(3-4)

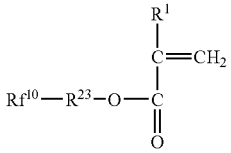

(3-5)

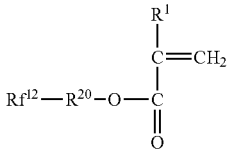

(3-6)

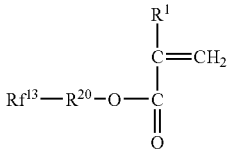

(where $R^1$ represents a hydrogen atom or a methyl group, $R^{20}$ represents a single bond or an alkylene group, $R^{21}$ represents an alkylene group having a branched structure with a carbon-carbon bond, $R^{22}$ represents a —$R^{21}$— group or a —O—$R^{21}$— group, $R^{23}$ represents a —Ar— group, a —O—Ar— group, or a —O—Ar—R— group (where Ar represents an arylene group and R represents an alkylene group.), $Rf^{10}$ represents a monovalent group having at least a fluoroalkyl group, $Rf^{11}$ represents a fluoroalkyl group having a branched structure with a carbon-carbon bond, $Rf^{12}$ represents a fluoroalkyl group interrupted with oxygen, and $Rf^{13}$ represents a perfluoroalkyl group having 4 to 6 carbon atoms.)

Referring to Formula (3):

$R^1$ in the above formula (3) represents a hydrogen atom or a methyl group.

$R^2$ in the above formula (3) represents a single bond or a divalent group. The divalent group may be preferably one having at least an alkylene group or an arylene group in its structure. Examples of the alkylene group include: linear alkylene groups such as a methylene group, an ethylene group, a propylene group, a butylene group, a pentylene group, and a hexylene group; and branched alkylene groups such as an isopropylene group and an isobutylene group. Of those, the methylene group, the ethylene group, the propylene group, and the butylene group are preferable. Examples of the arylene group include a phenylene group, a naphthylene group, and a biphenylene group. Of those, the phenylene group is preferable.

In the above formula (3), $Rf^1$ represents a monovalent group having at least one of a fluoroalkyl group and a fluoroalkylene group. Examples of the fluoroalkyl group include the following:

(CF-1)

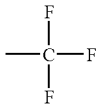

(CF-2)

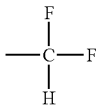

(CF-3)

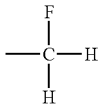

Examples of the fluoroalkylene group include the following:

(CF-4)

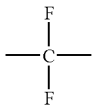

(CF-5)

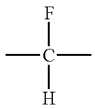

Re: Formula (3-1)

$R^1$ in the above formula (3-1) represents a hydrogen atom or a methyl group.

$R^{20}$ in the above formula (3-1) represents a single bond or an alkylene group. Examples of the alkylene group include linear alkylene groups such as a methylene group, an ethylene group, a propylene group, a butylene group, a pentylene group, and a hexylene group. Of those, the methylene group, the ethylene group, the propylene group, and the butylene group are preferable.

$Rf^{11}$ in the above formula (3-1) represents a fluoroalkyl group having a branched structure with a carbon-carbon bond. Here, the branched structure with a carbon-carbon bond represents a structure in which the longest bonding chain and the side chain thereof are bonded with each other by a carbon-carbon bond. In addition, part or the whole of the longest bonding chain and/or the side chain may be substituted with fluorine.

Specific examples of $Rf^{11}$ in the above formula (3-1) include groups represented by the above formulae (Rf11-1) to (Rf11-18).

Specific examples of the compound represented by the above formula (3-1) are shown below.

(3-1-1)

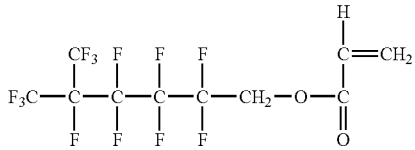

(3-1-2)

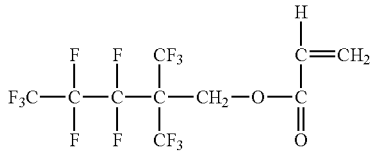

(3-1-3)

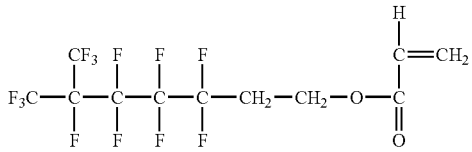

(3-1-4)

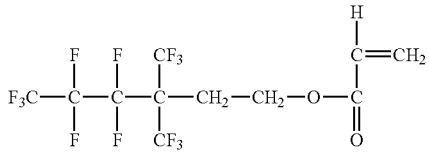

(3-1-5)

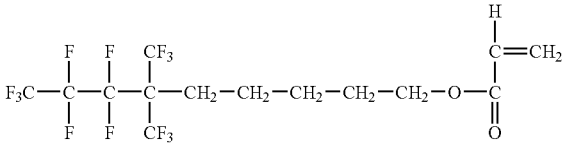

(3-1-6)

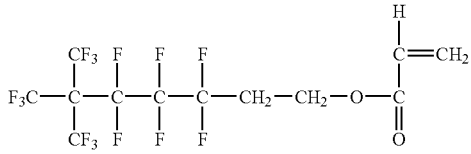

(3-1-7)

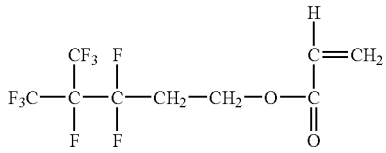

(3-1-8)

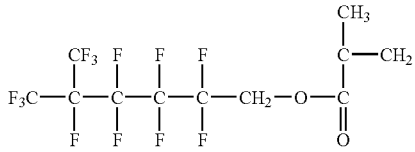

(3-1-9)

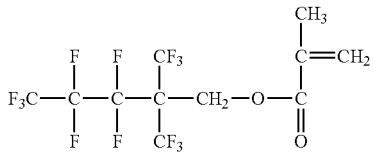

-continued (3-1-10)

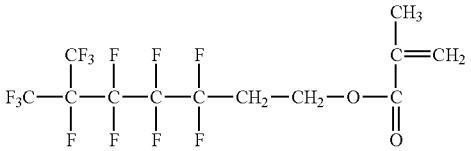

(3-1-11)

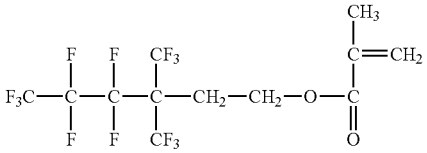

(3-1-12)

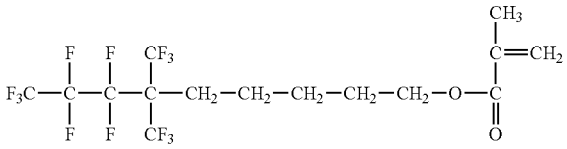

(3-1-13)

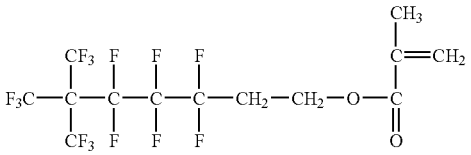

(3-1-14)

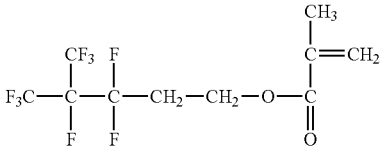

Of those, compounds represented by the above formulae (3-1-3), (3-1-4), (3-1-6), (3-1-7), (3-1-10), (3-1-11), (3-1-13), and (3-1-14) are preferable.

Referring to Formula (3-2):

$R^1$ in the above formula (3-2) represents a hydrogen atom or a methyl group.

$R^{21}$ in the above formula (3-2) represents an alkylene group having a branched structure with a carbon-carbon bond. The branched structure with a carbon-carbon bond represents a structure in which the longest bonding chain and the side chain thereof are bonded by a carbon-carbon bond. The longest bonding chain is preferably formed of 2 to 6 carbon atoms. In addition, the side chain may include an alkyl group and a fluoroalkyl group. The alkyl group may be a methyl group, an ethyl group, a propyl group, or a butyl group. Of those, the methyl group and the ethyl group are preferable. The fluoroalkyl group may include, for example, the groups represented by the above formulae (CF-1) to (CF-3). Of those, the group represented by the above formula (CF-1) is preferable.

$Rf^{10}$ in the above formula (3-2) represents a monovalent group with at least a fluoroalkyl group. Examples of the fluoroalkyl group include the groups represented by the above formulae (CF-1) to (CF-3). In addition, $Rf^{10}$ is not necessarily required to have a linear structure, and may have a branched structure. Alternatively, $Rf^{10}$ may be a fluoroalkyl group interrupted with an oxygen atom.

Specific examples of $Rf^{10}$ in the above formula (3-2) include groups represented by the above formulae (Rf10-1) to (Rf10-36).

Specific examples of the compound represented by the above formula (3-2) are shown below.

(3-2-1)

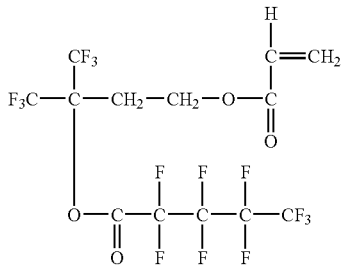

(3-2-2)

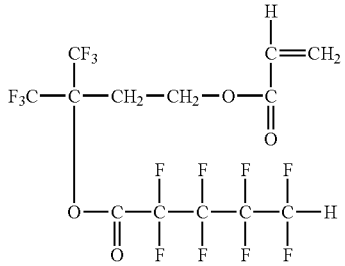

(3-2-3)

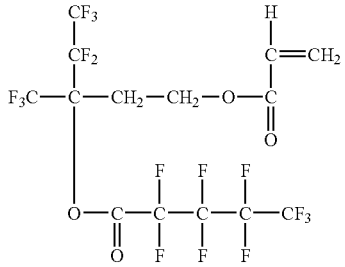

(3-2-4)

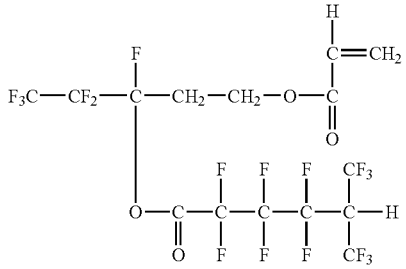

(3-2-5)

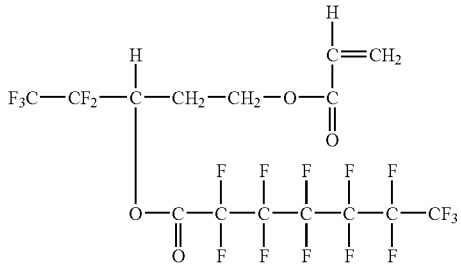

-continued (3-2-6)

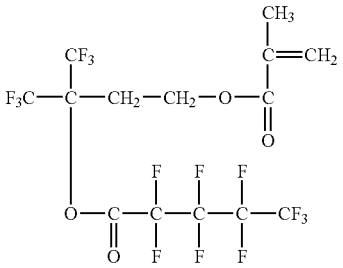

(3-2-7)

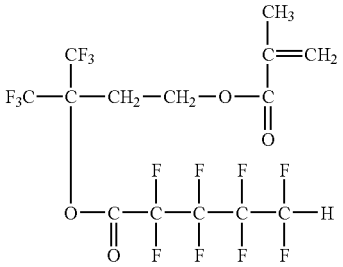

Of those, compounds represented by the above formulae (3-2-1) and (3-2-2) are preferable.

Referring to Formula (3-3):

$R^1$ in the above formula (3-3) represents a hydrogen atom or a methyl group.

$R^{22}$ in the above formula (3-3) represents a —$R^{21}$— group or a —O—$R^{21}$— group. To be specific, the —$R^{21}$— group represents an alkylene group having a branched structure with a carbon-carbon bond. Here, the branched structure with a carbon-carbon bond represents a structure in which the longest bonding chain and the side chain thereof are bonded by a carbon-carbon bond. The longest bonding chain is preferably formed of 2 to 6 carbon atoms. In addition, the side chain may be an alkyl group or a fluoroalkyl group. The alkyl group may be, for example, a methyl group, an ethyl group, a propyl group, or a butyl group. Of those, the methyl group and the ethyl group are preferable. The fluoroalkyl group may include, for example, groups represented by the above formulae (CF-1) to (CF-3). Of those, the group represented by the above formula (CF-1) is preferable. Further, the —O—$R^{31}$— group represents a structure in which the alkylene group having a branched structure with a carbon-carbon bond is bonded to $Rf^{10}$ through an oxygen atom.

$Rf^{10}$ in the above formula (3-3) represents a monovalent group with at least a fluoroalkyl group. The fluoroalkyl group may include, for example, groups represented by the above formulae (CF-1) to (CF-3). Further, $Rf^{10}$ is not necessarily required to have a linear structure, and may have a branched structure. Alternatively, $Rf^{10}$ may be a fluoroalkyl group interrupted with an oxygen atom.

Specific examples of $Rf^{10}$ in the above formula (3-3) include groups represented by the above formulae (Rf10-1) to (Rf10-36).

Specific examples of the repeating structural unit represented by the above formula (3-3) include the following:

(3-3-1)

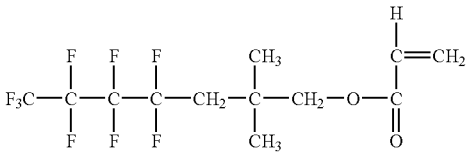

(3-3-2)

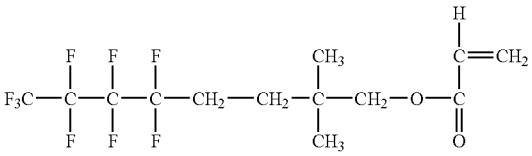

(3-3-3)

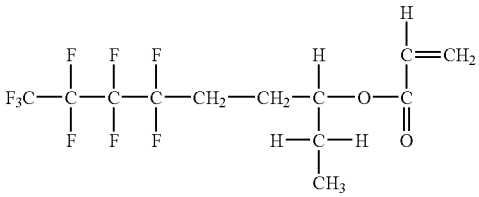

(3-3-4)

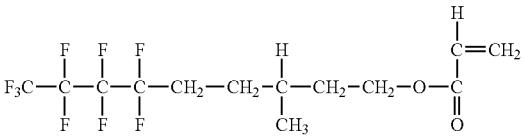

(3-3-5)

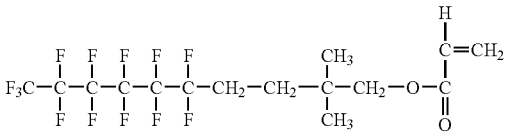

(3-3-6)

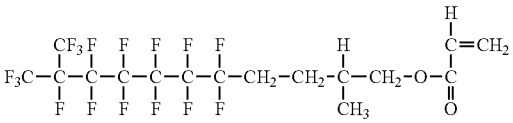

(3-3-7)

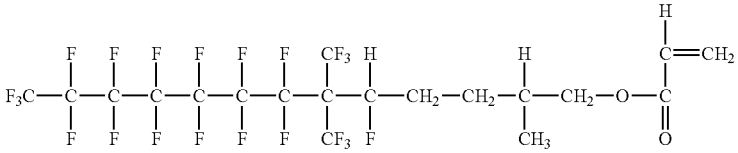

-continued (3-3-8)

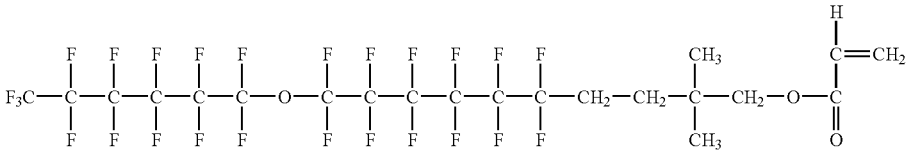

(3-3-9)

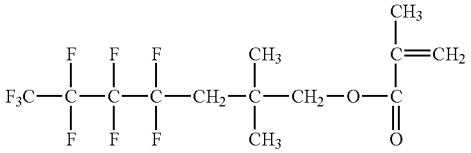

(3-3-10)

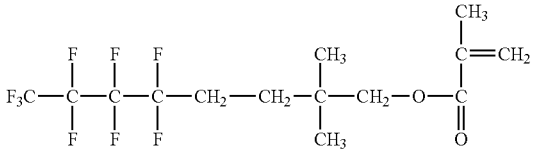

(3-3-11)

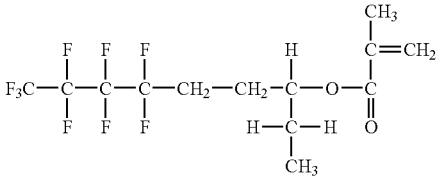

(3-3-12)

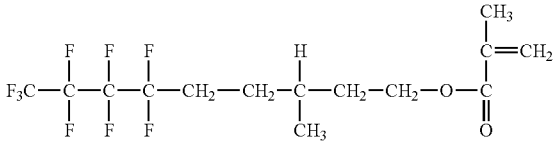

(3-3-13)

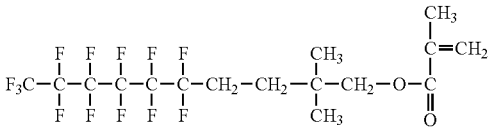

(3-3-14)

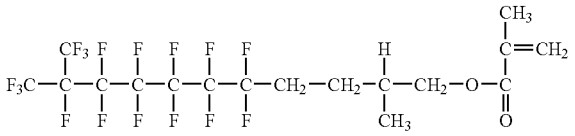

(3-3-15)

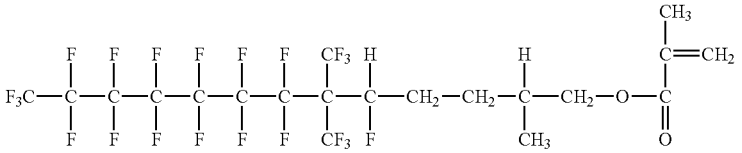

(3-3-16)

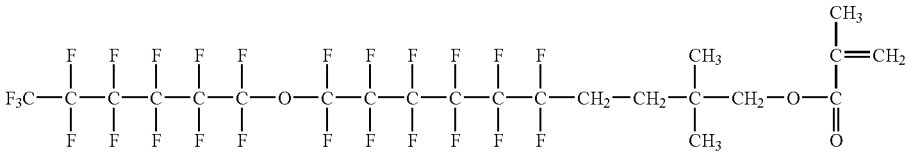

Of those, compounds represented by the above formulae (3-3-1), (3-3-2), (3-3-3), (3-3-4), (3-3-6), (3-3-9), (3-3-10), (3-3-11), (3-3-12), and (3-3-14) are preferable.

Referring to Formula (3-4):

$R^1$ in the above formula (3-4) represents a hydrogen atom or a methyl group.

$R^{23}$ in the above formula (3-4) represents a —Ar— group, a —O—Ar— group, or a —O—Ar—R— group (Ar represents an arylene group and R represents an alkylene group). Examples of the arylene group of Ar include a phenylene group, a naphthylene group, and a biphenylene group. Of those, the phenylene group is preferable. Examples of the alkylene group of R include: linear alkylene groups such as a methylene group, an ethylene group, a propylene group, a butylene group, a pentylene group, and a hexylene group; and branched alkylene groups such as an isopropylene group and an isobutylene group. Of those, the methylene group, the ethylene group, the propylene group, and the butylene group are preferable. The —O—Ar— group or the —O—Ar—R— group represents a structure in which Ar is bonded to $Rf^{10}$ through an oxygen atom.

$Rf^{10}$ in the above formula (3-4) represents a monovalent group with at least a fluoroalkyl group. The fluoroalkyl group may include, for example, groups represented by the above formulae (CF-1) to (CF-3). Further, $Rf^{10}$ is not necessarily required to have a linear structure, and may have a branched structure. Alternatively, $Rf^{10}$ may be a fluoroalkyl group interrupted with an oxygen atom.

Specific examples of $Rf^{10}$ in the above formula (3-4) include those represented by the above formulae (Rf10-1) to (Rf10-36).

Specific examples of the compound represented by the above formula (3-4) include the following:

(3-4-1)
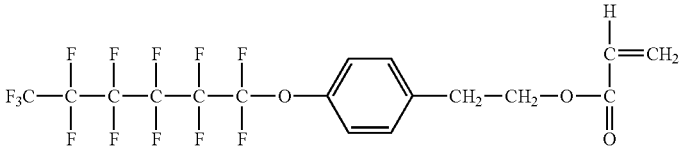
(3-4-2)
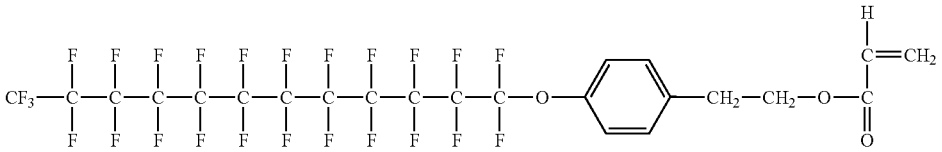
(3-4-3)
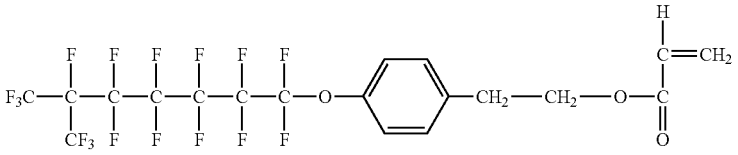
(3-4-4)
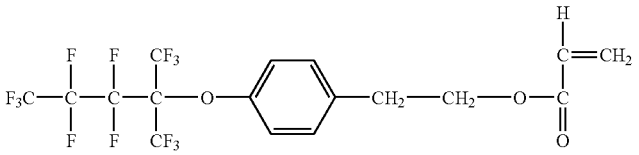
(3-4-5)
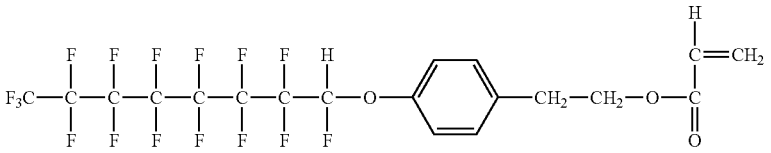
(3-4-6)
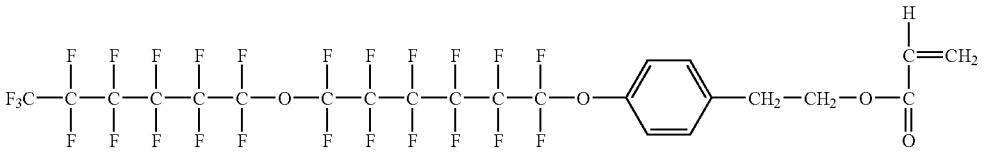
(3-4-7)
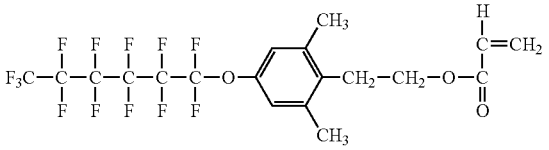
(3-4-8)
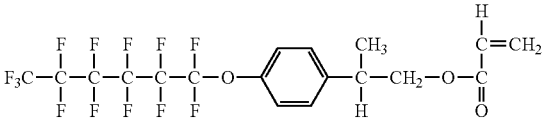
(3-4-9)
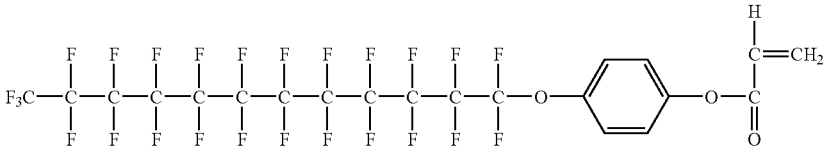
(3-4-10)
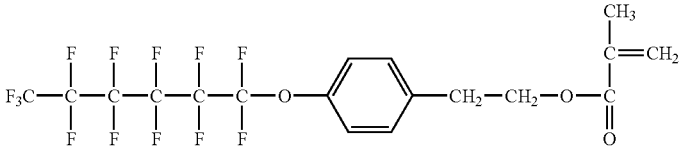

-continued (3-4-11)

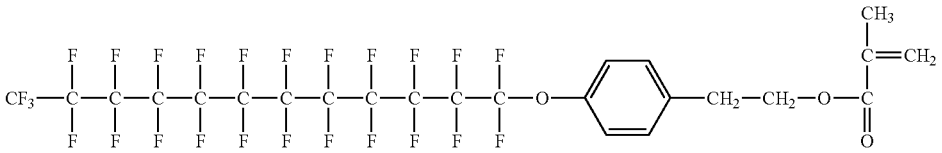

(3-4-12)

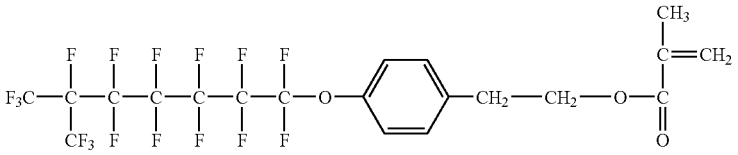

(3-4-13)

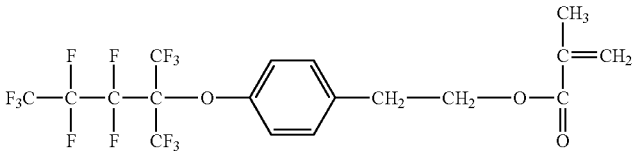

(3-4-14)

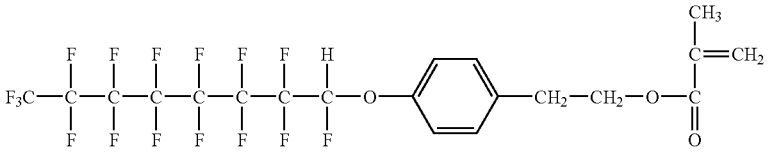

(3-4-15)

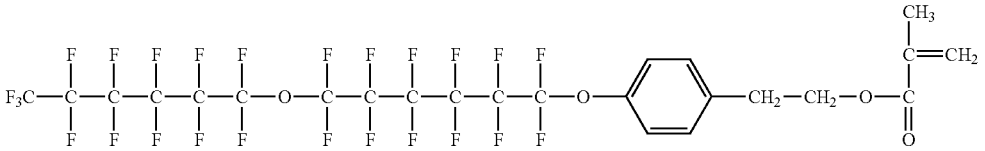

(3-4-16)

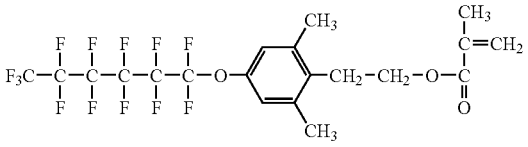

(3-4-17)

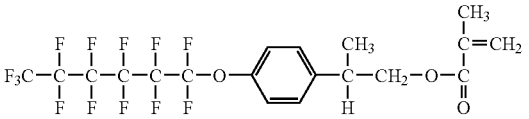

(3-4-18)

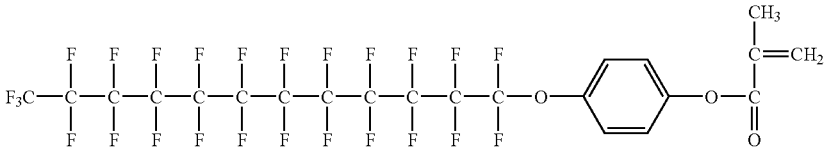

Of those, compounds represented by the above formulae (3-4-1), (3-4-6), (3-4-7), (3-4-8), (3-4-10), (3-4-15), (3-4-16), and (3-4-17) are preferable.

Referring to Formula (3-5):

$R^1$ in the above formula (3-5) represents a hydrogen atom or a methyl group.

$R^{20}$ in the above formula (3-5) represents a single bond or an alkylene group. Examples of the alkylene group include linear alkylene groups such as a methylene group, an ethylene group, a propylene group, a butylene group, a pentylene group, and a hexylene group. Of those, the methylene group, the ethylene group, the propylene group, and the butylene group are preferable.

$Rf^{12}$ in the above formula (3-5) represents a fluoroalkyl group interrupted with oxygen. The fluoroalkyl group interrupted with oxygen indicates that at least one oxygen atom is included in the longest bonding chain. Alternatively, a fluoroalkyl group or a fluoroalkylene group may be present on one side or both sides of the oxygen atom.

Specific examples of $Rf^{12}$ in the above formula (3-5) include groups represented by the above formulae (Rf12-1) to (Rf12-17).

Specific examples of the compound represented by the above formula (3-5) are shown below.

(3-5-1)
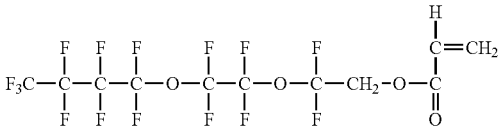
(3-5-2)
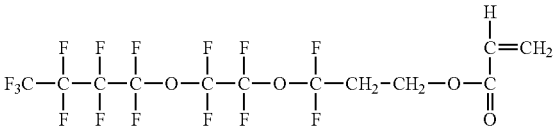
(3-5-3)
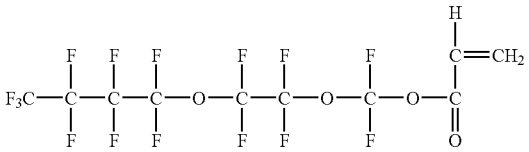
(3-5-4)
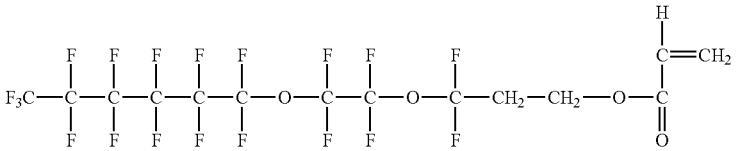
(3-5-5)
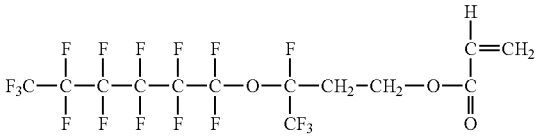
(3-5-6)
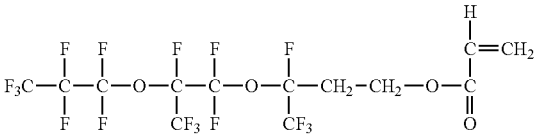
(3-5-7)
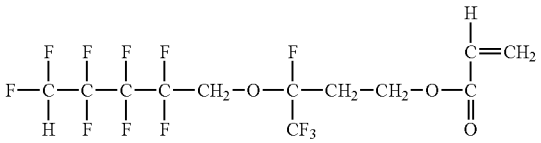
(3-5-8)
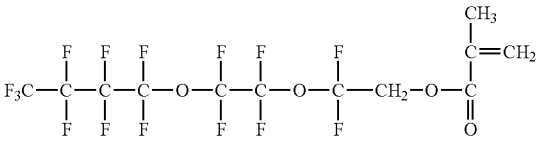
(3-5-9)
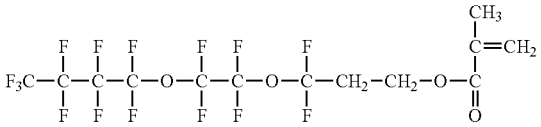
(3-5-10)
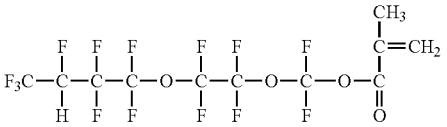
(3-5-11)
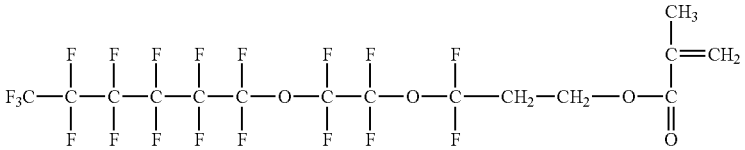
(3-5-12)
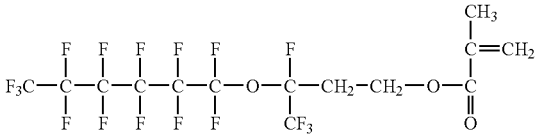
(3-5-13)
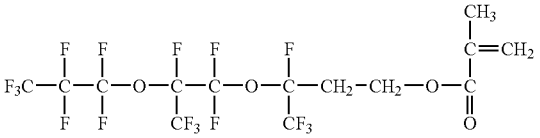
(3-5-14)
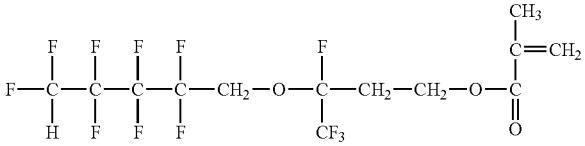

Of those, compounds represented by the above formulae (3-5-2), (3-5-4), (3-5-5), (3-5-6), (3-5-8), (3-5-11), (3-5-12), and (3-5-13) are preferable.

Referring to Formula (3-6):

$R^1$ in the above formula (3-6) represents a hydrogen atom or a methyl group.

$R^{20}$ in the above formula (3-6) represents a single bond or an alkylene group. Examples of the alkylene group include: linear alkylene groups such as a methylene group, an ethylene group, a propylene group, a butylene group, a pentylene group, and a hexylene group. Of those, the methylene group, the ethylene group, the propylene group, and the butylene group are preferable.

$Rf^{13}$ in the above formula (3-6) represents a perfluoroalkyl group with 4 to 6 carbon atoms.

Specific examples of $Rf^{13}$ in the above formula (3-6) include groups represented by the above formulae (Rf13-1) to (Rf13-3).

Specific examples of the compound represented by the above formula (3-6) are shown below.

(3-6-1)

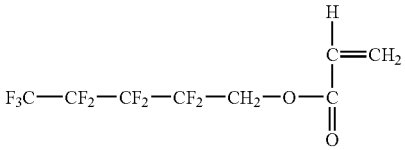

(3-6-2)

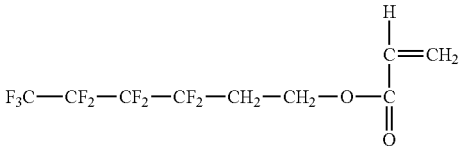

(3-6-3)

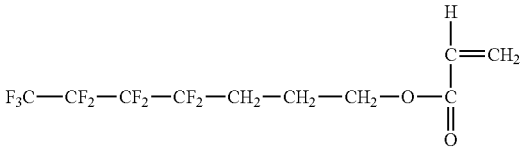

(3-6-4)

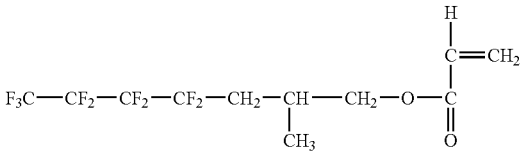

(3-6-5)

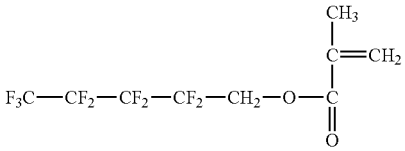

(3-6-6)

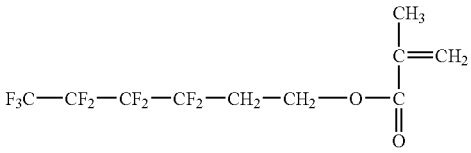

-continued (3-6-7)

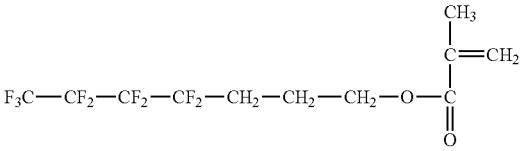

(3-6-8)

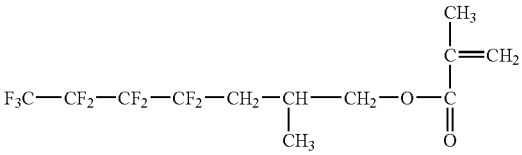

(3-6-9)

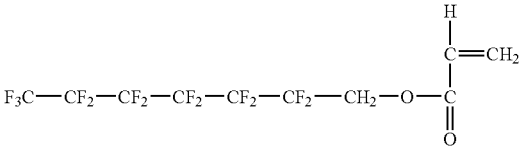

(3-6-10)

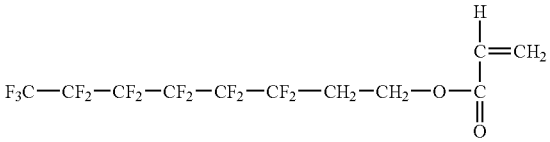

(3-6-11)

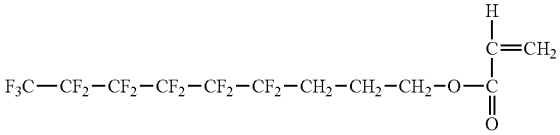

(3-6-12)

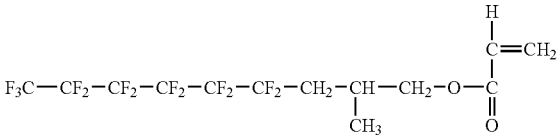

(3-6-13)

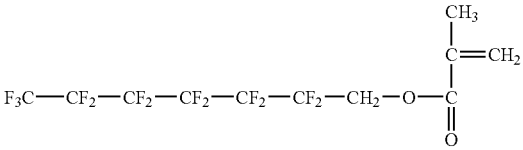

(3-6-14)

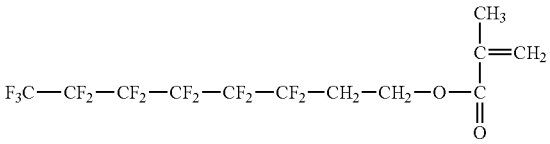

(3-6-15)

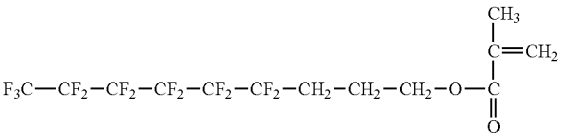

-continued (3-6-16)

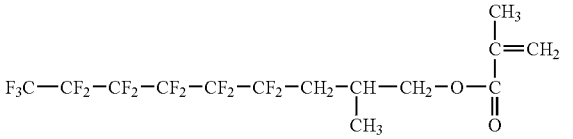

Of those, compounds represented by the above formulae (3-6-1), (3-6-2), (3-6-6), (3-6-7), (3-6-10), (3-6-11), (3-6-14), and (3-6-15) are preferable.

The compound represented by the above formula (3) can be produced by a combination of production methods well known in the art.

A method of producing a compound represented by the above formula (3) will be exemplified.

According to a method disclosed in Japanese Patent Application Laid-Open No. 2005-054020, an iodinated material of a fluoroalkyl group ($Rf^1$ group) is used as a starting material, whereby a compound represented by the above formula (3) where $R^1$ is H, and $R^2$ is $CH_2$—$CH_2$ is obtained.

Alternatively, other compounds represented by the above formula (3) can be obtained with reference to the other production methods disclosed in, for example, Japanese Patent Application Laid-Open No. 2001-302571 and Japanese Patent Application Laid-Open No. 2001-199953.

(3)

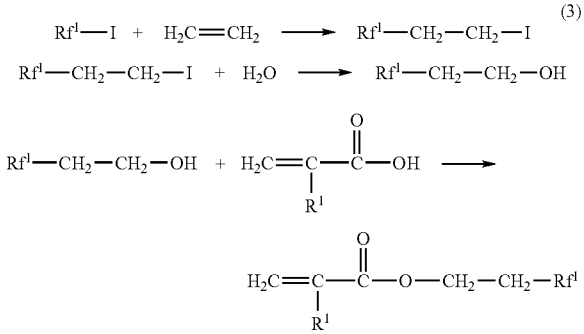

(In the above formula, $R^1$ represents $R^1$ in the formula (3) and $Rf^1$ represents $Rf^1$ in the formula (3)).

Further, the compound represented by the above formula (3-2) has a plurality of ester structures. Therefore, on this account, by-product materials or residual compounds remaining after the polymerization of compounds represented by the above formula (3-2) can be easily removed by washing the resulting polymer with water or alcohol. As a result, the compound having the repeating structural unit represented by the above formula (1-2) can be obtained at high purity. The acquisition of the compound at high purity may also contribute to the maintenance of electrophotographic properties in a favorable condition.

The compound having the repeating structural units represented by the above formula (a) is synthesized by the polymerization of compounds each represented by the following formula (d):

(d)

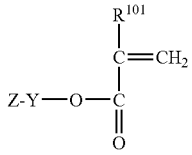

(where $R^{101}$ represents a hydrogen atom or a methyl group, Y represents a divalent organic group, and Z represents a polymer unit).

$R^{101}$ in the above formula (d) represents a hydrogen atom or a methyl group.

Y in the above formula (d), which is arbitrary as far as it is a divalent organic group, is preferably one represented by the following formula (c):

(c)

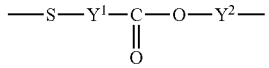

$Y^1$ and $Y^2$ in the above formula (c) each independently represent an alkylene group. Examples of the alkylene group include a methylene group, an ethylene group, a propylene group, a butylene group, a pentylene group, and a hexylene group. Of those, the methylene group, the ethylene group, and the propylene group are preferable. The substituents those alkylene groups may have, include alkyl groups, alkoxyl groups, hydroxyl groups, and aryl groups. The alkyl groups include a methyl group, an ethyl group, a propyl group, and a butyl group. Of those, the methyl group and the ethyl group are preferable. The alkoxyl groups include a methoxy group, an ethoxy group, and a propoxyl group. Of those, the methoxy group is preferable. The aryl groups include a phenyl group and a naphthyl group. Of those, the phenyl group is preferable. Further, of those, the methyl group and the hydroxyl group are more preferable.

Z in the above formula (d) is a polymer unit and its structure is not limited as far as it is a polymer unit, but is preferably a polymer unit having a repeating structural unit represented by the following formula (b-1) or the following formula (b-2):

(b-1)

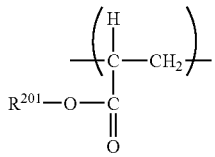

(b-2)

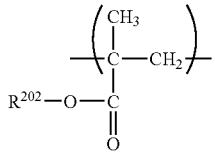

$R^{201}$ in the above formula (b-1) represents an alkyl group. Examples of the alkyl group include a methyl group, an ethyl group, a propyl group, a butyl group, a pentyl group, a hexyl group, a heptyl group, an octyl group, and a nonyl group. Of those, the methyl group, the ethyl group, the propyl group, the butyl group, the pentyl group, and the hexyl group are preferable.

$R^{202}$ in the above formula (b-2) represents an alkyl group. Examples of the alkyl group include a methyl group, an ethyl group, a propyl group, a butyl group, a pentyl group, a hexyl group, a heptyl group, an octyl group, and a nonyl group. Of those, the methyl group, the ethyl group, the propyl group, the butyl group, the pentyl group, and the hexyl group are preferable.

The terminal end of the polymer unit represented by Z in the above formula (d) may be terminated using an end-terminating agent or have a hydrogen atom.

The polymer having the repeating structural units represented by the above formula (1) for the present invention can be produced by polymerization of compounds represented by the above formula (3). Further, the polymer having both the repeating structural unit represented by the above formula (1) and the repeating structural unit represented by the above formula (a) can be produced by copolymerizing the compound represented by the above formula (3) with the compound represented by the above formula (d) according to the procedures disclosed in, for example, Japanese Patent Application Laid-Open No. 58-164656.

Hereinafter, an example of a method of producing the compound represented by the above formula (d) will be described. In the following formula, a compound is exemplified having the structure represented by the above formula (d) where $R^{101}$ is a methyl group, Y is a divalent organic group having the structure represented by the above formula (c), and Z is a polymer unit represented by the above formula (b-2). Further, in the above formula (c), $Y^1$ is a methylene group and $Y^2$ is a propylene group having a hydroxyl group.

(Step 1)

To an alkyl acrylate monomer or an alkyl methacrylate monomer which is a raw material for a polymer having a repeating structural unit represented by the above formula (b-1) or the above formula (b-2), a chain transfer agent is added in an amount of several mass % in monomer ratio, whereby the polymerization of the monomer is carried out. Consequently, an alkyl acrylate polymer or an alkyl methacrylate polymer having a terminal end coupled with the chain transfer agent is obtained. The chain transfer agent may include carboxylic acids with mercapto groups such as thioglycolic acid, 3-mercapto propionic acid, 2-mercapto propionic acid, and 4-mercapto-n-butanoic acid.

(Step 2)

A functional group is provided for binding to an alkyl acrylate polymer or an alkyl methacrylate polymer and the functional group is then reacted with a monomer (in the following formula, glycidyl methacrylate) that forms a principal chain in the subsequent reaction. Consequently, a compound represented by the above formula (d) is obtained. The above glycidyl methacrylate has a polymerizable functional group and a functional group (epoxy part) which can bind to a carboxyl group in the chain transfer agent. The monomer is not limited to glycidyl methacrylate as far as it is a monomer having similar functional-group configuration.

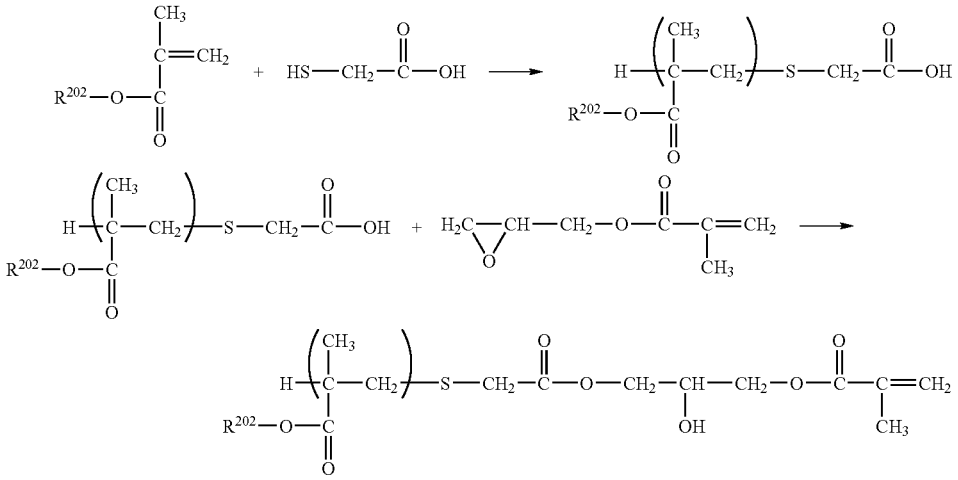

($R^{202}$ in the above formulas represents an alkyl group)

The copolymer of the repeating structural unit represented by the above formula (1) and the repeating structural unit represented by the above formula (a) can be produced according to the procedure disclosed in Japanese Patent Application Laid-Open No. 58-164656 using the compound represented by the above formula (3) and the compound represented by the above formula (d). Consequently, a compound having a part with an affinity for the fluorine-atom-containing resin particles and a part with an affinity for the binder resin of the surface layer can be obtained.

The fluorine-atom-containing resin particles in the present invention are preferably tetrafluoroethylene resin particles, trifluoroethylene resin particles, tetrafluoroethylene hexafluopropylene resin particles, polyvinyl fluoride resin particles, vinylidene fluoride resin particles, or difluoroethylene dichloride resin particles. In addition, copolymers thereof are preferable. Of those, tetrafluoroethylene resin particles are more preferable.

An electrophotographic photosensitive member is produced using both a polymer having the repeating structural units represented by the above formula (1) for the present invention and fluorine-atom-containing resin particles as components of a surface-layer coating solution. As a result, the fluorine-atom-containing resin particles can be dispersed so as to be provided with particle sizes almost up to those of primary particles. Therefore, according to the present invention, an electrophotographic photosensitive member having a surface layer in which fluorine-atom-containing resin particles are suitably dispersed can be obtained. As a result, an electrophotographic photosensitive member with excellent durability in which the generation of defects on an image due to poor dispersion is reduced, can be provided.

The structure of the fluoroalkyl group in the repeating structural unit represented by the above formula (1-1) is not a linear chain but a branched structure. In the case of the polymer having the repeating structural units represented by the above formula (1) for the present invention, which includes the repeating structural unit represented by the above formula (1-1), it is difficult to form micelles of the polymer having the repeating structural units represented by the above formula (1) for the present invention in a solution or a dispersion liquid. Therefore, the liquid composition in the solution or the dispersion liquid can be uniformized. In addition, it is difficult for contamination with slight amounts of ionic impurities to occur, which is considered to contribute to the improvement of characteristics and to keep electrophotographic properties in a favorable condition.

The repeating structural unit represented by the above formula (1-2) has a branched structure. In the case of the polymer having the repeating structural units represented by the above formula (1) for the present invention, which includes the repeating structural unit represented by the above formula (1-2), it is difficult to form micelles of the compound having the repeating structural unit represented by the above formula (1) in a solution or a dispersion liquid. Therefore, the liquid composition in the solution or the dispersion liquid can be uniformized. In addition, it is difficult for contamination with slight amounts of ionic impurities to occur, which is considered to contribute to the improvement of characteristics and to keep electrophotographic properties in a favorable condition.

The repeating structural unit represented by the above formula (1-3) has a branched structure. In the case of the polymer having the repeating structural units represented by the above formula (1) for the present invention, which includes the repeating structural unit represented by the above formula (1-3), it is difficult to form micelles of the compound having the repeating structural unit represented by the above formula (1) in a solution or a dispersion liquid. Therefore, the liquid composition in the solution or the dispersion liquid can be uniformized. In addition, it is difficult for contamination with slight amounts of ionic impurities to occur, which is considered to contribute to the improvement of characteristics and to keep electrophotographic properties in a favorable condition.

The repeating structural unit represented by the above formula (1-4) has a structure in which an arylene group is included. In the case of the polymer having the repeating structural units represented by the above formula (1) for the present invention, which includes the repeating structural unit represented by the above formula (1-4), it is difficult to form micelles of the compound having the repeating structural unit represented by the above formula (1) in a solution or a dispersion liquid. Therefore, the liquid composition in the solution or the dispersion liquid can be uniformized. In addition, it is difficult for contamination with slight amounts of ionic impurities to occur, which is considered to contribute to the improvement of characteristics and to keep electrophotographic properties in a favorable condition.

The repeating structural unit represented by the above formula (1-5) has a structure in which a fluoroalkyl group interrupted with oxygen is included. In the case of the polymer having the repeating structural units represented by the above formula (1) for the present invention, which includes the repeating structural unit represented by the above formula (1-5), it is difficult to form micelles of the compound having the repeating structural unit represented by the above formula (1) in a solution or a dispersion liquid. Therefore, the liquid composition in the solution or the dispersion liquid can be uniformized. In addition, it is difficult for contamination with slight amounts of ionic impurities to occur, which is considered to contribute to the improvement of characteristics and to keep electrophotographic properties in a favorable condition.

The repeating structural unit represented by the above formula (1-6) has a structure in which a perfluoroalkyl group with 4 to 6 carbon atoms is included. In the case of the polymer having the repeating structural units represented by the above formula (1) for the present invention, which includes the repeating structural unit represented by the above formula (1-6), it is difficult to form micelles of the compound having the repeating structural unit represented by the above formula (1) in a solution or a dispersion liquid. Therefore, the liquid composition in the solution or the dispersion liquid can be uniformized. In addition, it is difficult for contamination with slight amounts of ionic impurities to occur, which is considered to contribute to the improvement of characteristics and to keep electrophotographic properties in a favorable condition.

Next, the configuration of the electrophotographic photosensitive member of the present invention will be described.

As an example of the electrophotographic photosensitive member of the present invention, as shown in FIG. 1A to FIG. 1E, an electrophotographic photosensitive member having in this order an intermediate layer 103 and a photosensitive layer 104 on a support 101 can be exemplified (see FIG. 1A).

In addition, for example, a conductive layer 102 is prepared by dispersing conductive particles in a resin to make the volume resistance of the resin smaller. The conductive layer 102 is then formed between the support 101 and the intermediate layer 103, whereby the film thickness of the conductive layer 102 is thickened. The layer 102 may be provided as a layer for covering defects in the surface of the conductive support 101 or the non-conductive support 101 (for example, resin support) (see FIG. 1B).

A photosensitive layer 104 may be of a monolayer type photosensitive layer 104 containing a charge-transporting substance and a charge-generating substance in the same layer (see FIG. 1A). Further, photosensitive layer 104 may be of a multilayer type (separate function type) photosensitive layer having a charge-generating layer 1041 containing a charge-generating substance and a charge-transporting layer 1042 containing a charge-transporting substance separately. The multilayer type photosensitive layer is preferred in view of electrophotographic properties. In the case of a monolayer type photosensitive layer, the surface layer of the present invention is the photosensitive layer 104. In addition, there are two types of multilayer type photosensitive layers. One is a normal-layer type photosensitive layer in which the charge-generating layer 1041 and the charge-transporting layer 1042 are superposed on the support 101 in order from the support 101 (see FIG. 1C). The other is a reverse-layer type photosensitive layer in which the charge-transporting layer 1042 and the charge-generating layer 1041 are superposed on the support 101 in order from the support 101 (see FIG. 1D). From the viewpoint of electrophotographic properties, the normal-type photosensitive layer is preferred. Of the multilayer type photosensitive layers, in the case of the normal-layer type photosensitive layer, the surface layer of the electrophotographic photosensitive member is a charge-transporting layer. In the case of the reverse-layer type photosensitive layer, the surface layer is a charge-generating layer (when a protective layer is not provided).

Figure 1E:
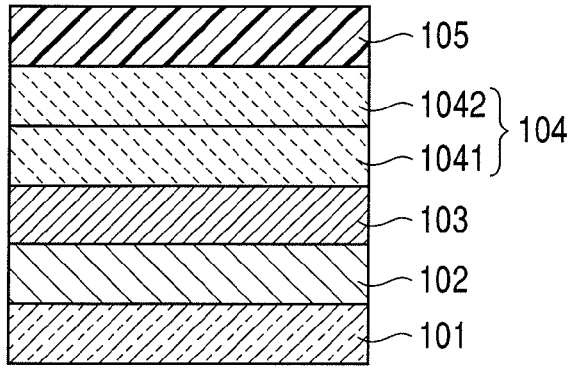
Figure 1C:
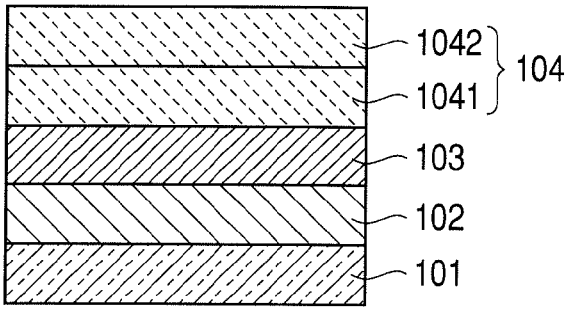

In addition, a protective layer 105 may be formed on the photosensitive layer 104 (charge-generating layer 1041 and charge-transporting layer 1042) (see FIG. 1E). In the case where the electrophotographic photosensitive member has the protective layer 105, the surface layer of the electrophotographic photosensitive member is the protective layer 105.

The support 101 is preferably conductive (conductive support) and may be one made of a metal such as aluminum, an aluminum alloy, or stainless steel. In the case of aluminum or an aluminum alloy, the support 101 used may be an ED tube or an EI tube or one obtained by subjecting the ED tube or the EI tube to cutting, electrolytic compound polishing (electrolysis with an electrode and an electrolytic solution having an electrolytic action, and polishing with a whetstone having a polishing action), or a wet- or dry-honing process. Also, the above metal-made support having a layer formed by vacuum deposition of aluminum, an aluminum alloy, or an indium oxide-tin oxide alloy may be used. In addition, a resin-made support (polyethylene terephthalate, polybutylene terephthalate, a phenol resin, polypropylene, or a polystyrene resin) having a layer formed by the same vacuum deposition may be used. Alternatively, a support prepared by impregnating a resin or paper with conductive particles such as carbon black, tin oxide particles, titanium oxide particles, and silver particles may be used, or a plastic having a conductive binder resin may be used.

When the surface of the support is a layer provided for imparting the conductivity to the support, the volume resistivity of the support is preferably $1\times10^{10}$ Ω·cm or less, more preferably $1\times10^{6}$ Ω·cm or less.

A conductive layer may be formed on the support for the purpose of covering defects on the surface of the support. The conductive layer is a layer formed by applying a coating solution prepared by dispersing conductive powder in a suitable binder resin on the support.

Such conductive powder include: carbon black; acetylene black; metal powder made of, for example, aluminum, nickel, iron, nichrome, copper, zinc, and silver; and metal oxide powder made of, for example, conductive tin oxide and ITO.

In addition, a binder resin used simultaneously with the conductive powder may include the following thermoplastic resins, thermosetting resins, and photo-curing resins.

Polystyrene, a styrene-acrylonitrile copolymer, a styrene-butadiene copolymer, a styrene-maleic anhydride copolymer, polyester, polyvinyl chloride, a vinyl chloride-vinyl acetate copolymer, polyvinyl acetate, polyvinylidene chloride, a polyarylate resin, a phenoxy resin, polycarbonate, a cellulose acetate resin, an ethylcellulose resin, polyvinyl butyral, polyvinyl formal, polyvinyl toluene, poly-N-vinyl carbazole, an acrylic resin, a silicone resin, an epoxy resin, a melamine resin, a urethane resin, a phenol resin, and an alkyd resin.

The conductive layer can be formed by dispersing or dissolving the above conductive powder and the binder resin into an organic solvent, followed by applying the resulting dispersion liquid or solution. Examples of the organic solvent include: ether-based solvents (e.g., tetrahydrofuran, ethylene glycol dimethyl ether); alcohol-based solvents (e.g., methanol); ketone-based solvents (e.g., methyl ethyl ketone); and aromatic hydrocarbon solvents (e.g., toluene).

The film thickness of the conductive layer is preferably 5 to 40 μm, more preferably 10 to 30 μm.

An intermediate layer having a barrier function may be formed on the support or the conductive layer.

The intermediate layer can be formed so that a hardening resin is applied and then hardened to form a resin layer. Alternatively, the intermediate layer can be formed so that an intermediate-layer coating solution containing a binder resin is applied on a conductive layer and then dried to form such a layer.

Examples of the binder resin in the intermediate layer include the following resins:

Water-soluble resins including polyvinyl alcohol, polyvinyl methyl ether, polyacrylic acids, methylcellulose, ethylcellulose, polyglutamic acid, and casein, a polyamide resin, a polyimide resin, a polyamide imide resin, a polyamic acid resin, a melamine resin, an epoxy resin, a polyurethane resin, and a polyglutamate resin.

For effectively expressing the electric barrier property of the intermediate layer and from the viewpoint of coating characteristics, adhesiveness, solvent resistance, and electrical resistance, the binder resin in the intermediate layer is preferably a thermoplastic resin. To be specific, a thermoplastic polyamide resin is preferable. The polyamide resin is preferably copolymer nylon with low crystallinity or amorphous copolymer nylon which can be applied in a solution state.

The film thickness of the intermediate layer is preferably 0.1 to 2.0 μm.

In addition, semiconductive particles may be dispersed in the intermediate layer, or an electron-transporting substance (electron-accepting substance such as an acceptor) may be incorporated in the intermediate layer, in order to prevent the flow of charges (carriers) from being disrupted in the intermediate layer.

A photosensitive layer is formed on the support, the conductive layer, or the intermediate layer.

Examples of the charge-generating substance used in the electrophotographic photosensitive member of the present invention include the following:

Azo pigments such as monoazo, disazo, and tris azo; phthalocyanine pigments such as metal phthalocyanine and nonmetal phthalocyanine; indigo pigments such as indigo and thioindigo; perylene pigments such as perylene acid anhydride and perylene acid imide; polycyclic quinone pigments such as anthraquinone and pyrene quinone; squalelium pigments, a pyrylium salt, and a thiapyrylium salt, and a triphenylmethane dye; inorganic substances such as selenium, selenium-tellurium, and amorphous silicon; and quinacridone pigments, azulenium salt pigments, a cyanine dye, a xanthene dye, quinonimine pigments, and styryl pigments.

Any one of those charge-generating substances may be used alone or two or more of them may be used in combination. Of those, in particular, the metal phthalocyanines, such as oxytitanium phthalocyanine, hydroxygallium phthalocyanine, and chlorogallium phthalocyanine are preferable because of their high sensitivities.

When the photosensitive layer is a multilayer type photosensitive layer, the binder resin used in the charge-generating layer may include, for example, the following: a polycarbonate resin, a polyester resin, a polyarylate resin, a butyral resin, a polystyrene resin, a polyvinyl acetal resin, a diallylphthalate resin, an acrylic resin, a methacrylic resin, a vinyl acetate resin, a phenol resin, a silicone resin, a polysulfone resin, a styrene-butadiene copolymer resin, an alkyd resin, an epoxy resin, a urea resin, and a vinyl chloride-vinyl acetate copolymer resin.

Of those, the butyral resin is preferable. They may be independently used. Alternatively, two or more of them may be used as a mixture or a copolymer.

The charge-generating layer can be formed by applying a charge-generating layer coating solution, which is prepared by dispersing a charge-generating substance into a solvent together with a binder resin, and then drying the coating solution. For example, a dispersion method may be one using a homogenizer, an ultrasonic wave, a ball mill, a sand mill, an attritor, or a roll mill. A ratio between the charge-generating substance and the binder resin is preferably in the range of 10:1 to 1:10 (mass ratio), more preferably in the range of 3:1 to 1:1 (mass ratio).

The solvent used in the charge-generating layer coating solution is selected on the basis of a binder resin to be used, and the solubility and dispersion stability of the charge-generating substance. The organic solvent may be an alcohol-based solvent, a sulfoxide-based solvent, a ketone-based solvent, an ether-based solvent, an ester-based solvent, or an aromatic hydrocarbon solvent.

The film thickness of the charge-generating layer is preferably 5 μm or less, more preferably 0.1 to 2 μm.

Further, the charge-generating layer may be incorporated with various sensitizers, antioxidants, UV absorbents, plasticizers, etc. as needed. An electron-transporting substance (electron-accepting substance such as an acceptor) may be added to the charge-generating layer to prevent the flow of charges (carriers) from being disrupted in the charge-generating layer.

Examples of the charge-transporting substance to be used in the electrophotographic photosensitive member of the present invention include a triarylamine compound, a hydrazone compound, a styryl compound, a stilbene compound, a pyrazoline compound, an oxazole compound, a thiazole compound, and a triallylmethane compound. Any one of those charge-transporting substances may be used alone, or two or more of them may be used in combination.

When the photosensitive layer is a multilayer type photosensitive layer, the following may be cited as examples of the binder resin to be used in the charge-transporting layer: an acrylic resin, a styrene resin, a polyester resin, a polycarbonate resin, a polyarylate resin, a polysulfone resin, a polyphenylene oxide resin, an epoxy resin, a polyurethane resin, an alkyd resin, and an unsaturated resin.

Of those, in particular, a polymethyl methacrylate resin, a polystyrene resin, a styrene-acrylonitrile copolymer resin, a polycarbonate resin, a polyarylate resin, or a diallyl phthalate resin is preferable. Any one of those resins can be used alone, or two or more of them can be used as a mixture or a copolymer.

The charge-transporting layer can be formed by applying a charge-transporting layer coating solution obtained by dissolving a charge-transporting substance and a binder resin into a solvent and then drying. A ratio between the charge-transporting substance and the binder resin is preferably in the range of 2:1 to 1:2 (mass ratio).

When the charge-transporting layer is the surface layer of the electrophotographic photosensitive member, fluorine-atom-containing resin particles, and a polymer having the repeating structural units represented by the above formula (1) for the present invention are added to the charge-transporting layer coating solution (surface-layer coating solution). In this case, if necessary, the particles and the polymer may be dispersed by a method using a homogenizer, ultrasonic dispersion, a ball mill, a vibration ball mill, a sand mill, an attritor, a roll mill, or a liquid-collision type high-speed dispersing machine.

Further, the average particle size of fluorine-atom-containing resin particles can be measured using an ultracentrifuge-type size-distribution measuring device "CAPA-700" (manufactured by Horiba, Ltd.) or a laser diffraction/scatter-type particle-size distribution measuring device "LA-750" (manufactured by Horiba, Ltd.). For example, a method of measuring the average particle size is as described below.

A dispersion liquid immediately after addition and dispersion of the fluorine-atom-containing resin particles is subjected to measurement by a liquid-phase precipitation method prior to mixing with a charge-transporting layer coating solution. When the ultracentrifuge-type size-distribution measuring device (CAPA-700) made by Horiba, Ltd. is employed, according to the manufacturer's instructions, the solution is diluted with a solvent which is to be a principal component of the charge-transporting layer coating solution and the average particle size is then determined.

The content of the fluorine-atom-containing resin particles is 0.1 to 30.0 mass % with respect to the total amount of the charge-transporting substance and the binder resin. The effective content of the polymer having the repeating structural units represented by the above formula (1) for the present invention is in the range of 0.01 to 5.0 mass % with respect to the total amount of the charge-transporting substance and the binder resin.

Examples of the solvent used for the charge-transporting layer coating solution include: ketone-based solvents such as acetone and methyl ethyl ketone; ester-based solvents such as methyl acetate and ethyl acetate; ether-based solvents such as tetrahydrofuran, dioxolane, dimethoxymethane, and dimethoxyethane; and aromatic hydrocarbon solvents such as toluene and xylene.

Any one of those solvents may be used alone or two or more of them may be used as a mixture. Of those solvents, it is preferable to use the ether-based solvents or the aromatic hydrocarbon solvents from the viewpoint of resin solubility.

The charge-transporting layer has a film thickness of preferably 5 to 40 μm, or more preferably 10 to 30 μm.

In addition, the charge-transporting layer may be incorporated with, for example, an antioxidant, a UV absorber, or a plasticizer as required.

When the photosensitive layer is a monolayer type photosensitive layer and provided as the surface layer of an electrophotographic photosensitive member, in the monolayer type photosensitive layer, the fluorine-atom-containing resin particles and the polymer having the repeating structural units represented by the above formula (1) for the present invention are added to and dispersed in the above charge-generating substance, the above charge-transporting substance, the above binder resin, and the above solvent. A coating solution for the monolayer type photosensitive layer thus obtained may be applied and dried to form the photosensitive layer of the electrophotographic photosensitive member (monolayer type photosensitive layer).

Further, a protective layer aimed at protecting the photosensitive layer may be formed on the photosensitive layer. The protective layer can be formed by applying a protective layer coating solution, which is prepared by dissolving the binder resins in the solvent as described above, and then drying.

When the surface layer of the electrophotographic photosensitive member is a protective layer, the fluorine-atom-containing resin particles and the polymer having the repeating structural units represented by the above formula (1) for the present invention are included in the protective layer as in the case where the above charge-transporting layer is the surface layer. Thus, the surface layer of the electrophotographic photosensitive member of the present invention can be formed.

The film thickness of the protective layer is preferably 0.5 to 10 μm, more preferably 1 to 5 μm.

The content of the fluorine-atom-containing resin particles in the protective layer is preferably 0.1 to 30.0 mass % with respect to the total solid content of the protective layer. The content of the polymer having the repeating structural units represented by the above formula (1) for the present invention is preferably 0.01 to 5.0 mass % with respect to the total amount of the charge-transporting substance and the binder resin.

When applying each of the coating solutions for the respective layers, the following coating methods may be employed: dip coating, spraying coating, spinner coating, roller coating, Mayer bar coating, blade coating, and ring coating.

Figure 2:
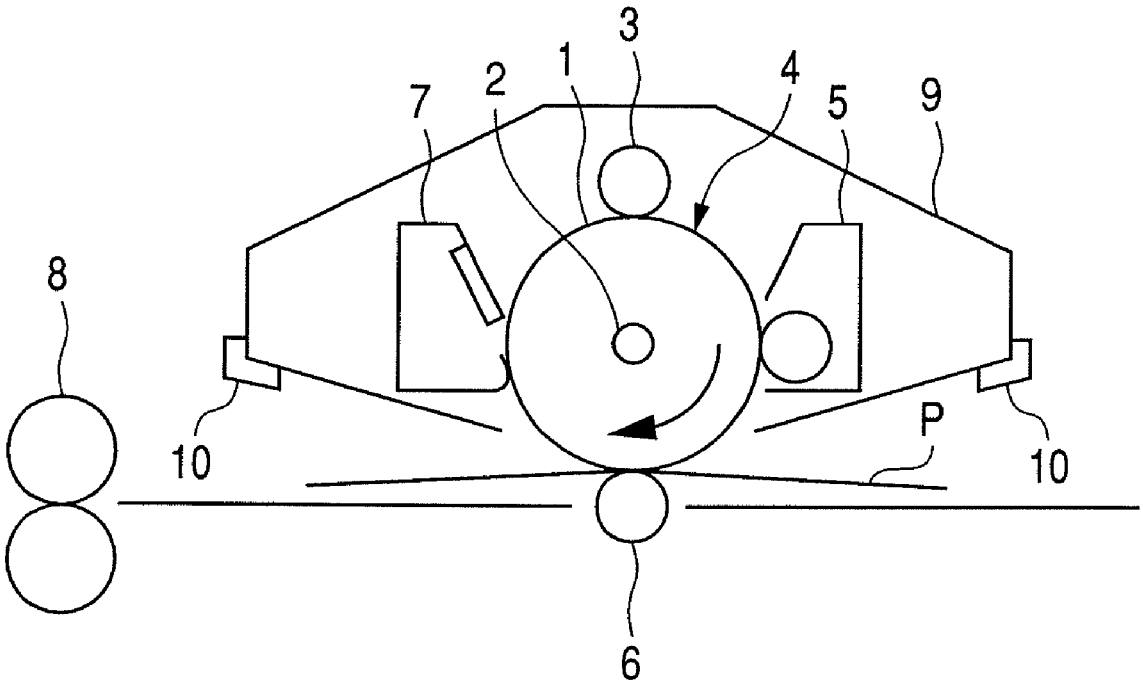
FIG. 2 is a diagram that schematically illustrates the configuration of an electrophotographic apparatus provided with a process cartridge of the present invention.

FIG. 2 illustrates an example of a schematic configuration of an electrophotographic apparatus equipped with a process cartridge according to the present invention.

In FIG. 2, a cylindrical electrophotographic photosensitive member 1 is rotated around an axis 2 in the direction indicated by the arrow at a predetermined peripheral speed.

The surface of the electrophotographic photosensitive member 1 which is rotated is uniformly charged positively or negatively at predetermined potential by a charging unit (primary charging unit: for example, a charging roller) 3. Subsequently, the surface of the electrophotographic photosensitive member 1 receives exposure light (image exposure light) 4 emitted from an exposure unit (not shown) such as slit exposure or laser-beam scanning exposure. In this way, electrostatic latent images corresponding to objective images are sequentially formed on the surface of the electrophotographic photosensitive member 1.

The electrostatic latent images formed on the surface of the electrophotographic photosensitive member 1 are developed with toner contained in a developer of a developing unit 5 to form toner images. Subsequently, the toner images thus formed and held on the surface of the electrophotographic photosensitive member 1 are sequentially transferred to a transfer material (such as paper) P by a transfer bias from a transfer unit (e.g., transfer roller) 6. The transfer material P is fed to a portion (contact part) between the electrophotographic photosensitive member 1 and the transfer unit 6 in synchronization with the rotation of the electrophotographic photosensitive member 1.

The transfer material P which has received the transfer of the toner images is dissociated from the surface of the electrophotographic photosensitive member 1 and then introduced to a fixing unit 8. The transfer material P is subjected to an image fixation and then printed as an image-formed product (print or copy) out of the apparatus.

The surface of the electrophotographic photosensitive member 1 after the transfer of the toner images is cleaned by removal of the developer (toner) remaining after the transfer by a cleaning unit (e.g., cleaning blade) 7. Further, the surface of the electrophotographic photosensitive member 1 is subjected to a de-charging process with pre-exposure light (not shown) from a pre-exposure unit (not shown) and then repeatedly used in image formation. As shown in FIG. 2, when the charging unit 3 is a contact-charging unit using a charging roller, the pre-exposure is not necessarily required.

Two or more components among from the electrophotographic photosensitive member 1, the charging unit 3, the developing unit 5 and the cleaning unit 7 as described above, may be integrally held together to make up a process cartridge. In addition, the process cartridge may be designed so as to be detachably mounted on the main body of an electrophotographic apparatus such as a copying machine or a laser beam printer. In FIG. 2, the electrophotographic photosensitive member 1, the charging unit 3, the developing unit 5, and the cleaning unit 7 are integrally supported and placed in a cartridge, thereby forming a process cartridge 9. The process cartridge 9 is detachably mounted on the main body of the electrophotographic apparatus using a guide unit 10 such as a rail of the main body of the electrophotographic apparatus.

EXAMPLES

Hereinafter, the present invention will be described in detail with reference to specific examples. However, the present invention is not limited to these examples. In addition, "part(s)" means "mass part(s)" and "%" means "mass %" in the examples.

Synthesis Example (A-1)

Synthesis of Compound Represented by the Above Formula (3-1-3)

An iodinated material (0.5 part) represented by the following formula (A-e-1):

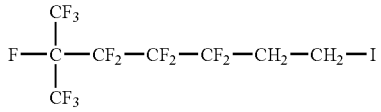

(A-e-1)

and ion-exchange water (20 parts) were placed in a deaerated autoclave, followed by heating up to 300° C. to carry out a conversion reaction of iodine into a hydroxyl group at a gauge pressure of 9.2 MPa for 4 hours. After the completion of the reaction, diethyl ether (20 parts) was added to the reaction mixture. After the mixture had been separated into two phases, magnesium sulfate (0.2 parts) was placed in an ether phase and magnesium sulfate was then removed by filtration, thereby obtaining a hydroxyl compound. The hydroxyl compound was subjected to column chromatography to separate and remove components other than a principal component. Subsequently, 100 parts of the previously obtained hydroxyl compound, 50 parts of acrylic acid, 5 parts of hydroquinone, 5 parts of p-toluenesulfonic acid, and 200 parts of toluene were introduced into a glass flask equipped with an agitator, a condenser, and a thermometer. Next, the flask was heated up to 110° C. and the reaction was then continued until the raw material, the hydroxyl compound, disappeared. After the completion of the reaction, the mixture was diluted with 200 parts of toluene, washed with a sodium hydroxide aqueous solution twice, and then washed with ion-exchange water three times. Subsequently, toluene was distilled off under reduced pressure, thereby obtaining a product. The resulting product was identified by $^{1}$H-NMR and $^{19}$F-NMR. As a result of the quantitative analysis of the product by gas chromatography, it was found that the compound represented by the above formula (3-1-3) was a principal component.

Synthesis Example (A-2)

Synthesis of Compound Represented by the Above Formula (3-1-4)

A product containing the compound represented by the above formula (3-1-4) as a principal component was obtained by carrying out the same reaction as in Synthesis Example (A-1) except that an iodinated material represented by the following formula (A-e-2) was used instead of the iodinated material represented by the above formula (A-e-1) described in Synthesis Example (A-1).

(A-e-2)

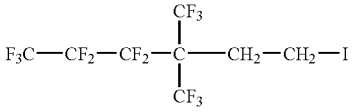

Synthesis Example (A-3)

Synthesis of Compound Represented by the Above Formula (3-1-6)

A product containing the compound represented by the above formula (3-1-6) as a principal component was obtained by carrying out the same reaction as in Synthesis Example (A-1) except that an iodinated material represented by the following formula (A-e-3) was used instead of the iodinated material represented by the above formula (A-e-1) described in Synthesis Example (A-1).

(A-e-3)

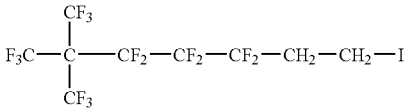

Synthesis Example (A-4)

Synthesis of Compound Represented by the Above Formula (3-1-7)

A product containing the compound represented by the above formula (3-1-7) as a principal component was obtained by carrying out the same reaction as in Synthesis Example (A-1) except that an iodinated material represented by the following formula (A-e-4) was used instead of the iodinated material represented by the above formula (A-e-1) described in Synthesis Example (A-1).

(A-e-4)

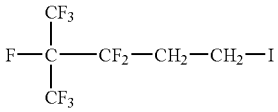

Synthesis Example (A-5)

Synthesis of Compound Represented by the Above Formula (3-2-2)

In a glass flask equipped with an agitator, a condenser, and a thermometer, 100 parts of a hydroxyl compound represented by the following formula (A-e-5):

(A-e-5)

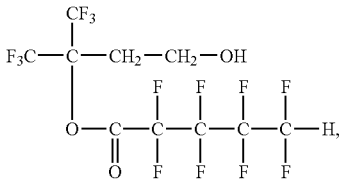

50 parts of acrylic acid, 5 parts of hydroquinone, 5 parts of p-toluenesulfonic acid, and 200 parts of toluene were placed. Subsequently, the mixture was heated up to 110° C. and the reaction was continued until the raw material, the hydroxyl compound, disappeared. After the completion of the reaction, the mixture was diluted with 200 parts of toluene, washed with a sodium hydroxide aqueous solution twice, and then washed with ion-exchange water three times. Subsequently, toluene was distilled off under reduced pressure, thereby obtaining a product. The resulting product was identified by $^{1}$H-NMR and $^{19}$F-NMR. As a result of the quantitative analysis of the product by gas chromatography, it was found that the compound represented by the above formula (3-2-2) was a principal component.

Synthesis Example (A-6)

Synthesis of Compound Represented by the Above Formula (3-2-1)

A product containing the compound represented by the above formula (3-2-1) as a principal component was obtained by carrying out the same reaction as in Synthesis Example (A-5) except that a hydroxyl compound represented by the following formula (A-e-6) was used instead of the hydroxyl compound represented by the above formula (A-e-5) described in Synthesis Example (A-5).

(A-e-6)

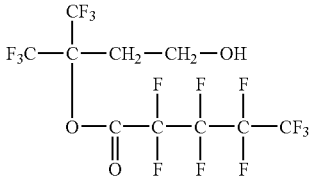

Synthesis Example (A-7)

A reaction was carried out in the same manner as in Synthesis Example (A-1) except that an iodinated material represented by the following formula (A-f-1):

(A-f-1)

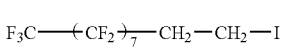

(in the above formula, 7 represents the number of repetitions of the repeating unit)

was used instead of the iodinated material represented by the above formula (A-e-1) described in Synthesis Example (A-1). Consequently, a product, in which a compound represented by the following formula (A-f):

(A-f)

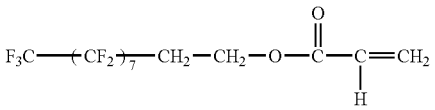

(in the above formula, 7 represents the number of repetitions of the repeating unit)

was a principal component, was obtained.

Production Example (A-1)

Production of Polymer (A-A)

In a glass flask equipped with an agitator, a reflux condenser, a dropping funnel, a thermometer, and a gas-blowing opening, 10 parts of methyl methacrylate (hereinafter abbreviated as MMA) and 0.3 part of an acetone (17.5%)-toluene mixture solvent were placed. Subsequently, a nitrogen gas was introduced into the flask and then 0.5 parts of azobisisobutyronitrile (hereinafter abbreviated as AIBN) as a polymerization initiator and 0.32 parts of thioglycolic acid as a chain transfer agent were added to initiate polymerization under reflux. During a time period of 4.5 hours after the initiation, 90 parts of MMA was continuously dropped. In addition, 2.08 parts of thioglycolic acid was dissolved in 7 parts of toluene and divided into 9 portions each of which was added every 30 minutes. Likewise, AIBN (1.5 parts) was divided into 3 portions each of which was added every 1.5 hours. Thus, the polymerization was carried out. Subsequently, the mixture was refluxed for additional two hours, thereby terminating the polymerization to obtain a polymer solution of the following formula (g):

(g)

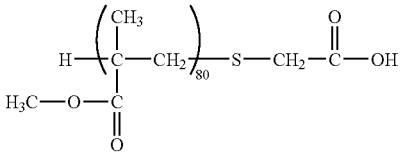

(in the above formula, 80 represents the average number of repetitions of the repeating unit).

The reaction temperature was 77 to 87° C. Part of the reaction solution was subjected to re-precipitation using n-hexane, followed by drying. Then, an acid value was measured and found to be 0.34 mg equivalent/g. An average number of repetitions of the repeating unit was about 80.

Next, part of acetone was distilled off from the above reaction solution, followed by the addition of 0.5% of triethyl amine as a catalyst and 200 ppm of hydroquinone monomethyl ether as a polymerization inhibitor. In addition, 1.2-fold moles of glycidyl methacrylate relative to the acid value of the polymer was added. Subsequently, the reaction solution was allowed to react for 11 hours under reflux (about 110° C.). The reaction solution was added to 10-fold volume of n-hexane and then subjected to precipitation, followed by drying at 80° C. under reduced pressure. As a result, 90 parts of a compound represented by the following formula (d-1) was obtained:

(d-1)

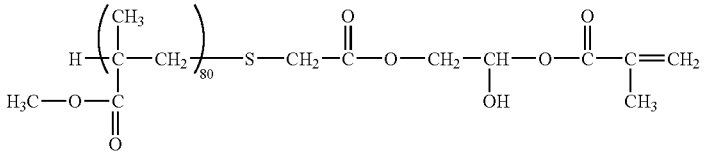

(in the above formula, 80 represents the average number of repetitions of the repeating unit).

Next, the following materials were placed in a glass flask equipped with an agitator, a reflux condenser, a dropping funnel, a thermometer, and a gas-blowing opening and allowed to react for 5 hours under reflux (heated to about 100° C.) while introducing a nitrogen gas: 70 parts of a compound represented by the above formula (d-1); 30 parts of a product in which a compound represented by the above formula (3-1-3) obtained by Synthesis Example (A-1) was a principal component; 270 parts of trifluorotoluene; and AIBN (0.35 part). The reaction solution was introduced into 10-fold volume of methanol and subjected to precipitation, followed by drying at 80° C. under reduced pressure. Consequently, a polymer (A-A: weight average molecular weight (Mw): 22,000) having a repeating structural unit represented by the above formula (1-1-3) was obtained.

In the present invention, the weight average molecular weights of the polymer and the resin were measured as described below according to a common procedure.

In other words, the polymer or the resin as a measurement target was placed in tetrahydrofuran and then left standing for several hours. After that, the measurement target resin and tetrahydrofuran were mixed well while being shaken (mixed until no aggregates of the measurement target polymer or resin were observed), and allowed to stand further for 12 hours or more.

After that, a product which had been passed through a sample-treating filter, MAISHORIDISK H-25-5 manufactured by Tosoh Corporation, was provided as a sample for gel permeation chromatography (GPC).

Subsequently, a column was stabilized in a heat chamber at 40° C. and a solvent, tetrahydrofuran, was then fed at a flow rate of 1 ml/min to the column at the temperature. Subsequently, 10 μl of the GPC sample was injected into the column, thereby determining the weight average molecular weight of the measurement target polymer or resin. The column used was a column TSKgel SuperHM-M manufactured by Tosoh Corporation.

For determining the weight average molecular weight of the measurement target polymer or resin, the molecular weight distribution possessed by the measuring-target polymer or resin was calculated from the relationship between the logarithmic values of the standard curve prepared by using several monodisperse polystyrene standard samples and the counted values. The standard polystyrene samples used for preparing the standard curve were monodisperse polystyrene manufactured by Sigma-Aldrich Corporation of ten different molecular weights: 3,500; 12,000; 40,000; 75,000; 98,000; 120,000; 240,000; 500,000; 800,000; and 1,800,000. The detector used was an RI (an index of refraction) detector.

Production Example (A-2)

Production of Polymer (A-B)

The reaction and the process were carried out by the same procedures as in Production Example (A-1) except that the compound represented by the above formula (3-1-3) was replaced with a product in which the compound represented by the above formula (3-1-4) obtained in Synthesis Example (A-2) was a principal component. Consequently, a polymer (A-B: weight average molecular weight (Mw): 21,000) having the repeating structural unit represented by the above formula (1-1-4) was obtained.

Production Example (A-3)

Production of Polymer (A-C)

The reaction and the process were carried out by the same procedures as in Production Example (A-1) except that the compound represented by the above formula (3-1-3) was replaced with a product in which the compound represented by the above formula (3-1-6) obtained in Synthesis Example (A-3) was a principal component. Consequently, a polymer (A-C: weight average molecular weight (Mw): 19,500) having the repeating structural unit represented by the above formula (1-1-6) was obtained.

Production Example (A-4)

Production of Polymer (A-D)

The reaction and the process were carried out by the same procedures as in Example (A-1) except that the compound represented by the above formula (3-1-3) was replaced with a produce in which the compound represented by the above formula (3-1-7) obtained in Synthesis Example (A-4) was a principal component. Consequently, a polymer (A-D: weight average molecular weight (Mw): 23,400) having the repeating structural unit represented by the above formula (1-1-7) was obtained.

Production Example (A-5)

Production of Polymer (A-E)

The reaction and the process were carried out by the same procedures as in Production Example (A-1) except that the compound represented by the above formula (3-1-3) was replaced with a product in which the compound represented by the above formula (3-2-2) obtained in Synthesis Example (A-5) was a principal component. Consequently, a polymer (A-E: weight average molecular weight (Mw): 22,100) having the repeating structural unit represented by the above formula (1-2-2) was obtained.

Production Example (A-6)

Production of Polymer (A-F)

The reaction and the process were carried out by the same procedures as in Production Example (A-1) except that the compound represented by the above formula (3-1-3) was replaced with a product in which the compound represented by the above formula (3-2-1) obtained in Synthesis Example (A-6) was a principal component. Consequently, a polymer (A-F: weight average molecular weight (Mw): 22,500) having the repeating structural unit represented by the above formula (1-2-1) was obtained.

Production Example (A-7)

Production of Polymer (A-G) (Comparative Example)

The reaction and the process were carried out by the same procedures as in Production Example (A-1) except that the compound represented by the above formula (3-1-3) was replaced with a product in which the compound represented by the above formula (A-f) obtained in Synthesis Example (A-7) was a principal component. Consequently, a polymer (A-G: weight average molecular weight (Mw): 21,000) having the repeating structural unit represented by the following formula (A-f-2) was obtained:

(A-f-2)

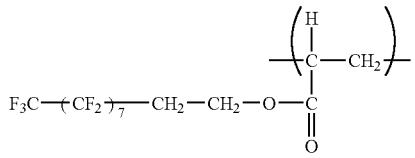

(in the above formula, 7 represents the number of repetitions of the repeating unit).

Example (A-1)

A conductive support used was an aluminum cylinder (JIS-A3003, aluminum alloy ED tube, manufactured by Showa Aluminum Corporation) of 260.5 mm in length and 30 mm in diameter obtained by hot extrusion in an environment of a temperature of 23° C. and a humidity of 60% RH.

The following materials were dispersed by means of a sand mill using glass beads 1 mm in diameter for 3 hours, thereby preparing a dispersion liquid: 6.6 parts of $TiO_2$ particles coated with oxygen-depleted $SnO_2$ as conductive particles (power resistivity: 80 Ω·cm, $SnO_2$ coverage (mass ratio): 50%); 5.5 parts of a phenol resin (trade name: Plyophen J-325, manufactured by Dainippon Ink & Chemicals, Incorporated; resin solic content: 60%) as a resin binder; and 5.9 parts of methoxy propanol as a solvent.

The following materials were added to the dispersion liquid, and were stirred, thereby preparing a conductive-layer coating solution: 0.5 parts of silicone resin particles (trade name: Tospal 120, manufactured by GE Toshiba Silicones; average particle size: 2 μm) as a surface-roughness imparting agent; and 0.001 parts of Silicone oil (trade name: SH28PA, manufactured by Dow Corning Toray Silicone Co., Ltd.) as a leveling agent.

The support was dip-coated with the conductive-layer coating solution and was dried and heat-cured at a temperature of 140° C. for 30 minutes, thereby forming a conductive layer of 15 μm in average film thickness at a position of 130 mm from the upper end of the support.

The conductive layer was dip-coated with the following intermediate-layer coating solution and then dried at a temperature of 100° C. for 10 minutes, thereby forming an intermediate layer of 0.5 μm in average film thickness at a position of 130 mm from the upper end of the support. The intermediate-layer coating solution was prepared by dissolving 4 parts of N-methoxy methylated nylon (trade name: Toresin EF-30T, manufactured by Teikoku Chemical Industry Co., Ltd.) and 2 parts of a copolymer nylon resin (Amilan CM8000, manufactured by Toray Co., Ltd.) in a mixed solvent of 65 parts of methanol and 30 parts of n-butanol.

Subsequently, the following materials were dispersed by means of a sand-milling device using glass beads of 1 mm in diameter for 1 hour, followed by adding 250 parts of ethyl acetate, thereby preparing a charge-generating layer coating solution: 10 parts of hydroxy gallium phthalocyanine in crystal form with intense peaks at Bragg angles (2θ±0.2°) in CuKα-characteristic X-ray diffraction of 7.5°, 9.9°, 16.3°, 18.6°, 25.1°, and 28.3°; 5 parts of polyvinyl butyral (trade name: S-LEX BX-1, manufactured by Sekisui Chemical, Co., Ltd.); and 250 parts of cyclohexanone.

The intermediate layer was dip-coated with the charge-generating layer coating solution and then was dried at a temperature of 100° C. for 10 minutes, thereby forming a charge-generating layer of 0.16 μm in average film thickness at a position of 130 mm from the upper end of the support.

Next, the following materials were dissolved in a mixed solvent of 30 parts of dimethoxy methane and 70 parts of chlorobenzene, thereby preparing a coating solution containing a charge-transporting substance: 10 parts of a charge-transporting substance having a structure represented by the following formula (CTM-1):

(CTM-1)

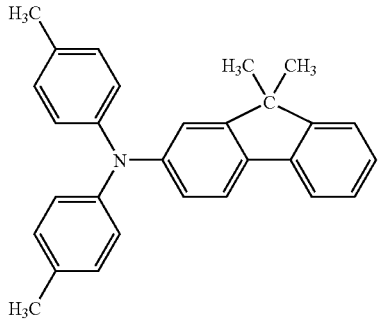

and 10 parts of a polycarbonate resin (Iupilon Z-400, manufactured by Mitsubishi Engineering-Plastics Corporation) [viscosity average molecular weight (Mv): 39,000] having a repeating structural unit represented by the following formula (P-1) as a binder resin:

(P-1)

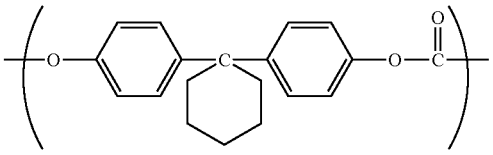

Subsequently, 5 parts of tetrafluoroethylene resin particles (trade name: Lubron L2, manufactured by Daikin Industries, Ltd.), 5 parts of a polycarbonate resin having a repeating structural unit represented by the above formula (P-1), and 70 parts of chlorobenzene were mixed together. Further, a solution in which the polymer (A-A: 0.5 parts) produced in Production Example (A-1) was added was prepared. The solution was allowed to pass twice through a high-speed liquid-collision dispersing device (trade name: Microfluidizer M-110EH, manufactured by U.S. Microfluidics, Co., Ltd.) at a pressure of 49 MPa (500 kg/cm$^2$), so that the solution containing the tetrafluoroethylene resin particles was subjected to high pressure dispersion. The average particle size of the tetrafluoroethylene resin particles immediately after the dispersion was 0.15 μm.

The dispersion liquid of tetrafluoroethylene resin particles thus prepared was mixed with the coating solution containing the charge-transporting substance, thereby preparing a charge-transporting layer coating solution. The amount added was adjusted so that the mass ratio of the tetrafluoroethylene resin particles to the total solid content (charge-transporting substance, binder resin, and tetrafluoroethylene resin particles) in the coating solution was 5%.

The charge-generating layer was dip-coated with the charge-transporting layer coating solution thus prepared and then was dried at a temperature of 120° C. for 30 minutes, thereby forming a charge-transporting layer with an average film thickness of 17 μm at a position of 130 mm from the upper end of the support.

A method of measuring a viscosity average molecular weight (Mv) is as described below.

First, 0.5 g of a sample was dissolved in 100 ml of methylene chloride and a specific viscosity of the solution at a temperature of 25° C. was then determined using an improved Ubbelohde-type viscometer. Subsequently, the limiting viscosity was calculated from the specific viscosity, and the viscosity average molecular weight (Mv) was then calculated by the Mark-Houwink viscosity formula. The viscosity average molecular weight (Mv) was represented by the corresponding value of polystyrene determined by gel permeation chromatography (GPC).

Consequently, the electrophotographic photosensitive member whose charge-transporting layer was a surface layer was prepared.

The electrophotographic photosensitive member thus prepared was subjected to the evaluation of an image*1 and the evaluation of electrophotographic properties*2. The evaluation results were shown in Table 1.

*1. Image-evaluating Method

The electrophotographic photosensitive member thus prepared, the main body of a laser beam printer LBP-2510 manufactured by Canon Co., Ltd., and a process cartridge of the LBP-2510 were placed for 15 hours in an environment of a temperature of 25° C. and a humidity of 50% RH. After that, the electrophotographic photosensitive member was attached to the process cartridge and images were output in the same environment.

The output of an initial image was carried out where the prepared electrophotographic photosensitive member was set in a cyan process cartridge and the process cartridge was set in a cyan process cartridge station in the main body. In this case, an image with only a cyan color was output in such a state that only a cyan process cartridge in which the electrophotographic photosensitive member of the present invention was set was provided with a developing unit and other stations were not provided with any developing unit. The image was a chart for printing the half tone of a knight's move pattern (a half tone image in which the knight's move pattern in chess (an isolated dot pattern in which two dots were printed for each 8 grids) was repeated) on a sheet of letter paper. The evaluation method was carried out by determining the number of image defects due to poor dispersion on the whole surface of letter paper on which an image was output using the electrophotographic photosensitive member. The image was evaluated as "A" where no image defect was observed, "B" where 1 to 2 defects were found in the image, and "C" where 3 or more defects were found in the image.

*2: Evaluation Method for Electrophotographic Properties

The prepared electrophotographic photosensitive member, the main body of the laser beam printer LBP-2510 manufactured by Canon Co., Ltd., and tools for measuring surface potential were placed in an environment of a temperature of 25° C. and a humidity of 50% RH (normal temperature and normal humidity) for 15 hours. The tools for measuring surface potential were those (from which toner, developing rollers, and a cleaning blade were removed) used for placing a probe for measuring the surface potential of an electrophotographic photosensitive member at the developing roller position of the process cartridge of the LBP-2510. After that, in the same environment, the tools for measuring the surface potential of the electrophotographic photosensitive member were attached to the member, and the surface potential of the electrophotographic photosensitive member was measured without feeding sheets in such a state that an electrostatic transfer belt unit was removed.

A potential measurement method was carried out as described below. First, an exposure part potential (Vl: a potential at the first round after exposing the whole surface of the electrophotographic photosensitive member after charging) was measured. Next, a potential after pre-exposure (Vr: a potential at the first round after pre-exposure (the second round after charging) where charging was carried out only at the first round of the electrophotographic photosensitive member and image exposure was not performed) was measured. Subsequently, a cycle of charging/whole-surface image exposure/pre-exposure was repeated 1,000 times (1K cycles). After that, the potential after pre-exposure (in the tables, represented by Vr (1K)) was measured again.

Those results were shown in Table 1.

Examples (A-2) to (A-6)

An electrophotographic photosensitive member was prepared and evaluated in the same manner as in Example (A-1) except that the polymer (A-A) used in the charge-transporting layer coating solution in Example (A-1) was replaced with a polymer shown in Table 1. The results are shown in Table 1.

Example (A-7)

An electrophotographic photosensitive member was prepared and evaluated in the same manner as in Example (A-2) except that the tetrafluoroethylene resin particles used in the charge-transporting layer coating solution in Example (A-2) were replaced with vinylidene fluoride resin particles. The results are shown in Table 1.

Example (A-8)

An electrophotographic photosensitive member was prepared and evaluated in the same manner as in Example (A-2) except for the following change. The results are shown in Table 1.

The polycarbonate resin including a repeating structural unit represented by the above formula (P-1), the binder resin of the charge-transporting layer, was replaced with a polyarylate resin having a repeating structural unit represented by the following formula (P-2) (weight average molecular weight (Mw): 120,000):

(P-2)

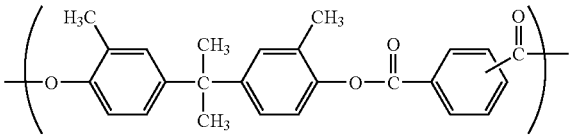

In addition, a molar ratio between a terephthalic acid structure and an isophthalic acid structure in the above polyarylate resin (tetraphthalic acid structure: isophthalic acid structure) was 50:50.

Example (A-9)

An electrophotographic photosensitive member was prepared and evaluated in the same manner as in Example (A-8) except that hydroxy gallium phthalocyanine as the charge-generating substance of the charge-generating layer in Example (A-8) was replaced with oxytitanium phthalocyanine (TiOPc) below. The results are shown in Table 1. TiOPc with intense peaks at Bragg angles 2θ±0.2° in CuKα-characteristic X-ray diffraction of 9.0°, 14.2°, 23.9°, and 27.1°.

Examples (A-10) and (A-11)

An electrophotographic photosensitive member was prepared and evaluated in the same manner as in Example (A-8) except that the polymer (A-B) used in the charge-transporting layer coating solution in Example (A-8) was replaced with a polymer represented in Table 1. The results are shown in Table 1.

Example (A-12)

An electrophotographic photosensitive member was prepared and evaluated the same manner as in Example (A-10) except that the charge-transporting substance represented by the above formula (CTM-1) used in the charge-transporting layer coating solution in Example (A-10) was replaced with a charge-transporting substance represented by the following formula (CTM-2):

(CTM-2)

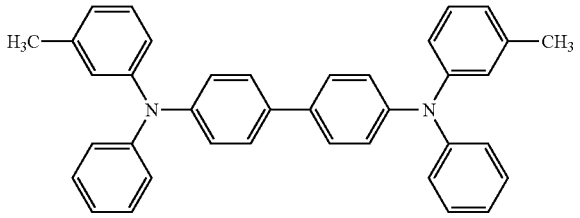

and a charge-transporting substance represented by the following formula (CTM-3):

(CTM-3)

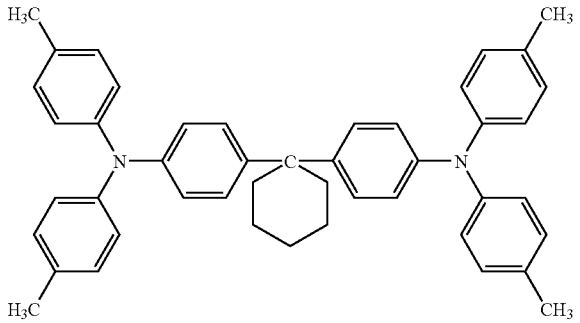

where 5 parts of each charge-transporting substance was used. The results are shown in Table 1.

Comparative Example (A-1)

An electrophotographic photosensitive member was prepared and evaluated in the same manner as in Example (A-2) except that the polymer (A-B) was not contained in the charge-transporting layer coating solution in Example (A-2). The results are shown in Table 1.

Comparative Example (A-2)

An electrophotographic photosensitive member was prepared and evaluated in the same manner as in Example (A-2) except that the polymer (A-B) used in the charge-transporting layer coating solution in Example (A-2) was replaced with 2,6-di-tert-butyl-p-cresol (BHT). The results are shown in Table 1.

Comparative Example (A-3)

An electrophotographic photosensitive member was prepared and evaluated in the same manner as in Example (A-2) except that the polymer (A-B) used in the charge-transporting layer coating solution in Example (A-2) was replaced with the polymer (A-G) produced in Production Example (A-7). The results are shown in Table 1.

Comparative Example (A-4)

An electrophotographic photosensitive member was prepared and evaluated in the same manner as in Example (A-2) except that the polymer (A-B) used in the charge-transporting layer coating solution in Example (A-2) was replaced with a compound (trade name: Alon GF300, manufactured by Toagosei Co., Ltd.). The results are shown in Table 1.

Example (A-13)

0.15 part of the polymer (A-B) produced in Production Example (A-2) and 35 parts of 1,1,2,2,3,3,4-heptafluorocyclopentane (trade name: Zeorora-H, manufactured by Zeon Corporation) were dissolved in 35 parts of 1-propanol. After that, 3 parts of tetrafluoroethylene resin particles (trade name: Lubron L-2, manufactured by Daikin Industries, Ltd.) was added. Subsequently, the mixture was subjected three times to treatment with a high-pressure dispersing device (trade name: Microfluidizer M-110EH, manufactured by U.S. Microfluidics, Co., Ltd.) at a pressure of 58.8 MPa (600 kgf/cm$^2$) to be uniformly dispersed. The dispersed product was filtrated through a 10-μm polytetrafluoroethylene membrane filter under pressure, thereby preparing a dispersion liquid. The average particle size of the tetrafluoroethylene resin particles immediately after the dispersion was 0.14 μm.

Example (A-14)

A tetrafluoroethylene resin particle dispersion liquid was prepared in the same manner as in Example (A-13) except that the polymer (A-B) in Example (A-13) was replaced with the polymer (A-E) produced in Production Example (A-5). The tetrafluoroethylene resin particles immediately after the dispersion had an average particle size of 0.17 μm.

TABLE 1

| | | Particle size after dispersion [μm] | Initial image | Initial electrophotographic characteristics Vl [−V] | Vr [−V] | After extensive operation Vr (1K) [−V] |
|---|---|---|---|---|---|---|
| Example (A-1) | Polymer (A-A) | 0.15 | A | 125 | 35 | 45 |
| Example (A-2) | Polymer (A-B) | 0.13 | A | 125 | 35 | 45 |
| Example (A-3) | Polymer (A-C) | 0.17 | A | 120 | 30 | 40 |
| Example (A-4) | Polymer (A-D) | 0.16 | A | 120 | 35 | 45 |
| Example (A-5) | Polymer (A-E) | 0.16 | A | 120 | 30 | 40 |

TABLE 1-continued

| | | Particle size after dispersion [μm] | Initial image | Initial electrophotographic characteristics Vl [−V] | Vr [−V] | After extensive operation Vr (1K) [−V] |
|---|---|---|---|---|---|---|
| Example (A-6) | Polymer (A-F) | 0.16 | A | 120 | 35 | 45 |
| Example (A-7) | Polymer (A-B) | 0.20 | A | 125 | 40 | 50 |
| Example (A-8) | Polymer (A-B) | 0.10 | A | 120 | 35 | 40 |
| Example (A-9) | Polymer (A-B) | 0.10 | A | 125 | 40 | 50 |
| Example (A-10) | Polymer (A-E) | 0.11 | A | 120 | 25 | 30 |
| Example (A-11) | Polymer (A-F) | 0.11 | A | 120 | 25 | 30 |
| Example (A-12) | Polymer (A-E) | 0.11 | A | 120 | 25 | 30 |
| Comparative Example (A-1) | — | 2.55 | C | 120 | 25 | 30 |
| Comparative Example (A-2) | BHT | 2.35 | C | 135 | 45 | 75 |
| Comparative Example (A-3) | Polymer (A-G) | 0.22 | B | 120 | 40 | 60 |
| Comparative Example (A-4) | Alon GF300 | 0.21 | A | 125 | 35 | 55 |

As can be seen from the above results, the following will be evident from a comparison between Examples (A-1) to (A-12) of the present invention and Comparative Examples (A-1) and (A-2). The polymer having the repeating structural unit in the present invention can be used as a structural component of the surface-layer coating solution together with fluorine-atom-containing resin particles to produce an electrophotographic photosensitive member. Thus, the fluorine-atom-containing resin particles can be dispersed so as to be provided with particle sizes almost up to those of primary particles. As a result, an electrophotographic photosensitive member free from image defects due to poor dispersion can be provided.

In addition, when making a comparison between Examples (A-1) to (A-12) of the present invention and Comparative Example (A-3), it can be seen that the branched structure in the polymer having the repeating structural unit in the present invention allows the fluorine-atom-containing resin particles to be dispersed so as to be provided with particle sizes almost up to those of primary particles, and can stably retain the dispersion state.

Further, the following will be evident from a comparison between Examples (A-1) to (A-12) of the present invention and Comparative Example (A-4). When the polymer having the repeating structural unit in the present invention is used as a structural component of the surface-layer coating solution together with fluorine-atom-containing resin particles to produce an electrophotographic photosensitive member, the fluorine-atom-containing resin particles can be made finer so as to be provided with dispersion particle sizes almost up to those of primary particles more than the case where the polymer of Comparative Example (A-4) is used. Additionally, the finely dispersed state can be stably retained. Even though no difference on images could be detected, in consideration of the fact that the fluorine-atom-containing resin particles can be made finer so as to be provided with dispersion particle sizes almost up to those of primary particles by virtue of the constitution of the present invention, the constitution of the present invention is considered to be superior in dispersibility, dispersion stability, etc.

Synthesis Example (B-1)

Synthesis of Compound Represented by the Above Formula (3-2-2)

An iodinated material (0.5 part) represented by the following formula (B-e-1):

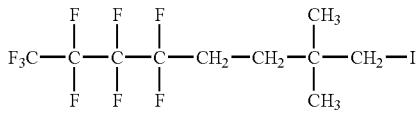

(B-e-1)

and ion-exchange water (20 parts) were incorporated into a deaerated autoclave, followed by heating up to 300° C. to carry out a conversion reaction of iodine to a hydroxyl group at a gauge pressure of 9.2 MPa for 4 hours. After the completion of the reaction, diethyl ether (20 parts) was added to the reaction mixture. After the mixture had been separated into two phases, magnesium sulfate (0.2 part) was placed in an ether phase and magnesium sulfate was then removed by filtration, thereby obtaining a hydroxyl compound. The hydroxyl compound was subjected to column chromatography to separate and remove components other than a principal component. Subsequently, 100 parts of the previously obtained hydroxyl compound, 50 parts of acrylic acid, 5 parts of hydroquinone, 5 parts of p-toluenesulfonic acid, and 200 parts of toluene were introduced into a glass flask equipped with an agitator, a condenser, and a thermometer. Next, the flask was heated up to 110° C. and the reaction was then continued until the raw material, the hydroxyl compound, disappeared. After the completion of the reaction, the mixture was diluted with 200 parts of toluene, washed with a sodium hydroxide aqueous solution twice, and then washed with ion-exchange water three times. Subsequently, toluene was distilled off under reduced pressure, thereby obtaining a product. The resulting product was identified by $^{1}$H-NMR and $^{19}$F-NMR. As a result of the quantitative analysis of the product by gas chromatography, it was found that the compound represented by the above formula (3-3-2) was a principal component.

Synthesis Example (B-2)

Synthesis of Compound Represented by the Above Formula (3-3-6)

A product containing the compound represented by the above formula (3-3-6) as a principal component was obtained by carrying out the same reaction as in Synthesis Example (B-1) except that an iodinated material represented by the following formula (B-e-2) was used instead of the iodinated material represented by the above formula (B-e-1) described in Synthesis Example (B-1).

(B-e-2)

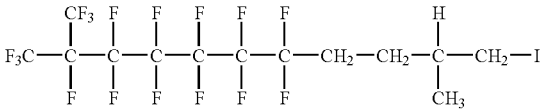

Synthesis Example (B-3)

A reaction was carried out in the same manner in Synthesis Example (B-1) except that an iodinated material represented by the following formula (B-f-1):

(B-f-1)

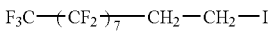

(in the above formula, 7 represents the number of repetitions of the repeating unit)

was used instead of the iodinated material represented by the above formula (B-e-1) described in Synthesis Example (B-1). Consequently, a product, in which a compound represented by the following formula (B-f):

(B-f)

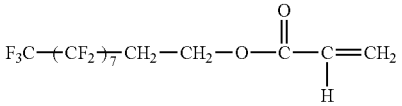

(in the above formula, 7 represents the number of repetitions of the repeating unit)

was a principal component, was obtained.

Production Example (B-1)

Production of Polymer (B-A)

In a glass flask equipped with an agitator, a reflux condenser, a dropping funnel, a thermometer, and a gas-blowing opening, 10 parts of methyl methacrylate (hereinafter abbreviated as MMA) and 0.3 part of an acetone (17.5%)-toluene mixed solvent were placed. Subsequently, a nitrogen gas was introduced into the flask and then 0.5 part of azobisisobutyronitrile (hereinafter abbreviated as AIBN) as a polymerization initiator and 0.32 part of thioglycolic acid as a chain transfer agent were added to initiate polymerization under reflux. During a time period of 4.5 hours after the initiation, 90 parts of MMA was continuously dropped. In addition, 2.08 parts of thioglycolic acid was dissolved in 7 parts of toluene and divided into 9 portions each of which was added every 30 minutes. Likewise, AIBN (1.5 parts) was divided into 3 portions each of which was added every 1.5 hours. Thus, the polymerization was carried out. Subsequently, the mixture was refluxed for an additional two hours, thereby terminating the polymerization to obtain a polymer solution of the above formula (g). The reaction temperature was 77 to 87° C. Part of the reaction solution was subjected to re-precipitation using n-hexane, followed by drying. Then, an acid value was measured and found to be 0.34 mg equivalent/g. An average number of repetitions of the repeating unit was about 80.

Next, part of acetone was distilled off from the above reaction solution, followed by the addition of 0.5% of triethyl amine as a catalyst and 200 ppm of hydroquinone monomethyl ether as a polymerization inhibitor. In addition, 1.2-fold moles of glycidyl methacrylate relative to the acid value of the polymer was added. Subsequently, the reaction solution was allowed to react for 11 hours under reflux (about 110° C.). The reaction solution was added to 10-fold volume of n-hexane and then subjected to precipitation, followed by drying at 80° C. under reduced pressure. As a result, 90 parts of a compound represented by the above formula (d-1) was obtained.

Next, the following materials were placed in a glass flask equipped with an agitator, a reflux condenser, a dropping funnel, a thermometer, and a gas-blowing opening and then allowed to react for 5 hours under reflux (heated to about 100° C.) while introducing a nitrogen gas: 70 parts of a compound represented by the above formula (d-1); 30 parts of a product in which a compound represented by the above formula (3-2-2) obtained in Synthesis Example (B-1) was a principal component; 270 parts of trifluorotoluene; and AIBN (0.35 parts). The reaction solution was introduced into 10-fold volume of methanol and subjected to precipitation, followed by drying at 80° C. under reduced pressure. Consequently, a polymer (B-A: weight average molecular weight (Mw): 24,000) having a repeating structural unit represented by the above formula (1-3-2) was obtained.

The weight average molecular weight of the polymer was measured by the same method as the aforementioned method.

Production Example (B-2)

Production of Polymer (B-B)

The reaction and the process were carried out in the same procedures as in Production Example (B-1) except that the compound represented by the above formula (3-3-2) was replaced with a product in which the compound represented by the above formula (3-3-6) obtained in Synthesis Example (B-2) was a principal component. Consequently, a polymer (B-B: weight average molecular weight 23,000) having the repeating structural unit represented by the above formula (1-3-6) was obtained.

Production Example (B-3)

Production of Polymer (B-C) (Comparative Example)

The reaction and the process were carried out in the same procedures as in Production Example (B-1) except that the compound represented by the above formula (3-3-2) was replaced with a product in which the compound represented by the above formula (B-f) obtained in Synthesis Example (B-3) was a principal component. Consequently, a polymer (B-C: weight average molecular weight 21,000) having the repeating structural unit represented by the following formula (B-f-2) was obtained:

(B-f-2)

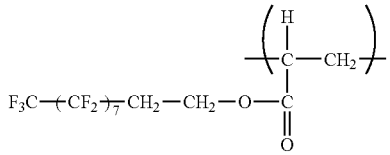

(in the above formula, 7 represents the number of repetitions of the repeating unit).

Example (B-1)

A conductive support used was an aluminum cylinder (JIS-A3003, aluminum alloy ED tube, manufactured by Showa Aluminum Corporation) of 260.5 mm in length and 30 mm in diameter obtained by hot extrusion in an environment of a temperature of 23° C. and a humidity of 60% RH.

The following materials were dispersed by means of a sand mill using glass beads 1 mm in diameter for 3 hours, thereby preparing a dispersing solution: 6.6 parts of $TiO_2$ particles coated with oxygen-depleted $SnO_2$ as conductive particles (power resistivity: 80 Ω·cm, $SnO_2$ coverage (mass ratio): 50%); 5.5 parts of a phenol resin (trade name: Plyophen J-325, manufactured by Dainippon Ink & Chemicals, Incorporated; resin solid content: 60%) as a resin binder; and 5.9 parts of methoxy propanol as a solvent.

The following materials were added to the dispersion solution, and were stirred, thereby preparing a conductive-layer coating solution: 0.5 part of silicone resin particles (trade name: Tospal 120, GE Toshiba Silicones; average particle size: 2 μm) as a surface-roughness imparting agent; and 0.001 part of silicone oil (trade name: SH28PA, manufactured by Dow Corning Toray Silicone Co., Ltd.) as a leveling agent.

The support was dip-coated with the conductive-layer coating solution and was dried and heat-cured at a temperature of 140° C. for 30 minutes, thereby forming a conductive layer of 15 μm in average film thickness at a position of 130 mm from the upper end of the support.

The conductive layer was dip-coated with the following intermediate-layer coating solution and then was dried at a temperature of 100° C. for 10 minutes, thereby forming an intermediate layer of 0.5 μm in average film thickness at a position of 130 mm from the upper end of the support. The intermediate-layer coating solution was prepared by dissolving 4 parts of N-methoxy methylated nylon (trade name: Toresin EF-30T, manufactured by Teikoku Chemical Industry Co., Ltd.) and 2 parts of a copolymer nylon resin (Amilan CM8000, manufactured by Toray Co., Ltd.) in a mixed solvent of 65 parts of methanol and 30 parts of n-butanol.

Subsequently, the following materials were dispersed by means of a sand-milling device using glass beads of 1 mm in diameter for 1 hour, followed by adding 250 parts of ethyl acetate, thereby preparing a charge-generating layer coating solution: 10 parts of hydroxy gallium phthalocyanine in crystal form with intense peaks at Bragg angles (2θ±0.2°) in CuKα-characteristic X-ray diffraction of 7.5°, 9.9°, 16.3°, 18.6°, 25.1°, and 28.3°; 5 parts of polyvinyl butyral (trade name: S-LEX BX-1, manufactured by Sekisui Chemical, Co., Ltd.); and 250 parts of cyclohexanone.

The intermediate layer was dip-coated with the charge-generating layer coating solution and then was dried at a temperature of 100° C. for 10 minutes, thereby forming a charge-generating layer of 0.16 μm in average film thickness at a position of 130 mm from the upper end of the support.

Next, the following materials were dissolved in a mixture solvent of 30 parts of dimethoxy methane and 70 parts of chlorobenzene, thereby preparing a coating solution containing a charge-transporting substance: 10 parts of a charge-transporting substance having a structure represented by the above formula (CTM-1); and 10 parts of a polycarbonate resin (Iupilon Z-400, manufactured by Mitsubishi Engineering-Plastics Corporation) [viscosity average molecular weight (Mv): 39,000] formed of a repeating structural unit represented by the above formula (P-1) as a binder resin.

Subsequently, 5 parts of tetrafluoroethylene resin particles (trade name: Lubron L2, manufactured by Daikin Industries, Ltd.), 5 parts of the polycarbonate resin having a repeating structural unit of the above formula (P-1), and 70 parts of chlorobenzene were mixed together. Further, a solution in which the polymer (B-A: 0.5 part) produced in Production Example (B-1) was added was prepared. The solution was allowed to pass twice through a high-speed liquid-collision dispersing device (trade name: Microfluidizer M-110EH, manufactured by U.S. Microfluidics, Co., Ltd.) at a pressure of 49 MPa (500 kg/cm$^2$), so that the solution containing the tetrafluoroethylene resin particles was subjected to high pressure dispersion. The average particle size of the tetrafluoroethylene resin particles immediately after the dispersion was 0.15 μm.

The dispersion liquid of tetrafluoroethylene resin particles thus prepared was mixed with the coating solution containing the charge-transporting substance, thereby preparing a charge-transporting layer coating solution. The amount added was adjusted so that the mass ratio of the tetrafluoroethylene resin particles to the total solid content (charge-transporting substance, binder resin, and tetrafluoroethylene resin particles) in the coating solution was 5%.

The charge-generating layer was dip-coated with the charge-transporting layer coating solution thus prepared and then was dried at a temperature of 120° C. for 30 minutes, thereby forming a charge-transporting layer with an average film thickness of 17 μm at a position of 130 mm from the upper end of the support.

Consequently, the electrophotographic photosensitive member whose charge-transporting layer was provided as a surface layer was prepared.

The electrophotographic photosensitive member thus prepared was subjected to the evaluation of an image*1 and the evaluation of electrophotographic properties*2. The results were shown in Table 2.

*1: Image-Evaluating Method

The electrophotographic photosensitive member thus prepared, the main body of a laser beam printer LBP-2510 manufactured by Canon Co., Ltd., and a process cartridge of the LBP-2510 were placed for 15 hours in an environment of a temperature of 25° C. and a humidity of 50% RH. After that, the electrophotographic photosensitive member was attached to the process cartridge and images were then output in the same environment.

The output of an initial image was carried out where the prepared electrophotographic photosensitive member was set in a cyan process cartridge and the process cartridge was set in a cyan process cartridge station in the main body. In this case, an image with only a cyan color was output in such a state that only a cyan process cartridge in which the electrophotographic photosensitive member of the present invention was set was provided with a developing unit and other stations were not provided with any developing unit. The image was a chart for printing the half tone of a knight's move pattern (a half tone image in which the knight's move pattern of chess (an isolated dot pattern in which two dots were printed for each 8 grids) was repeated) on a sheet of letter paper. The evaluation method was carried out by determining the number of image defects due to poor dispersion on the whole surface of letter paper on which an image was output using the electrophotographic photosensitive member. The image was evaluated as "A" where no image defect was observed, "B" where 1 to 2 defects were found in the image, and "C" where 3 or more defects were found in the image.

*2: Evaluation Method for Electrophotographic Properties

The prepared electrophotographic photosensitive member, the main body of the laser beam printer LBP-2510 manufactured by Canon Co., Ltd., and tools for measuring surface potential were placed in an environment of a temperature of 25° C. and a humidity of 50% RH (normal temperature and normal humidity) for 15 hours. The tools for measuring surface potential were those (from which toner, developing rollers, and a cleaning blade were removed) used for placing a probe for measuring the surface potential of an electrophotographic photosensitive member at the developing roller position of the process cartridge of the LBP-2510. After that, in the same environment, the tools for measuring the surface potential of the electrophotographic photosensitive member were attached to the member, and the surface potential of the electrophotographic photosensitive member was measured without feeding sheets in such a state that an electrostatic transfer belt unit was removed.

A potential measurement method was carried out as described below. First, an exposure part potential (Vl: a potential at the first round after exposing the whole surface of the electrophotographic photosensitive member after charging) was measured. Next, a potential after pre-exposure (Vr: a potential at the first round after pre-exposure (the second round after charging) where charging was carried out only at the first round of the electrophotographic photosensitive member and image exposure was not performed) was measured. Subsequently, a cycle of charging/whole-surface image exposure/pre-exposure was repeated 1,000 times (1K cycles). After that, the potential after pre-exposure (in the tables, represented by Vr (1K)) was measured again.

Those results were shown in Table 2.

Example (B-2)

An electrophotographic photosensitive member was prepared and evaluated in the same manner as in Example (B-1) except that the polymer (B-A) used in the charge-transporting layer coating solution in Example (B-1) was replaced with the polymer (B-B) produced in Production Example (B-2). The results are shown in Table 2.

Example (B-3)

An electrophotographic photosensitive member was prepared and evaluated in the same manner as in Example (B-1) except that the tetrafluoroethylene resin particles used in the charge-transporting layer coating solution in Example (B-1) were replaced with vinylidene fluoride resin particles. The results are shown in Table 2.

Example (B-4)

An electrophotographic photosensitive member was prepared and evaluated in the same manner as in Example (B-1) except for the following change. The results are shown in Table 2.

The polycarbonate resin including a repeating structural unit represented by the above formula (P-1), the binder resin of the charge-transporting layer, was replaced with a polyarylate resin having a repeating structural unit represented by the above formula (P-2) (weight average molecular weight (Mw): 120,000).

In addition, a molar ratio between a terephthalic acid structure and an isophthalic acid structure in the above polyarylate resin (tetraphthalic acid structure:isophthalic acid structure) was 50:50.

Example (B-5)

An electrophotographic photosensitive member was prepared and evaluated in the same manner as in Example (B-4) except that hydroxy gallium phthalocyanine as the charge-generating substance of the charge-generating layer in Example (B-4) was replaced with oxytitanium phthalocyanine (TiOPc) below. The results are shown in Table 2. TiOPc with intense peaks at Bragg angles 2θ±0.2° in CuKα-characteristic X-ray diffraction of 9.0°, 14.2°, 23.9°, and 27.1°.

Example (B-6)

An electrophotographic photosensitive member was prepared and evaluated in the same manner as in Example (B-5) except that the charge-transporting substance represented by the above formula (CTM-1) used in the charge-transporting layer coating solution in Example (B-5) was replaced with a charge-transporting substance represented by the above formula (CTM-2) and a charge-transporting substance represented by the above formula (CTM-3) where 5 parts of each charge-transporting substance was used. The results are shown in Table 2.

Comparative Example (B-1)

An electrophotographic photosensitive member was prepared and evaluated in the same manner as in Example (B-1) except that the polymer (B-A) was not contained in the charge-transporting layer coating solution in Example (B-1). The results are shown in Table 2.

Comparative Example (B-2)

An electrophotographic photosensitive member was prepared and evaluated in the same manner as in Example (B-1) except that the polymer (B-A) used in the charge-transporting layer coating solution in Example (B-1) was replaced with 2,6-di-tert-butyl-p-cresol (BHT). The results are shown in Table 2.

Comparative Example (B-3)

An electrophotographic photosensitive member was prepared and evaluated in the same manner as in Example (B-1) except that the polymer (B-A) used in the charge-transporting layer coating solution in Example (B-1) was replaced with the polymer (B-C) produced in Production Example (B-3). The results are shown in Table 2.

Comparative Example (B-4)

An electrophotographic photosensitive member was prepared and evaluated in the same manner as in Example (B-1) except that the polymer (B-A) used in the charge-transporting layer coating solution in Example (B-1) was replaced with a compound (trade name: Alon GF300, manufactured by Toagosei Co., Ltd.). The results are shown in Table 2.

Example (B-7)

0.15 part of the polymer (B-A) produced in Production Example (B-1) and 35 parts of 1,1,2,2,3,3,4-heptafluorocyclopentane (trade name: Zeorora-H, manufactured by Zeon Corporation) were dissolved in 35 parts of 1-propanol. After that, 3 parts of tetrafluoroethylene resin particles (trade name: Lubron L-2, manufactured by Daikin Industries, Ltd.) was added. Subsequently, the mixture was subjected three times to treatment with a high-pressure dispersing device (trade name: Microfluidizer M-110EH, manufactured by U.S. Microfluidics, Co., Ltd.) at a pressure of 58.8 MPa (600 kgf/cm$^2$) to be uniformly dispersed. The dispersed product was filtrated through a 10-μm polytetrafluoroethylene membrane filter under pressure, thereby preparing a dispersion liquid. The average particle size of the tetrafluoroethylene resin particles immediately after the dispersion was 0.15 μm.

TABLE 2

| | | Particle size after | | Initial electrophotographic characteristics | | After extensive operation |
|---|---|---|---|---|---|---|
| | | dispersion [μm] | Initial image | Vl [−V] | Vr [−V] | Vr (1K) [−V] |
| Example (B-1) | Polymer (B-A) | 0.15 | A | 125 | 35 | 45 |
| Example (B-2) | Polymer (B-B) | 0.16 | A | 120 | 35 | 45 |
| Example (B-3) | Polymer (B-A) | 0.20 | A | 125 | 40 | 50 |
| Example (B-4) | Polymer (B-A) | 0.11 | A | 125 | 30 | 40 |
| Example (B-5) | Polymer (B-A) | 0.11 | A | 125 | 35 | 45 |
| Example (B-6) | Polymer (B-A) | 0.11 | A | 120 | 30 | 40 |
| Comparative Example (B-1) | — | 2.55 | C | 120 | 25 | 30 |
| Comparative Example (B-2) | BHT | 2.35 | C | 135 | 45 | 75 |
| Comparative Example (B-3) | Polymer (B-C) | 0.22 | B | 120 | 40 | 60 |
| Comparative Example (B-4) | Alon GF300 | 0.21 | A | 125 | 35 | 55 |

As can be seen from the above results, the following will be evident from a comparison between Examples (B-1) to (B-6) of the present invention and Comparative Examples (B-1) and (B-2). The polymer having the repeating structural unit in the present invention can be used as a structural component of the surface-layer coating solution together with fluorine-atom-containing resin particles to produce an electrophotographic photosensitive member. Thus, the fluorine-atom-containing resin particles can be dispersed so as to be provided with particle sizes almost up to those of primary particles. As a result, an electrophotographic photosensitive member free from image defects due to poor dispersion can be provided.

In addition, the following will be evident by making a comparison between Examples (B-1) to (B-6) of the present invention and Comparative Example (B-3). That is, the polymer having the repeating structural unit in the present invention has a structure coupled with an alkylene group having the branched structure with a carbon-carbon bond. Thus, fluorine-atom-containing resin particles are dispersed so as to be provided with particle sizes almost up to those of primary particles, and the dispersion state can be stably retained. Further, good electrophotographic properties can be retained.

Further, the following will be evident from a comparison between Examples (B-1) to (B-6) of the present invention and Comparative Example (B-4). That is, the polymer having the repeating structural unit in the present invention is used as a structural component of a surface-layer coating solution together with the fluorine-atom-containing resin particles to produce an electrophotographic photosensitive member, whereby, compared with the use of the compound of Comparative Example (B-4), fluorine-atom-containing resin particles are further dispersed so as to be provided with particle sizes almost up to those of primary particles, the dispersion state can be stably retained, and good electrophotographic properties can be retained. Even though there was no difference observed on images, taking into account the fact that, according to the constitution of the present invention, the fluorine-atom-containing resin particles can be made finer so as to be provided with dispersion particle sizes almost up to those of primary particles, the constitution of the present invention may be superior in dispersibility, dispersion stability, etc.

Synthesis Example (C-1)

Synthesis of Compound Represented by the Above Formula (3-4-1)

An iodinated material (0.5 parts) represented by the following formula (C-e-1):

(C-e-1)

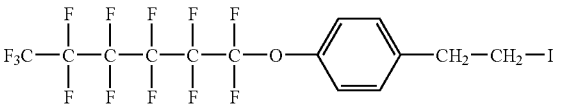

and ion-exchanged water (20 parts) were incorporated into a deaerated autoclave, followed by heating up to 300° C. to carry out a conversion reaction of iodine to a hydroxyl group at a gauge pressure of 9.2 MPa for 4 hours. After the completion of the reaction, diethyl ether (20 parts) was added to the reaction mixture. After the mixture had been separated into two phases, magnesium sulfate (0.2 parts) was placed in an ether phase and magnesium sulfate was then removed by filtration, thereby obtaining a hydroxyl compound. The hydroxyl compound was subjected to column chromatography to separate and remove components other than a principal component. Subsequently, 100 parts of the previously obtained hydroxyl compound, 50 parts of acrylic acid, 5 parts of hydroquinone, 5 parts of p-toluenesulfonic acid, and 200 parts of toluene were introduced into a glass flask equipped with an agitator, a condenser, and a thermometer. Next, the flask was heated up to 110° C. and the reaction was then continued until the raw material, the hydroxyl compound, disappeared. After the completion of the reaction, the mixture was diluted with 200 parts of toluene, washed with a sodium hydroxide aqueous solution twice, and then washed with ion-exchange water three times. Subsequently, toluene was distilled off under reduced pressure, thereby obtaining a product. The resulting product was identified by $^{1}$H-NMR and $^{19}$F-NMR. As a result of the quantitative analysis of the product by gas chromatography, it was found that the compound represented by the above formula (3-4-1) was a principal component.

Synthesis Example (C-2)

Synthesis of Compound Represented by the Above Formula (3-4-3)

A product containing the compound represented by the above formula (3-4-3) as a principal component was obtained by carrying out the same reaction as in Synthesis Example (C-1) except that an iodinate material represented by the following formula (C-e-2) was used instead of the iodinated material represented by the above formula (C-e-1) described in Synthesis Example (C-1).

(C-e-2)

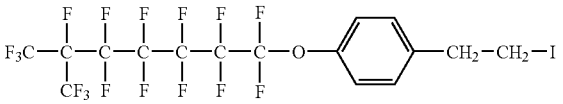

Synthesis Example (C-3)

Synthesis of Compound Represented by the Above Formula (3-4-6)

A product containing the compound represented by the above formula (3-4-6) as a principal component was obtained by carrying out the same reaction as in Synthesis Example (C-1) except that an iodinated material represented by the following formula (C-e-3) was used instead of the iodinated material represented by the above formula (C-e-1) described in Synthesis Example (C-1).

(C-e-3)

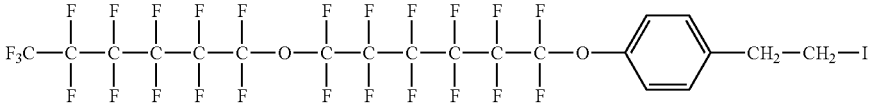

Synthesis Example (C-4)

A reaction was carried out in the same manner as in Synthesis Example (C-1) except that an iodinated material represented by the following formula (C-f-1):

(C-f-1)

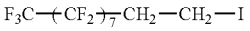

(in the above formula, 7 represents the number of repetitions of the repeating unit)

was used instead of the iodinated material represented by the above formula (C-e-1) described in Synthesis Example (C-1). Consequently, a product, in which a compound represented by the following formula (C-f):

(C-f)

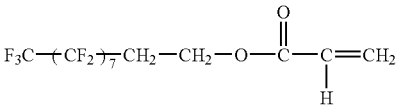

(in the above formula, 7 represents the number of repetitions of the repeating unit) was a principal component, was obtained.

Production Example (C-1)

Production of Polymer (C-A)

In a glass flask equipped with an agitator, a reflux condenser, a dropping funnel, a thermometer, and a gas-blowing opening, 10 parts of methyl methacrylate (hereinafter abbreviated as MMA) and 0.3 part of an acetone (17.5%)-toluene mixed solvent were placed. Subsequently, a nitrogen gas was introduced into the flask and then 0.5 parts of azobisisobutyronitrile (hereinafter abbreviated as AIBN) as a polymerization initiator and 0.32 parts of thioglycolic acid as a chain transfer agent were added to initiate polymerization under reflux. During a time period of 4.5 hours after the initiation, 90 parts of MMA was continuously dropped. In addition, 2.08 parts of thioglycolic acid was dissolved in 7 parts of toluene and divided into 9 portions each of which was added every 30 minutes. Likewise, AIBN (1.5 parts) was divided into 3e portions each of which was added every 1.5 hours. Thus, polymerization was carried out. Subsequently, the mixture was refluxed for additional two hours, thereby terminating the polymerization to obtain a polymer solution of the above formula (g) The reaction temperature was 77 to 87° C. Part of the reaction solution was subjected to re-precipitation using n-hexane, followed by drying. Then, an acid value of was measured and found 0.34 mg equivalent/g. An average number of repetitions of the repeating unit was about 80.

Next, part of acetone was distilled off from the above reaction solution, followed by the addition of 0.5% of triethyl amine as a catalyst and 200 ppm of hydroquinone monomethyl ether as a polymerization inhibitor. In addition, 1.2-fold moles of glycidyl methacrylate relative to the acid value of the polymer was added. Subsequently, the reaction solution was allowed to react for 11 hours under reflux (about 110° C.). The reaction solution was added to 10-fold volume of n-hexane and then subjected to precipitation, followed by drying at 80° C. under reduced pressure. As a result, 90 parts of a compound represented by the above formula (d-1) was obtained.

Next, the following materials were placed in a glass flask equipped with an agitator, a reflux condenser, a dropping funnel, a thermometer, and a gas-blowing opening and allowed to react for 5 hours under reflux (heated to about 100° C.) while introducing a nitrogen gas: 70 parts of a compound represented by the above formula (d-1); 30 parts of a product in which compound represented by the above formula (3-4-1) obtained in Synthesis Example (C-1) was a principal component; 270 parts of trifluorotoluene; and AIBN (0.35 part). The reaction solution was introduced into 10-fold volume of methanol and subjected to precipitation, followed by drying at 80° C. under reduced pressure. Consequently, a polymer (C-A: weight average molecular weight (Mw): 21,000) having a repeating structural unit represented by the above formula (1-4-1) was obtained.

The weight average molecular weight of the polymer was determined by the same measurement method as described above.

Production Example (C-2)

Production of Polymer (C-B)

The reaction and the process were carried out by the same procedures as in Production Example (C-1) except that the compound represented by the above formula (3-4-1) was replaced with a product in which the compound represented by the above formula (3-4-3) obtained in Synthesis Example (C-2) was a principal component. Consequently, a polymer (C-B: weight average molecular weight (Mw)=20,000) having the repeating structural unit represented by the above formula (1-4-3) was obtained.

Production Example (C-3)

Production of Polymer (C-C)

The reaction and the process were carried out by the same procedures as in Production Example (C-1) except that the compound represented by the above formula (3-4-1) was replaced with a product in which the compound represented by the above formula (3-4-6) obtained in Synthesis Example (C-3) was a principal component. Consequently, a polymer (C-C: weight average molecular weight (Mw)=23,000) having the repeating structural unit represented by the above formula (1-4-6) was obtained.

Production Example (C-4)

Production of Polymer (C-D) (Comparative Example)

The reaction and the process were carried out by the same procedures as in Production Example (C-1) except that the compound represented by the above formula (3-4-1) was replaced with a product in which the compound represented by the above formula (C-f) obtained in Synthesis Example (C-4) was a principal component. Consequently, a polymer (C-D: weight average molecular weight (Mw)=21,000) having the repeating structural unit represented by the following formula (C-f-2) was obtained:

(C-f-2)

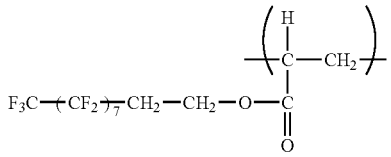

(in the above formula, 7 represents the number of repetitions of the repeating unit)

Example (C-1)

A conductive support used was an aluminum cylinder (JIS-A3003, aluminum alloy ED tube, manufactured by Showa Aluminum Corporation) of 260.5 mm in length and 30 mm in diameter obtained by hot extrusion in an environment of a temperature of 23° C. and a humidity of 60% RH.

The following materials were dispersed by means of a sand mill using glass beads of 1 mm in diameter for 3 hours, thereby preparing a dispersing solution: 6.6 parts of $TiO_2$ particles covered with oxygen-depleted $SnO_2$ as conductive particles (power resistivity: 80 Ω·cm, $SnO_2$ coverage (mass ratio): 50%); 5.5 parts of a phenol resin (trade name: Plyophen J-325, manufactured by Dainippon Ink & Chemicals, Incorporated; resin solid content: 60%) as a resin binder; and 5.9 parts of Methoxy propanol as a solvent.

The following materials were added to the dispersing solution, and were stirred, thereby preparing a conductive-layer coating solution: 0.5 parts Silicone resin particles (trade name: Tospal 120, GE Toshiba Silicones, average particle size: 2 μm) as a surface-roughness imparting agent; and 0.001 parts of Silicone oil (trade name: SH28PA, manufactured by Dow Corning Toray Silicone Co., Ltd.) as a leveling agent.

The support was dip-coated with the conductive-layer coating solution and was dried and heat-cured at a temperature of 140° C. for 30 minutes, thereby forming a conductive layer of 15 μm in average film thickness at a position of 130 mm from the upper end of the support.

The conductive layer was dip-coated with the following intermediate-layer coating solution and then was dried at a temperature of 100° C. for 10 minutes, thereby forming an intermediate layer of 0.5 μm in average film thickness at a position of 130 mm from the upper end of the support: an intermediate-layer coating solution prepared by dissolving 4 parts of N-methoxy methylated nylon (trade name: Toresin EF-30T, manufactured by Teikoku Chemical Industry Co., Ltd.) and 2 parts of a copolymer nylon resin (Amilan CM8000, manufactured by Toray Co., Ltd.) in a mixed solvent of 65 parts of methanol and 30 parts of n-butanol.

Subsequently, the following materials were dispersed by means of a sand-milling device using glass beads of 1 mm in diameter for 1 hour, followed by adding 250 parts of ethyl acetate, thereby preparing a charge-generating layer coating solution: 10 parts of Hydroxy gallium phthalocyanine in crystal form with intense peaks at Bragg angles (2θ±0.2°) in CuKα-characteristic X-ray diffraction of 7.5°, 9.9°, 16.3°, 18.6°, 25.1°, and 28.3°; 5 parts of Polyvinyl butyral (trade name: S-LEX BX-1, manufactured by Sekisui Chemical, Co., Ltd.); and 250 parts of cyclohexanone.

The intermediate layer was dip-coated with the charge-generating layer coating solution and then was dried at a temperature of 100° C. for 10 minutes, thereby forming a charge-generating layer of 0.16 μm in average film thickness at a position of 130 mm from the upper end of the support.

Next, the following materials were dissolved in a mixed solvent of 30 parts of dimethoxy methane and 70 parts of chlorobenzene, thereby preparing a coating solution containing a charge-transporting substance: 10 parts of a charge-transporting substance having a structure represented by the above formula (CTM-1); and 10 parts of a polycarbonate resin (Iupilon Z-400, manufactured by Mitsubishi Engineering-Plastics Corporation) [viscosity average molecular weight (Mv) 39,000] formed of a repeating structural unit represented by the above formula (P-1) as a binder resin.

Subsequently, 5 parts of tetrafluoroethylene resin particles (trade name: Lubron L2, manufactured by Daikin Industries, Ltd.), 5 parts of the polycarbonate resin formed of a repeating structural unit of the above formula (P-1), and 70 parts of chlorobenzene were mixed together. Further, a solution in which the polymer (C-A: 0.5 parts) produced in Production Example (C-1) was added was prepared. The solution was allowed to pass twice through a high-speed liquid-collision dispersing device (trade name: Microfluidizer M-110EH, manufactured by U.S. Microfluidics, Co., Ltd.) at a pressure of 49 MPa (500 kg/cm$^2$), so that the solution containing the tetrafluoroethylene resin particles at was subjected to high pressure dispersion. The average particle size of the tetrafluoroethylene resin particles immediately after the dispersion was 0.15 μm.

The dispersing solution of tetrafluoroethylene resin particles thus prepared was mixed with the coating solution containing the charge-transporting substance, thereby preparing a charge-transporting layer coating solution. The amount added was adjusted so that the mass ratio of the tetrafluoroethylene resin particles to the total solid content (charge-transporting substance, binder resin, and tetrafluoroethylene resin particles) in the coating solution was 5%.

The charge-generating layer was dip-coated with the charge-transporting layer coating solution thus prepared and was dried at a temperature of 120° C. for 30 minutes. Consequently, a charge-transporting layer with an average film thickness of 17 μm at a position of 130 mm from the upper end of the support was formed.

Consequently, the electrophotographic photosensitive member whose charge-transporting layer was a surface layer was prepared.

The electrophotographic photosensitive member thus prepared was subjected to the evaluation of an image*1 and the evaluation of electrophotographic properties*2. The results were shown in Table 3.

*1. Image-Evaluating Method

The electrophotographic photosensitive member thus prepared, the main body of a laser beam printer LBP-2510 manufactured by Canon Co., Ltd., and a process cartridge of the LBP-2510 were placed for 15 hours in an environment of a temperature of 25° C. and a humidity of 50% RH. After that, the electrophotographic photosensitive member was attached to the process cartridge and images were output in the same environment.

The output of an initial image was carried out where the prepared electrophotographic photosensitive member was set in a cyan process cartridge and the cartridge was set in a cyan process cartridge station in the main body. In this case, an image with only a cyan color was output in such a state that only a cyan process cartridge in which the electrophotographic photosensitive member of the present invention was set was provided with a developing unit and other stations were not provided with any developing unit. The image was a chart for printing the half tone of a knight's move pattern (a half tone image in which the knight's move pattern in chess (an isolated dot pattern in which two dots were printed for each 8 grids) was repeated) on a sheet of letter paper. The evaluation method was carried out by determining the number of image defects due to poor dispersion on the whole surface of letter paper on which an image was output using the electrophotographic photosensitive member. The image was evaluated as "A" where no image defect was observed, "B" where 1 to 2 defects were found in the image, or "C" where 3 or more defects were found in the image.

*2: Evaluation Method for Electrophotographic Properties

The prepared electrophotographic photosensitive member, the main body of the laser beam printer LBP-2510 manufactured by Canon Co., Ltd., and tools for measuring surface potential were placed in an environment of a temperature of 25° C. and a humidity of 50% RH (normal temperature and normal humidity) for 15 hours. The tools for measuring the surface potential were those (from which toner, developing rollers, and a cleaning blade were removed) used for placing a probe for measuring the surface potential of an electrophotographic photosensitive member on the developing roller position of the process cartridge of the LBP-2510. After that, in the same environment, the tools for measuring the surface potential of the electrophotographic photosensitive member were attached to the member, and the surface potential of the electrophotographic photosensitive member was then measured without feeding sheets in such a state that an electrostatic transfer belt unit was removed.

A potential measurement method was carried out as described below. First, an exposure part potential (Vl: a potential at the first round after exposing the whole surface of the electrophotographic photosensitive member after charging) was measured. Next, a potential after pre-exposure (Vr: a potential at the first round after pre-exposure (the second round after charging) where charging was carried out only at the first round of the electrophotographic photosensitive member and image exposure was not performed) was measured. Subsequently, a cycle of charging/whole-surface image exposure/pre-exposure was repeated 1,000 times (1K cycles). After that, the potential after pre-exposure after-potential (in the tables, represented by Vr (1K)) was measured again.

Those results were shown in Table 3.

Example (C-2)

An electrophotographic photosensitive member was prepared and evaluated in the same manner as in Example (C-1) except that the polymer (C-A) used in the charge-transporting layer coating solution in Example (C-1) was replaced with the polymer (C-B) produced in Production Example (C-2). The results are shown in Table 3.

Example (C-3)

An electrophotographic photosensitive member was prepared and evaluated in the same manner as in Example (C-1) except that the polymer (C-A) used in the charge-transporting layer coating solution in Example (C-1) was replaced with the polymer (C-C) produced in Production Example (C-3). The results are shown in Table 3.

Example (C-4)

An electrophotographic photosensitive member was prepared and evaluated in the same manner as in Example (C-1) except that the tetrafluoroethylene resin particles used in the charge-transporting layer coating solution in Example (C-1) were replaced with vinylidene fluoride resin particles. The results are shown in Table 3.

Example (C-5)

An electrophotographic photosensitive member was prepared and evaluated in the same manner as in Example (C-1) except for the following change. The results are shown in Table 3.

The polycarbonate resin including a repeating structural unit represented by the above formula (P-1), the binder resin of the charge-transporting layer, was replaced with a polyarylate resin having a repeating structural unit represented by the above formula (P-2)(weight average molecular weight (Mw): 120,000).

In addition, a molar ratio between a terephthalic acid structure and an isophthalic acid structure in the above polyarylate resin (tetraphthalic acid structure:isophthalic acid structure) was 50:50.

Example (C-6)

An electrophotographic photosensitive member was prepared and evaluated in the same manner as in Example (C-4) except that hydroxy gallium phthalocyanine as the charge-generating substance of the charge-generating layer in Example (C-5) was replaced with oxytitanium phthalocyanine (TiOPc) below. The results are shown in Table 3. TiOPc with intense peaks at Bragg angles 2θ±0.2° in CuKα-characteristic X-ray diffraction of 9.0°, 14.2°, 23.9°, and 27.1°.

Example (C-7)

An electrophotographic photosensitive member was prepared and evaluated in the same manner as in Example (C-6) except that the charge-transporting substance represented by the above formula (CTM-1) used in the charge-transporting layer coating solution in Example (C-6) was replaced with a charge-transporting substance represented by the above formula (CTM-2) and a charge-transporting substance represented by the above formula (CTM-3), where 5 parts of each charge-transporting substance was used. The results are shown in Table 3.

Comparative Example (C-1)

An electrophotographic photosensitive member was prepared and evaluated in the same manner as in Example (C-1) except that the polymer (C-A) was not included in the charge-transporting layer coating solution in Example (C-1). The results are shown in Table 3.

Comparative Example (C-2)

An electrophotographic photosensitive member was prepared and evaluated in the same manner as in Example (C-1) except that the polymer (C-A) used in the charge-transporting layer coating solution in Example (C-1) was replaced with 2,6-di-tert-butyl-p-cresol (BHT). The results are shown in Table 3.

Comparative Example (C-3)

An electrophotographic photosensitive member was prepared and evaluated in the same manner as in Example (C-1) except that the polymer (C-A) used in the charge-transporting layer coating solution in Example (C-1) was replaced with the polymer (C-D) produced in Production Example (C-4). The results are shown in Table 3.

Comparative Example (C-4)

An electrophotographic photosensitive member was prepared and evaluated in the same manner as in Example (C-1), except that the polymer (C-A) used in the charge-transporting layer coating solution in Example (C-1) was replaced with a compound (trade name Alon GF300, manufactured by Toagosei Co., Ltd.). The results are shown in Table 3.

Example (C-8)

0.15 parts of the polymer (C-A) produced in Production Example (C-1) and 35 parts of 1,1,2,2,3,3,4-heptafluorocyclopentane (trade name: Zeorora-H, manufactured by Zeon Corporation) were dissolved in 35 parts of 1-propanol. After that, 3 parts of tetrafluoroethylene resin particles (trade name: Lubron L-2, manufactured by Daikin Industries, Ltd.) was added. Subsequently, the mixture was subjected three times to treatment with a high-pressure dispersing device (trade name: Microfluidizer M-110EH, manufactured by U.S. Microfluidics, Co., Ltd.) at a pressure of 58.8 MPa (600 kgf/cm$^2$) to be uniformly dispersed. The dispersed product was filtrated through a 10-μm polytetrafluoroethylene membrane filter under pressure, thereby preparing a dispersion liquid. The average particle size of the tetrafluoroethylene resin particles immediately after the dispersion was 0.13 μm.

TABLE 3

| | | Particle size after dispersion [μm] | Initial image | Initial electrophotographic properties Vl [−V] | Initial electrophotographic properties Vr [−V] | After extensive practice Vr (1K) [−V] |
|---|---|---|---|---|---|---|
| Example (C-1) | Polymer (C-A) | 0.16 | A | 120 | 30 | 40 |
| Example (C-2) | Polymer (C-B) | 0.15 | A | 125 | 35 | 45 |
| Example (C-3) | Polymer (C-C) | 0.17 | A | 120 | 35 | 45 |
| Example (C-4) | Polymer (C-A) | 0.20 | A | 125 | 40 | 50 |
| Example (C-5) | Polymer (C-A) | 0.11 | A | 120 | 35 | 40 |
| Example (C-6) | Polymer (C-A) | 0.11 | A | 125 | 35 | 45 |
| Example (C-7) | Polymer (C-A) | 0.11 | A | 120 | 30 | 35 |
| Comparative Example (C-1) | — | 2.55 | C | 120 | 25 | 30 |
| Comparative Example (C-2) | BHT | 2.35 | C | 135 | 45 | 75 |
| Comparative Example (C-3) | Polymer (C-D) | 0.22 | B | 120 | 40 | 60 |
| Comparative Example (C-4) | Alon GF300 | 0.21 | A | 125 | 35 | 55 |

As can be seen from the results as described above, the following will be evident from a comparison between Examples (C-1) to (C-7) of the present invention and Comparative Examples (C-1) and (C-2). The polymer having the repeating structural unit in the present invention can be used as a structural component of the surface-layer coating solution together with fluorine-atom-containing resin particles to produce an electrophotographic photosensitive member. Thus, the fluorine-atom-containing resin particles can be dispersed so as to be provided with particle sizes almost up to those of primary particles. As a result, an electrophotographic photosensitive member free from image defects due to poor dispersion can be provided.

In addition, when making a comparison between Examples (C-1) to (C-7) of the present invention and Comparative Example (C-3), it can be seen that a structure containing an arylene group in the polymer having the repeating structural unit in the present invention allows the fluorine-atom-containing resin particles to be dispersed so as to be provided with particle sizes almost up to those of primary particles, and can stably retain the dispersion state and good electrophotographic properties.

Further, the following will be evident from a comparison between Examples (C-1) to (C-7) of the present invention and Comparative Example (C-4). When the polymer having the repeating structural unit in the present invention is used as a structural component of the surface-layer coating solution together with fluorine-atom-containing resin particles to produce an electrophotographic photosensitive member, the fluorine-atom-containing resin particles can be dispersed so as to be provided with particle sizes almost up to those of primary particles more than the case where compound of Comparative Example (C-4) is used. Additionally, the stable dispersion state and good electrophotographic properties can be retained. Even though no difference on images could be detected, in consideration of the fact that the fluorine-atom-containing resin particles can be made finer so as to be provided with dispersion particle sizes almost up to those of primary particles by virtue of the constitution of the present invention, the constitution of the present invention is considered to be superior in dispersibility, dispersion stability, etc.

Synthesis Example (D-1)

Synthesis of Compound Represented by the Above Formula (3-5-2)

An iodinated material (0.5 parts) represented by the following formula (D-e-1):

(D-e-1)

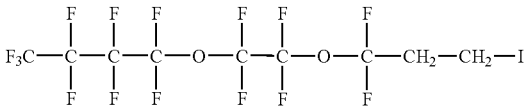

and ion-exchange water (20 parts) were incorporated into a deaerated autoclave, followed by heating up to 300° C. to carry out a conversion reaction of iodine to a hydroxyl group at a gauge pressure of 9.2 MPa for 4 hours. After the completion of the reaction, diethyl ether (20 parts) was added to the reaction mixture. After the mixture had been separated into two phases, magnesium sulfate (0.2 parts) was placed in an ether phase and magnesium sulfate was then removed by filtration, thereby obtaining a hydroxyl compound. The hydroxyl compound was subjected to column chromatography to separate and remove components other than a principal component. Subsequently, 100 parts of the previously obtained hydroxyl compound, 50 parts of acrylic acid, 5 parts of hydroquinone, 5 parts of p-toluenesulfonic acid, and 200 parts of toluene were introduced into a glass flask equipped with an agitator, a condenser, and a thermometer. Next, the flask was heated up to 110° C. and the reaction was then continued until the raw material, the hydroxyl compound, disappeared. After the completion of the reaction, the mixture was diluted with 200 parts of toluene, washed with a sodium hydroxide aqueous solution twice, and then washed with ion-exchange water three times. Subsequently, toluene was distilled off under reduced pressure, thereby obtaining a product. The resulting product was identified by $^{1}$H-NMR and $^{19}$F-NMR. As a result of the quantitative analysis of the product by gas chromatography, it was found that the compound represented by the above formula (3-5-2) was a principal component.

Synthesis Example (D-2)

Synthesis of Compound Represented by the Above Formula (3-5-4)

A product containing the compound represented by the above formula (3-5-4) as a principal component was obtained by carrying out the same reaction as in Synthesis Example (D-1) except that an iodinated material represented by the following formula (D-e-2) was used instead of the iodinated material represented by the above formula (D-e-1) described in Synthesis Example (D-1).

(D-e-2)

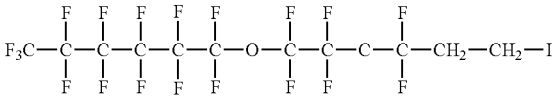

Synthesis Example (D-3)

Synthesis of Compound Represented by the Above Formula (3-5-5)

A product containing the formula represented by the above formula (3-5-5) as a principal component was obtained by carrying out the same reaction as in Synthesis Example (D-1) except that an iodinated material represented by the following formula (D-e-3) was used instead of the iodinated material represented by the above formula (D-e-1) described in Synthesis Example (D-1)

(D-e-3)

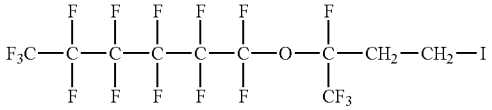

Synthesis Example (D-4)

Synthesis of Compound Represented by the Above Formula (3-5-6)

A product containing the compound represented by the above formula (3-5-6) as a principal component was obtained by carrying out the same reaction as in Synthesis Example (D-1) except that an iodinated material represented by the following formula (D-e-4) was used instead of the iodinated material represented by the above formula (D-e-1) described in Synthesis Example (D-1).

(D-e-4)

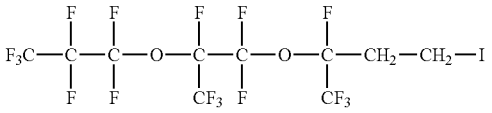

Synthesis Example (D-5)

A reaction was carried out in the same manner as in Synthesis Example (D-1) except that an iodinated material represented by the following formula (D-f-1):

(D-f-1)

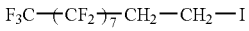

(in the above formula, 7 represents the number of repetitions of the repeating unit)

was used instead of the iodinated material represented by the above formula (D-e-1) described in Synthesis Example (D-1). Consequently, a product, in which a compound represented by the following formula (D-f):

(D-f)

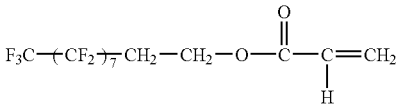

(in the above formula, 7 represents the number of repetitions of the repeating unit)

was a principal component, was obtained.

Production Example (D-1)

Production of Polymer (D-A)

In a glass flask equipped with an agitator, a reflux condenser, a dropping funnel, a thermometer, and a gas-blowing opening, 10 parts of methyl methacrylate (hereinafter abbreviated as MMA) and 0.3 parts of an acetone (17.5%)-toluene mixed solvent were placed. Subsequently, a nitrogen gas was introduced into the flask and then 0.5 parts of azobisisobutyronitrile (hereinafter abbreviated as AIBN) as a polymerization initiator and 0.32 parts of thioglycolic acid as a chain transfer agent were added to initiate polymerization under reflux. During a time period of 4.5 hours after the initiation, 90 parts of MMA was continuously dropped. In addition, 2.08 parts of thioglycolic acid was dissolved in 7 parts of toluene and divided into 9 portions each of which was added every 30 minutes. Likewise, AIBN (1.5 parts) was divided into 3 portions each of which was added every 1.5 hours. Thus, the polymerization was carried out. Subsequently, the mixture was refluxed for an additional two hours, thereby terminating the polymerization to obtain a polymer solution of the above formula (g). The reaction temperature was 77 to 87° C. Part of the reaction solution was subjected to re-precipitation using n-hexane, followed by drying. Then, an acid value was measured and found to be 0.34 mg equivalent/g. An average number of repetitions of the repeating unit was about 80.

Next, part of acetone was distilled off from the above reaction solution, followed by the addition of 0.5% of triethylamine as a catalyst and 200 ppm of hydroquinone monomethyl ether as a polymerization inhibitor. In addition, 1.2-fold moles of glycidyl methacrylate relative to the acid value of the polymer was added. Subsequently, the reaction solution was reacted for 11 hours under reflux (about 110° C.). The reaction solution was added to 10-fold volume of n-hexane and then subjected to precipitation, followed by drying at 80° C. under reduced pressure. As a result, 90 parts of a compound represented by the above formula (d-1) was obtained.

Next, the following materials were placed in a glass flask equipped with an agitator, a reflux condenser, a dropping funnel, a thermometer, and a gas-blowing opening and allowed to react for 5 hours under reflux (heated to about 100° C.) while introducing a nitrogen gas: 70 parts of a compound represented by the above formula (d-1); 30 parts of a product in which a compound represented by the above formula (3-5-2) obtained in Synthesis Example (D-1) was a principal component; 270 parts of trifluorotoluene; and AIBN (0.35 part). The reaction solution was introduced into 10-fold volume of methanol and subjected to precipitation, followed by drying at 80° C. under reduced pressure. Consequently, a polymer (D-A: weight average molecular weight (Mw): 22,000) having a repeating structural unit represented by the above formula (1-5-3) was obtained.

The weight average molecular weight of the polymer was determined by the same measurement method as described above.

Production Example (D-2)

Production of Polymer (D-B)

The reaction and the process were carried out by the same procedures as in Production Example (D-1) except that the compound represented by the above formula (3-5-3) was replaced with a product in which the compound represented by the above formula (3-5-4) obtained in Synthesis Example (D-2) was a principal component. Consequently, a polymer (D-B: weight average molecular weight 23,000) having the repeating structural unit represented by the above formula (1-5-4) was obtained.

Production Example (D-3)

Production of Polymer (D-C)

The reaction and the process were carried out by the same procedures as in Production Example (D-1) except that the compound represented by the above formula (3-5-3) was replaced with a product in which the compound represented by the above formula (3-5-5) obtained in Synthesis Example (D-3) was a principal component. Consequently, a polymer (D-C: weight average molecular weight 20,000) having the repeating structural unit represented by the above formula (1-5-5) was obtained.

Production Example (D-4)

Production of Polymer (D-D)

The reaction and the process were carried out by the same procedures as in Production Example (D-1) except that the compound represented by the above formula (3-5-3) was replaced with a product in which the compound represented by the above formula (3-5-6) obtained in Synthesis Example (D-4) was a principal component. Consequently, a polymer (D-D: weight average molecular weight 24,500) having the repeating structural unit represented by the above formula (1-5-6) was obtained.

Production Example (D-5)

Production of Polymer (D-E) (Comparative Example)

The reaction and the process were carried out by the same procedures as in Production Example (D-1) except that the compound represented by the above formula (3-3-2) was replaced with a product in which the compound represented by the above formula (D-f) obtained in Synthesis Example (D-5) was a principal component. Consequently, a polymer (D-E: weight average molecular weight 21,000) having the repeating structural unit represented by the following formula (D-f-2) was obtained:

(D-f-2)

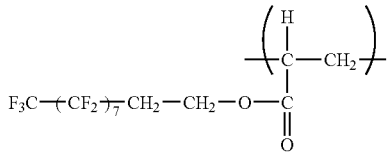

(in the above formula, 7 represents the number of repetitions of the repeating unit).

Example (D-1)

A conductive support used was an aluminum cylinder (JIS-A3003, aluminum alloy ED tube, manufactured by Showa Aluminum Corporation) of 260.5 mm in length and 30 mm in diameter obtained by hot extrusion in an environment of a temperature of 23° C. and a humidity of 60% RH.

The following materials were dispersed by means of a sand mill using glass beads 1 mm in diameter for 3 hours, thereby preparing a dispersion liquid: 6.6 parts of $TiO_2$ particles covered with oxygen-depleted $SnO_2$ as conductive particles (power resistivity: 80 Ω·cm, $SnO_2$ coverage (mass ratio): 50%); 5.5 parts of a phenol resin (trade name: Plyophen J-325, manufactured by Dainippon Ink & Chemicals, Incorporated; resin solid content: 60%) as a resin binder; and 5.9 parts of methoxy propanol as a solvent.

The following materials were added to the dispersion liquid, and was stirred, thereby preparing a conductive-layer coating solution: 0.5 parts of silicone resin particles (trade name: Tospal 120, GE Toshiba Silicones, average particle size: 2 μm) as a surface-roughness imparting agent; and 0.001 parts of silicone oil (trade name: SH28PA, manufactured by Dow Corning Toray Silicone Co., Ltd.) as a leveling agent.

The support was dip-coated with the conductive-layer coating solution and was dried and heat-cured at a temperature of 140° C. for 30 minutes, thereby forming a conductive layer of 15 μm in average film thickness at a position of 130 mm from the upper end of the support.

The conductive layer was dip-coated with the following intermediate-layer coating solution and then was dried at a temperature of 100° C. for 10 minutes, thereby forming an intermediate layer of 0.5 μm in average film thickness at a position of 130 mm from the upper end of the support. The intermediate-layer coating solution was prepared by dissolving 4 parts of N-methoxy methylated nylon (trade name: Toresin EF-30T, manufactured by Teikoku Chemical Industry Co., Ltd.) and 2 parts of a copolymer nylon resin (Amilan CM8000, manufactured by Toray Co., Ltd.) in a mixed solvent of 65 parts of methanol and 30 parts of n-butanol.

Subsequently, the following materials were dispersed by means of a sand-milling device using glass beads of 1 mm in diameter for 1 hour, followed by adding 250 parts of ethyl acetate, thereby preparing a charge-generating layer coating solution; 10 parts of hydroxy gallium phthalocyanine in crystal form with intense peaks at Bragg angles (2θ±0.2°) in CuKα-characteristic X-ray diffraction of 7.5°, 9.9°, 16.3°, 18.6°, 25.1°, and 28.3°; 5 parts of polyvinyl butyral (trade name: S-LEX BX-1, manufactured by Sekisui Chemical, Co., Ltd.); and 250 parts of cyclohexanone.

The intermediate layer was dip-coated with the charge-generating layer coating solution and then was dried at a temperature of 100° C. for 10 minutes, thereby forming a charge-generating layer of 0.16 μm in average film thickness at a position of 130 mm from the upper end of the support.

Next, the following materials were dissolved in a mixed solvent of 30 parts of dimethoxy methane and 70 parts of chlorobenzene, thereby preparing a coating solution containing a charge-transporting substance: 10 parts of a charge-transporting substance having a structure represented by the above formula (CTM-1); and 10 parts of a polycarbonate resin (Iupilon Z-400, manufactured by Mitsubishi Engineering-Plastics Corporation) [viscosity average molecular weight (Mv): 39,000] having a repeating structural unit represented by the above formula (P-1) as a binder resin.

Subsequently, 5 parts of tetrafluoroethylene resin particles (trade name Lubron: L2, manufactured by Daikin Industries, Ltd.), 5 parts of the polycarbonate resin having a repeating structural unit of the above formula (P-1), and 70 parts of chlorobenzene were mixed together. Further, a solution in which the polymer (B-A: 0.5 part) produced in Production Example (B-1) was added was prepared. The solution was allowed to pass twice through a high-speed liquid-collision dispersing device (trade name: Microfluidizer M-110EH, manufactured by U.S. Microfluidics, Co., Ltd.) at a pressure of 49 MPa (500 kg/cm$^2$), so that the solution containing the tetrafluoroethylene resin particles was subjected to high pressure dispersion. The average particle size of the tetrafluoroethylene resin particles immediately after the dispersion was 0.15 μm.

The dispersion liquid of tetrafluoroethylene resin particles thus prepared was mixed with the coating solution containing the charge-transporting substance, thereby preparing a charge-transporting layer coating solution. The amount added was adjusted so that the mass ratio of the tetrafluoroethylene resin particles to the total solid content (charge-transporting substance, binder resin, and tetrafluoroethylene resin particles) in the coating solution was 5%.

The charge-generating layer was dip-coated with the charge-transporting layer coating solution thus prepared and then was dried at a temperature of 120° C. for 30 minutes. Consequently, a charge-transporting layer with an average film thickness of 17 μm at a position of 130 mm from the upper end of the support was formed.

Consequently, the electrophotographic photosensitive member whose charge-transporting layer was a surface layer was prepared.

The electrophotographic photosensitive member thus prepared was subjected to the evaluation of an image*[1] and the evaluation of electrophotographic properties*[2]. The results were shown in Table 4.

*1. Image-Evaluating Method

The electrophotographic photosensitive member thus prepared, the main body of a laser beam printer LBP-2510 manufactured by Canon Co., Ltd., and a process cartridge of the LBP-2510 were placed for 15 hours in an environment of a temperature of 25° C. and a humidity of 50% RH. After that, the electrophotographic photosensitive member was attached to the process cartridge and images were then output in the same environment.

The output of an initial image was carried out where the prepared electrophotographic photosensitive member was set in a cyan process cartridge and the process cartridge was set in a cyan process cartridge station in the main body. In this case, an image with only a cyan color was output in such a state that only a cyan process cartridge in which the electrophotographic photosensitive member of the present invention was set was provided with a developing unit and other stations were not provided with any developing unit. The image was a chart for printing the half tone of a knight's move pattern (a half tone image in which the knight's move pattern in chess (an isolated dot pattern in which two dots were printed for each 8 grids) was repeated) on a sheet of letter paper. The evaluation method was carried out by measuring the number of image defects due to poor dispersion on the whole surface of letter paper on which an image was output using the electrophotographic photosensitive member. The image was evaluated as "A" where no image defect was observed, "B" where 1 to 2 defects were found in the image, or "C" where 3 or more defects were found in the image.

*2: Evaluation Method for Electrophotographic Properties

The prepared electrophotographic photosensitive member, the main body of the laser beam printer LBP-2510 manufactured by Canon Co., Ltd., and tools for measuring a surface potential were placed in an environment of a temperature of 25° C. and a humidity of 50% RH (normal temperature and normal humidity) for 15 hours. Further, the tools for measuring the surface potential were those (from which the toner, the developing rollers, and the cleaning blade were removed) used for placing a probe for measuring the surface potential of an electrophotographic photosensitive member at the developing roller position of the process cartridge of the LBP-2510. After that, in the same environment, the tools for measuring the surface potential of the electrophotographic photosensitive member were attached to the member, and the surface potential of the electrophotographic photosensitive member was measured without feeding sheets in such a state that an electrostatic transfer belt unit was removed.

A potential measurement method was carried out as described below. First, an exposure part potential (Vl: a potential at the first round after exposing the whole surface of the electrophotographic photosensitive member after charging) was measured. Next, potential after pre-exposure (Vr: a potential at the first round after pre-exposure (the second round after charging) where charging was carried out only at the first round of the electrophotographic photosensitive member and image exposure was not performed) was measured. Subsequently, a cycle of electrification/whole-surface image exposure/pre-exposure was repeated 1,000 times (1K cycles). After that, the potential after pre-exposure (in the tables, represented by Vr (1K)) was measured again.

Those results were shown in Table 4.

Example (D-2)

An electrophotographic photosensitive member was prepared and evaluated in the same manner as in Example (D-1) except that the polymer (D-A) used in the charge-transporting layer coating solution in Example (D-1) was replaced with the polymer (D-B) produced in Production Example (D-2). The results are shown in Table 4.

Example (D-3)

An electrophotographic photosensitive member was prepared and evaluated in the same manner as in Example (D-1) except that the polymer (D-A) used in the charge-transporting layer coating solution in Example (D-1) was replaced with the polymer (D-C) produced in Production Example (D-3). The results are shown in Table 4.

Example (D-4)

An electrophotographic photosensitive member was prepared and evaluated in the same manner as in Example (D-1) except that the polymer (D-A) used in the charge-transporting layer coating solution in Example (D-1) was replaced with the polymer (D-D) produced in Production Example (D-4). The results are shown in Table 4.

Example (D-5)

An electrophotographic photosensitive member was prepared and evaluated in the same manner as in Example (D-1) except that the tetrafluoroethylene resin particles used in the charge-transporting layer coating solution in Example (D-1) were replaced with vinylidene fluoride resin particles. The results are shown in Table 4.

Example (D-6)

An electrophotographic photosensitive member was prepared and evaluated in the same manner as in Example (D-1) except for the following change. The results are shown in Table 4.

The polycarbonate resin including a repeating structural unit represented by the above formula (P-1), the binder resin of the charge-transporting layer, was replaced with a polyarylate resin having a repeating structural unit represented by the above formula (P-2)(weight average molecular weight (Mw): 120,000).

A molar ratio between a terephthalic acid structure and an isophthalic acid structure in the above polyarylate resin (tetraphthalic acid structure:isophthalic acid structure) was 50:50.

Example (D-7)

An electrophotographic photosensitive member was prepared and evaluated in the same manner as in Example (D-6) except that hydroxy gallium phthalocyanine as the charge-generating substance of the charge-generating layer in Example (D-6) was replaced with oxytitanium phthalocyanine (TiOPc) below. The results are shown in Table 4. TiOPc with intense peaks at Bragg angles 2θ±0.2° in CuKα-characteristic X-ray diffraction of 9.0°, 14.2°, 23.9°, and 27.1°.

Example (D-8)

An electrophotographic photosensitive member was prepared and evaluated in the same manner as in Example (D-7) except that the charge-transporting substance represented by the above formula (CTM-1) used in the charge-transporting layer coating solution in Example (D-7) was replaced with a charge-transporting substance represented by the above formula (CTM-2) and a charge-transporting substance represented by the following formula (CTM-3) where 5 parts of each charge-transporting substance was used. The results are shown in Table 4.

Comparative Example (D-1)

An electrophotographic photosensitive member was prepared and evaluated in the same manner as in Example (D-1) except that the polymer (D-A) was not contained in the charge-transporting layer coating solution in Example (D-1). The results are shown in Table 4.

Comparative Example (D-2)

An electrophotographic photosensitive member was prepared and evaluated in the same manner as in Example (D-1) except that the polymer (D-A) used in the charge-transporting layer coating solution in Example (D-1) was replaced with 2,6-di-tert-butyl-p-cresol (BHT). The results are shown in Table 4.

Comparative Example (D-3)

An electrophotographic photosensitive member was prepared and evaluated in the same manner as in Example (D-1) except that the polymer (D-A) used in the charge-transporting layer coating solution in Example (D-1) was replaced with the polymer (D-E) produced in Production Example (D-5). The results are shown in Table 4.

Comparative Example (D-4)

An electrophotographic photosensitive member was prepared and evaluated in the same manner as in Example (D-1) except that the polymer (D-A) used in the charge-transporting layer coating solution in Example (D-1) was replaced with a compound (trade name: Alon GF300, manufactured by Toagosei Co., Ltd.). The results are shown in Table 4.

Example (D-9)

0.15 part of the polymer (D-A) produced in Production Example (D-1) and 35 parts of 1,1,2,2,3,3,4-heptafluorocyclopentane (trade name: Zeorora-H, manufactured by Zeon Corporation) were dissolved in 35 parts of 1-propanol. After that, 3 parts of tetrafluoroethylene resin particles (trade name: Lubron L-2, manufactured by Daikin Industries, Ltd.) was added. Subsequently, the mixture was subjected three times to treatment with a high-pressure dispersing device (trade name: Microfluidizer M-110EH, manufactured by U.S. Microfluidics, Co., Ltd.) at a pressure of 58.8 MPa (600 kgf/cm$^2$) to be uniformly dispersed. The dispersed product was filtrated through a 10-μm polytetrafluoroethylene membrane filter under pressure, thereby preparing a dispersion liquid. The average particle size of the tetrafluoroethylene resin particles immediately after the dispersion was 0.15 μm.

TABLE 4

| | | Particle size after dispersion [μm] | Initial image | Initial electrophotographic characteristics Vl [−V] | Vr [−V] | After extensive operation Vr (1K) [−V] |
|---|---|---|---|---|---|---|
| Example (D-1) | Polymer (D-A) | 0.15 | A | 125 | 35 | 45 |
| Example (D-2) | Polymer (D-B) | 0.14 | A | 125 | 30 | 40 |
| Example (D-3) | Polymer (D-C) | 0.16 | A | 120 | 35 | 45 |
| Example (D-4) | Polymer (D-D) | 0.17 | A | 120 | 35 | 45 |
| Example (D-5) | Polymer (D-A) | 0.20 | A | 125 | 40 | 50 |
| Example (D-6) | Polymer (D-A) | 0.10 | A | 120 | 35 | 40 |
| Example (D-7) | Polymer (D-A) | 0.10 | A | 125 | 40 | 50 |
| Example (D-8) | Polymer (D-A) | 0.11 | A | 120 | 30 | 35 |
| Comparative Example (D-1) | — | 2.55 | C | 120 | 25 | 30 |
| Comparative Example (D-2) | BHT | 2.35 | C | 135 | 45 | 75 |
| Comparative Example (D-3) | Polymer (D-E) | 0.22 | B | 120 | 40 | 60 |
| Comparative Example (D-4) | Alon GF300 | 0.21 | A | 125 | 35 | 55 |

As be seen from the results as described above, the following will be evident from a comparison between Examples (D-1) to (D-8) of the present invention and Comparative Examples (D-1) and (D-2). The polymer having the repeating structural unit in the present invention can be used as a structural component of the surface-layer coating solution together with fluorine-atom-containing resin particles to produce an electrophotographic photosensitive member. Thus, the fluorine-atom-containing resin particles can be dispersed so as to be provided with particle sizes almost up to those of primary particles. As a result, an electrophotographic photosensitive member free from image defects due to poor dispersion can be provided.

In addition, the following will be evident from a comparison between Examples (D-1) to (D-8) of the present invention and Comparative Example (D-3). When the polymer having the repeating structural unit in the present invention includes a fluoroalkyl group interrupted with oxygen, fluorine-atom-containing resin particles are dispersed so as to be provided with particle sizes almost up to those of primary particles, and the dispersion state can be stably retained, and further, good electrophotographic properties can be retained.

Further, the following will be evident from a comparison between Examples (D-1) to (D-8) of the present invention and Comparative Example (D-4) When the polymer having the repeating structural unit in the present invention is used as a structural component of a surface-layer coating solution together with the fluorine-atom-containing resin particles to produce an electrophotographic photosensitive member, fluorine-atom-containing resin particles are further dispersed so as to be provided with particle sizes almost up to those of primary particles more than the case where the compound of Comparative Example (D-4) is used, and the dispersion state can be stably retained, and further, good electrophotographic properties can be retained. Even though no difference on images could be detected, in consideration of the fact that the fluorine-atom-containing resin particles can be made finer so as to be provided with dispersion particle sizes almost up to those of primary particles by virtue of the constitution of the present invention, the constitution of the present invention is considered to be superior in dispersibility, dispersion stability, etc.

Synthesis Example (E-1)

Synthesis of Compound Represented by the Above Formula (3-6-2)

0.5 part of an iodinated material represented by the following formula (E-e-1):

$$F_3C—CF_2—CF_2—CF_2—CH_2—CH_2—I \quad \text{(E-e-1)}$$

and 20 parts of ion-exchange water were placed in a deaerated autoclave, followed by heating the inside of the autoclave up to 300° C. to carry out a conversion reaction of iodine into a hydroxyl group at a gauge pressure of 9.2 MPa for 4 hours.

After the completion of the reaction, 20 parts of diethyl ether was added to the reaction mixture. After the mixture had been separated into two phases, 0.2 parts of magnesium sulfate was placed in an ether phase and the magnesium sulfate was then removed by filtration, thereby obtaining a hydroxyl compound of the above formula (E-e-1). The hydroxyl compound was subjected to column chromatography to separate and remove components other than a principal component, whereby the hydroxyl compound was obtained. Subsequently, 100 parts of the hydroxyl compound, 50 parts of acrylic acid, 5 parts of hydroquinone, 5 parts of p-toluenesulfonic acid, and 200 parts of toluene were introduced into a glass flask equipped with an agitator, a condenser, and a thermometer. After that, the glass flask was heated up to 110° C. and the reaction was then continued until the raw material, the hydroxyl compound, disappeared. After the completion of the reaction, the mixture was diluted with 200 parts of toluene, washed with a sodium hydroxide aqueous solution twice, and then washed with ion-exchange water three times. Subsequently, toluene was distilled off under reduced pressure, thereby obtaining a product. The resulting product was identified by $^1$H-NMR and $^{19}$F-NMR. As a result of the quantitative analysis of the product by gas chromatography, it was found that the principal component of the product was the compound represented by the above formula (3-6-2).

Synthesis Example (E-2)

Synthesis of Compound Represented by the Above Formula (3-6-3)

A product containing the compound represented by the above formula (3-6-3) as a principal component was obtained by carrying out the same reaction as in Synthesis Example (E-1) except that an iodinated material represented by the following formula (E-e-2) was used instead of the iodinated compound represented by the above formula (E-e-1) described in Synthesis Example (E-1).

$$F_3C—CF_2—CF_2—CF_2—CH_2—CH_2—CH_2—I \quad \text{(E-e-2)}$$

Synthesis Example (E-3)

Synthesis of Compound Represented by the Above Formula (3-6-10)

A product containing the compound represented by the above formula (3-6-10) as a principal component was obtained by carrying out the same reaction as in Synthesis Example (E-1) except that an iodinated material represented by the following formula (E-e-3) was used instead of the iodinated material represented by the above formula (E-e-1) described in Synthesis Example (E-1).

$$F_3C—CF_2—CF_2—CF_2—CF_2—CF_2—CH_2—CH_2—I \quad \text{(E-e-3)}$$

Synthesis Example (E-4)

Synthesis of Compound Represented by the Above Formula (3-6-11)

A product containing the compound represented by the above formula (3-6-11) as a principal component was obtained by carrying out the same reaction as in Synthesis Example (E-1) except that an iodinated material represented by the following formula (E-e-4) was used instead of the iodinated material represented by the above formula (E-e-1) described in Synthesis Example (E-1).

$$F_3C—CF_2—CF_2—CF_2—CF_2—CF_2—CH_2—CH_2—CH_2—I \quad \text{(E-e-4)}$$

Synthesis Example (E-5)

Instead of the iodinated material represented by the above formula (E-e-1) described in Synthesis Example (E-1), an iodinated material represented by the following formula (E-f-1-a):

$$F_3C-(CF_2)_7-CH_2-CH_2-I \quad \text{(E-f-1-a)}$$

(in the above formula, 7 represents the number of repetitions of the repeating unit of the substituent —$CF_2$—) was used and reacted in the same manner as in Synthesis Example (E-1). As a result, a product having a compound represented by the following formula (E-f-1):

$$F_3C-(CF_2)_7-CH_2-CH_2-O-\overset{O}{\overset{\|}{C}}-\underset{H}{\underset{|}{C}}=CH_2 \quad \text{(E-f-1)}$$

(in the above formula, 7 represents the number of repetitions of the repeating unit of the substituent —$CF_2$—) as a principal component was obtained.

Synthesis Example (E-6)

Instead of the iodinated material represented by the above formula (E-e-1) described in Synthesis Example (E-1), an iodinated material represented by the following formula (E-f-2-a):

$$F_3C-(CF_2)_9-CH_2-CH_2-I \quad \text{(E-f-2-a)}$$

(in the formula, 9 represents the number of repetitions of the repeating unit of the substituent —$CF_2$—) was used and allowed to react in the same manner as in Synthesis Example (E-1). As a result, a product having a compound represented by the following formula (E-f-2):

$$F_3C-(CF_2)_9-CH_2-CH_2-O-\overset{O}{\overset{\|}{C}}-\underset{H}{\underset{|}{C}}=CH_2 \quad \text{(E-f-2)}$$

(in the formula, 9 represents the number of repetitions of the repeating unit of the substituent —$CF_2$—) as a principal component was obtained.

Synthesis Example (E-7)

Instead of the iodinated material represented by the above formula (E-e-1) described in Synthesis Example (E-1), an iodinated material represented by the following formula (E-f-3-a):

$$F_3C-CF_2-CH_2-CH_2-I \quad \text{(E-f-3-a)}$$

was used and allowed to react in the same manner as in Synthesis Example (E-1). As a result, a product having a compound represented by the following formula (E-f-3):

$$F_3C-CF_2-CH_2-CH_2-O-\overset{O}{\overset{\|}{C}}-\underset{H}{\underset{|}{C}}=CH_2 \quad \text{(E-f-3)}$$

as a principal component was obtained.

Production Example (E-1)

Production of Polymer (E-A)

In a glass flask equipped with an agitator, a reflux condenser, a dropping funnel, a thermometer, and a gas-blowing opening, 10 parts of methyl methacrylate (hereinafter abbreviated as MMA) and 0.3 part of an acetone (17.5%)-toluene mixed solvent were introduced. Subsequently, a nitrogen gas was introduced into the flask and then 0.5 part of 2,2'-azobisisobutyronitrile (hereinafter abbreviated as AIBN) as a polymerization initiator and 0.32 part of thioglycolic acid as a chain transfer agent were added to initiate polymerization under reflux. During a time period of 4.5 hours after the initiation, 90 parts of MMA was continuously dropped. In addition, 2.08 parts of thioglycolic acid was dissolved in 7 parts of toluene and divided into 9 portions each of which was added every 30 minutes. Likewise, 1.5 parts of AIBN was divided into 3 portions each of which was added every 1.5 hours. Thus, the polymerization was carried out. Subsequently, the mixture was refluxed for an additional two hours, thereby terminating the polymerization. A polymer solution of the above formula (g) was obtained. The reaction temperature was 77 to 87° C.

Part of the reaction solution was subjected to re-precipitation using n-hexane, followed by drying. Then, an acid value was measured and found to be 0.34 mg equivalent/g. An average number of repetitions of the repeating unit was about 80.

Next, part of acetone was distilled off from the above reaction solution, followed by the addition of 0.5% of triethyl amine as a catalyst and 200 ppm of hydroquinone monomethyl ether as a polymerization inhibitor. In addition, 1.2-fold moles of glycidyl methacrylate relative to the acid value of the polymer was added. Subsequently, the reaction solution was allowed to react for 11 hours under reflux (about 110° C.). The reaction solution was added to 10-fold volume of n-hexane and then subjected to precipitation, followed by drying at 80° C. under reduced pressure. As a result, 90 parts of a compound represented by the above formula (d-1) was obtained.

Next, in a glass flask equipped with an agitator, a reflux condenser, a dropping funnel, a thermometer, and a gas-blowing opening, the following components were placed:

70 parts of a compound represented by the above formula (d-1), 30 parts of a product containing as a principal component a compound obtained in Synthesis Example (E-1) and represented by the above formula (3-6-2), 270 parts of trifluorotoluene, and 0.35 part of AIBN.

A nitrogen gas was introduced into the flask and the mixture was allowed to react for 5 hours under reflux (heated to about 100° C.). The reaction solution was placed in 10-fold volume of methanol and subjected to precipitation, followed by drying at 80° C. under reduced pressure. Consequently, a polymer (E-A) having a repeating structural unit represented by the above formula (1-6-2) was obtained. The weight average molecular weight of the polymer (E-A) was 22,000.

The weight average molecular weight of the polymer was determined by the same measurement method as described above.

Production Example (E-2)

Production of Polymer (E-B)

A polymer (E-B) having a repeating structural unit represented by the above formula (1-6-3) was obtained by a reaction and a process carried out by the same procedures as in Production Example (E-1) except that the compound represented by the above formula (3-6-2) was replaced with a product in which the compound represented by the above formula (3-6-3) obtained in Synthesis Example (E-2) was a principal component. The weight average molecular weight of the polymer (E-B) was 20,000.

Production Example (E-3)

Production of Polymer (E-C)

A polymer (E-C) having a repeating structural unit represented by the above formula (1-6-10) was obtained by a reaction and a process carried out by the same procedures as in Production Example (E-1) except that the compound represented by the above formula (3-6-2) was replaced with a product in which the compound represented by the above formula (3-6-10) obtained in Synthesis Example (E-3) was a principal component. The weight average molecular weight of the polymer (E-C) was 23,000.

Production Example (E-4)

Production of Polymer (E-D)

A polymer (E-D) having a repeating structural unit represented by the above formula (1-6-11) was obtained by a reaction and a process carried out by the same procedures as in Production Example (E-1) except that the compound represented by the above formula (3-6-2) was replaced with a product in which the compound represented by the above formula (3-6-11) obtained in Synthesis Example (E-4) was a principal component. The weight average molecular weight of the polymer (E-D) was 22,600.

Production Example (E-5)

Production of polymer (E-E)

A polymer (E-E) was obtained by a reaction and a process carried out by the same procedures as in Production Example (E-1) except that each of the following components was used instead of 30 parts of the compound represented by the above formula (3-6-2). The polymer (E-E) included a repeating structural unit represented by the above formula (1-6-2) and a repeating structural unit represented by the above formula (1-6-10) in a molar ratio of 70:30. The weight average molecular weight of the polymer (E-E) was 22,900.

21 parts of a product containing a compound obtained in Synthesis Example (E-1) and represented by the above formula (3-6-2) as a principal component, and 9 parts of a product containing as a principal component a compound obtained in Synthesis Example (E-3) and represented by the above formula (3-6-10).

Production Example (E-6)

Production of Polymer (E-F)

A polymer (E-F) was obtained by a reaction and a process carried out by the same procedures as in Production Example (E-1) except that each of the following components was used instead of 30 parts of the compound represented by the above formula (3-6-2). The polymer (E-F) included a repeating structural unit represented by the above formula (1-6-2) and a repeating structural unit represented by the above formula (1-6-10) in a molar ratio of 50:50. The weight average molecular weight of the polymer (E-F) was 24,000.

15 parts of a product containing as a principal component a compound obtained in Synthesis Example (E-1) and represented by the above formula (3-6-2), and 15 parts of a product containing a compound obtained in Synthesis Example (E-3) and represented by the above formula (3-6-10) as a principal component.

Production Example (E-7)

Production of Polymer (E-G)

A polymer (E-G) was obtained by a reaction and a process carried out by the same procedures as in Production Example (E-1) except that each of the following components was used instead of 30 parts of the compound represented by the above formula (3-6-2). The polymer (E-G) included a repeating structural unit represented by the above formula (1-6-2) and a repeating structural unit represented by the above formula (1-6-10) in a molar ratio of 30:70. The weight average molecular weight of the polymer (E-G) was 25,000.

9 parts of a product containing as a principal component a compound obtained in Synthesis Example (E-1) and represented by the above formula (3-6-2), and 21 parts of a product containing a compound obtained in Synthesis Example (E-3) and represented by the above formula (3-6-10) as a principal component.

Production Example (E-8)

Production of Polymer (E-H)

A polymer (E-H) was obtained by a reaction and a process carried out by the same procedures as in Production Example (E-1) except that each of the following components was used instead of 30 parts of the compound represented by the above formula (3-6-2). As a result, the polymer (E-H) included a repeating structural unit represented by the following formula (E-f-3-b):

(E-f-3-b)

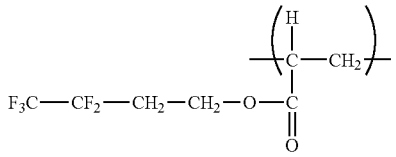

a repeating structural unit represented by the above formula (1-6-2), and a repeating structural unit represented by the above formula (1-6-10) in a molar ratio of 3:67:30. The weight average molecular weight of the polymer (E-H) was 22,000.

1 part of a product containing as a principal component a compound obtained in Synthesis Example (E-7) and represented by the above formula (E-f-3), 20 parts of a product containing as a principal component a compound obtained in Synthesis Example (E-1) and represented by the above formula (3-6-2), and 9 parts of a product containing as a principal component a compound obtained in Synthesis Example (E-3) and represented by the above formula (3-6-10).

Production Example (E-9)

Production of Polymer (E-I)

A polymer (E-I) was obtained by a reaction and a process carried out by the same procedures as in Production Example (E-1) except that each of the following components was used instead of 30 parts of the compound represented by the above formula (3-6-2). As a result, the polymer (E-I) included a repeating structural unit represented by the above formula (1-6-2), a repeating structural unit represented by the above formula (1-6-10), and a repeating structural unit represented by the following formula (E-f-1-b):

(E-f-1-b)

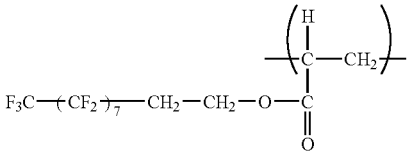

(in the above formula, 7 represents the number of repetitions of the repeating unit of the substituent —$CF_2$—) in a molar ratio of 30:67:3. The weight average molecular weight of the polymer (E-I) was 18,600.

9 parts of a product containing as a principal component a compound obtained in Synthesis Example (E-1) and represented by the above formula (3-6-2), 20 parts of a product containing as a principal component a compound obtained in Synthesis Example (E-3) and represented by the above formula (3-6-10), and 1 part of a product containing as a principal component a compound obtained in Synthesis Example (E-5) and represented by the above formula (E-f-1).

Production Example (E-10)

Production of Polymer (E-J) (Comparative Example)

A polymer (E-J) having a repeating structural unit represented by the above formula (E-f-1-b) was obtained by a reaction and a process carried out by the same procedures as in Production Example (E-1) except that the compound represented by the above formula (3-6-2) was replaced with a product in which the compound represented by the above formula (E-f-1) obtained in Synthesis Example (E-5) was a principal component. The weight average molecular weight of the polymer (E-J) was 24,000.

Production Example (E-11)

Production of Polymer (E-K) (Comparative Example)

A polymer (E-K): was obtained by a reaction and a process carried out by the same procedures as in Production Example (E-1) except that the compound represented by the above formula (3-6-2) was replaced with a product in which the compound represented by the above formula (E-f-2) obtained in Synthesis Example (E-6) was a principal component. As a result, the polymer (E-K) included a repeating structural unit represented by the following formula (E-f-2-b):

(E-f-2-b)

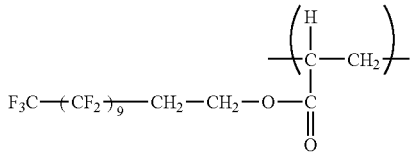

(in the above formula, 9 represents the number of repetitions of the repeating unit of the substituent —$CF_2$—). The weight average molecular weight of the polymer (E-K) was 25,000.

Production Example (E-12)

Production of polymer (E-L) (Comparative Example)

A polymer (E-L) having a repeating structural unit represented by the above formula (E-f-3-b) was obtained by a reaction and a process carried out by the same procedures as in Production Example (E-1) except that the compound represented by the above formula (3-6-2) was replaced with a product in which the compound represented by the above formula (E-f-3) obtained in Synthesis Example (E-7) was a principal component. The weight average molecular weight of the polymer (E-L) was 21,700.

Production Example (E-13)

Production of Polymer (E-M) (Comparative Example)

A polymer (E-M) was obtained by a reaction and a process carried out by the same procedures as in Production Example (E-1) except that each of the following components was used instead of 30 parts of the compound represented by the above formula (3-6-2). The polymer (E-M) included a repeating structural unit represented by the above formula (E-f-3-b) and a repeating structural unit represented by the above formula (1-6-2) in a molar ratio of 30:70. The weight average molecular weight of the polymer (E-M) was 21,400.

9 parts of a product containing as a principal component a compound obtained in Synthesis Example (E-7) and represented by the above formula (E-f-3), and 21 parts of a product containing as a principal component a compound obtained in Synthesis Example (E-1) and represented by the above formula (E-3-2).

Production Example (E-14)

Production of Polymer (E-N) (Comparative Example)

A polymer (E-N) was obtained by a reaction and a process carried out by the same procedures as in Production Example (E-1) except that each of the following components was used instead of 30 parts of the compound represented by the above formula (3-6-2). The polymer (E-N) included a repeating structural unit represented by the above formula (1-6-10) and a repeating structural unit represented by the above formula (E-f-1-b) in a molar ratio of 70:30. The weight average molecular weight of the polymer (E-N) was 18,500.

21 parts of a product containing as a principal component a compound obtained in Synthesis Example (E-3) and represented by the above formula (3-6-10), and 9 parts of a product containing as a principal component a compound obtained in Synthesis Example (E-5) and represented by the above formula (E-f-1).

Example (E-1)

A conductive support used was an aluminum cylinder (JIS-A3003, aluminum alloy ED tube, manufactured by Showa Aluminum Corporation) of 260.5 mm in length and 30 mm in diameter obtained by hot extrusion in an environment of a temperature of 23° C. and a humidity of 60% RH.

The following materials were dispersed by means of a sand mill using glass beads 1 mm in diameter for 3 hours, thereby preparing a dispersing solution: 6.6 parts of $TiO_2$ particles covered with oxygen-depleted $SnO_2$ as conductive particles (power resistivity: 80 Ω·cm, $SnO_2$ coverage (mass ratio): 50%); 5.5 parts of a phenol resin (trade name: Plyophen J-325, manufactured by Dainippon Ink & Chemicals, Incorporated; resin solid content: 60%) as a resin binder, and 5.9 parts of methoxy propanol as a solvent.

The following materials were added to the dispersing solution, and were stirred, thereby preparing a conductive-layer coating solution: 0.5 parts of silicone resin particles (trade name: Tospal 120, GE Toshiba Silicones, average particle size: 2 μm) as a surface-roughness imparting agent, and 0.001 parts silicone oil (trade name: SH28PA, manufactured by Dow Corning Toray Silicone Co., Ltd.) as a leveling agent.

The support was dip-coated with the conductive-layer coating solution and was dried and heat-cured at a temperature of 140° C. for 30 minutes, thereby forming a conductive layer of 15 μm in average film thickness at a position of 130 mm from the upper end of the support.

The conductive layer was dip-coated with the following intermediate-layer coating solution and was dried at a temperature of 100° C. for 10 minutes, thereby forming an intermediate layer of 0.5 μm in average film thickness at a position of 130 mm from the upper end of the support. An intermediate-layer coating solution prepared by dissolving 4 parts of N-methoxy methylated nylon (trade name: Toresin EF-30T, manufactured by Teikoku Chemical Industry Co., Ltd.) and 2 parts of a copolymer nylon resin (Amilan CM8000, manufactured by Toray Co., Ltd.) in a mixed solvent of 65 parts of methanol and 30 parts of n-butanol.

Subsequently, the following materials were dispersed by means of a sand-milling device using glass beads of 1 mm in diameter for 1 hour, followed by adding 250 parts of ethyl acetate, thereby preparing a charge-generating layer coating solution: 10 parts of hydroxy gallium phthalocyanine in crystal form with strong peaks at Bragg angles (2θ±0.2°) in CuKα-characteristic X-ray diffraction of 7.5°, 9.9°, 16.3°, 18.6°, 25.1°, and 28.3°, 5 parts of polyvinyl butyral (trade name: S-LEX BX-1, manufactured by Sekisui Chemical, Co., Ltd.), and 250 parts of cyclohexanone.

The intermediate layer was dip-coated with the charge-generating layer coating solution and was dried at a temperature of 100° C. for 10 minutes, thereby forming a charge-generating layer of 0.16 μm in average film thickness at a position of 130 mm from the upper end of the support.

Next, the following materials were dissolved in a mixture solvent of 30 parts of dimethoxy methane and 70 parts of chlorobenzene, thereby preparing a coating solution containing a charge-transporting substance: 10 parts of a charge-transporting substance having a structure represented by the above formula (CTM-1), and 10 parts of a polycarbonate resin (Iupilon Z-400, manufactured by Mitsubishi Engineering-Plastics Corporation) [viscosity average molecular weight (Mv): 39,000] including a repeating structural unit represented by the above formula (P-1) as a binder resin.

Subsequently, 5 parts of tetrafluoroethylene resin particles (trade name: Lubron L2, manufactured by Daikin Industries, Ltd.), 5 parts of the polycarbonate resin including a repeating structural unit of the above formula (P-1), and 70 parts of chlorobenzene were mixed together. Further, a solution in which the polymer (E-A: 0.5 parts) produced in Production Example (E-1) was added was prepared. The solution was allowed to pass twice through a high-speed liquid-collision dispersing device (trade name: Microfluidizer M-110EH, manufactured by U.S. Microfluidics, Co., Ltd.) at a pressure of 49 MPa (500 kg/cm$^2$), so that the solution containing the tetrafluoroethylene resin particles was subjected to high pressure dispersion. The average particle size of the tetrafluoroethylene resin particles immediately after the dispersion was 0.15 μm.

The dispersion liquid of tetrafluoroethylene resin particles thus prepared was mixed with the coating solution containing the charge-transporting substance, thereby preparing a charge-transporting layer coating solution. The amount added was adjusted so that the mass ratio of the tetrafluoroethylene resin particles to the total solid content (charge-transporting substance, binder resin, and tetrafluoroethylene resin particles) in the coating solution was 5%.

The charge-generating layer was dip-coated with the charge-transporting layer coating solution thus prepared and was dried at a temperature of 120° C. for 30 minutes. Consequently, a charge-transporting layer with an average film thickness of 17 μm at a position of 130 mm from the upper end of the support was formed.

Consequently, the electrophotographic photosensitive member whose charge-transporting layer was a surface layer was prepared.

The electrophotographic photosensitive member thus prepared was subjected to the evaluation of an image*1 and the evaluation of electrophotographic properties*2. The results were shown in Table 5.

*1. Image-Evaluating Method

The electrophotographic photosensitive member thus prepared, the main body of a laser beam printer LBP-2510 manufactured by Canon Co., Ltd., and a process cartridge of the LBP-2510 were placed for 15 hours in an environment of a temperature of 25° C. and a humidity of 50% RH. After that, the electrophotographic photosensitive member was attached to the process cartridge and images were output in the same environment.

The output of an initial image was carried out where the prepared electrophotographic photosensitive member was set in a cyan process cartridge and the process cartridge was set in a cyan process cartridge station in the main body. In this case, an image with only a single cyan color was output in such a state that only a cyan process cartridge in which the electrophotographic photosensitive member of the present invention was set was provided with a developing unit and other stations were not provided with any developing unit. The image was a chart for printing the half tone of a knight's move pattern (a half tone image in which the knight's move pattern of chess (an isolated dot pattern in which two dots were printed for each 8 grids) was repeated) on a sheet of letter paper. The evaluation method was carried out by determining the number of image defects due to poor dispersion on the whole surface of letter paper on which an image was output using the electrophotographic photosensitive member. The image was evaluated as "A" where no image defect was observed, "B" where 1 to 2 defects were found in the image, or "C" where 3 or more defects were found in the image.

*2: Evaluation Method for Electrophotographic Properties

The prepared electrophotographic photosensitive member, the main body of the laser beam printer LBP-2510 manufactured by Canon Co., Ltd., and tools for measuring a surface potential were placed in an environment of a temperature of 25° C. and a humidity of 50% RH (normal temperature and normal humidity) for 15 hours. The tools for measuring the surface potential were those (from which toner, developing rollers, and a cleaning blade were removed) used for placing a probe for measuring the surface potential of an electrophotographic photosensitive member at the developing roller position of the process cartridge of the LBP-2510. After that, in the same environment, the tools for measuring the surface potential of the electrophotographic photosensitive member was attached to the member, and the surface potential of the electrophotographic photosensitive member was measured without feeding sheets in such a state that an electrostatic transfer belt unit was removed.

A potential measurement method was carried out as described below: First, an exposure part potential (Vl: a potential at the first round after exposing the whole surface of the electrophotographic photosensitive member after charging) was measured. Next, a potential after pre-exposure (Vr: a potential at the first round after pre-exposure (the second round after charging) where charging was carried out only at the first round of the electrophotographic photosensitive member and image exposure was not performed) was measured. Subsequently, a cycle of charging/whole-surface image exposure/pre-exposure was repeated 1,000 times (1K cycles). After that, the potential after pre-exposure (in the tables, represented by Vr (1K)) was measured again.

Those results were shown in Table 5.

Examples (E-2) to (E-9)

An electrophotographic photosensitive member was prepared and evaluated in the same manner as in Example (E-1) except that the polymer (E-A) used in the charge-transporting layer coating solution in Example (E-1) was replaced with a polymer represented in Table 5. The results are shown in Table 5.

Example (E-10)

An electrophotographic photosensitive member was prepared and evaluated in the same manner as in Example (E-1) except for the following change. The results are shown in Table 5.

The polycarbonate resin formed of a repeating structural unit represented by the above formula (P-1), the binder resin of the charge-transporting layer, was replaced with a polyarylate resin having a repeating structural unit represented by the above formula (P-2) (weight average molecular weight (Mw): 120,000).

A molar ratio between a terephthalic acid structure and an isophthalic acid structure in the above polyarylate resin (tetraphthalic acid structure: isophthalic acid structure) was 50:50.

Example (E-11)

An electrophotographic photosensitive member was prepared and evaluated in the same manner as in Example (E-10) except that the polymer (E-A) used in the charge-transporting layer coating solution in Example (E-10) was replaced with the polymer (E-B). The results are shown in Table 5.

Example (E-12)

An electrophotographic photosensitive member was prepared and evaluated in the same manner as in Example (E-10) except that the charge-transporting substance represented by the above formula (CTM-1) used in the charge-transporting layer coating solution in Example (E-10) was replaced with a charge-transporting substance represented by the above formula (CTM-2) and a charge-transporting substance represented by the above general formula (CTM-3) where 5 parts of each charge-transporting substance was used. The results are shown in Table 5.

Examples (E-13)

An electrophotographic photosensitive member was prepared and evaluated in the same manner as in Example (E-12) except that the polymer (E-A) used in the charge-transporting layer coating solution in Example (E-12) was replaced with the polymer (E-B). The results are shown in Table 5.

Comparative Example (E-1)

An electrophotographic photosensitive member was prepared and evaluated in the same manner as in Example (E-1) except that the polymer (E-A) was not included in the charge-transporting layer coating solution in Example (E-1). The results are shown in Table 5.

Comparative Example (E-2)

An electrophotographic photosensitive member was prepared and evaluated in the same manner as in Example (E-1) except that the polymer (E-A) used in the charge-transporting layer coating solution in Example (E-1) was replaced with 2,6-di-tert-butyl-p-cresol (BHT). The results are shown in Table 5.

Comparative Examples (E-3) to (E-7)

An electrophotographic photosensitive member was prepared and evaluated in the same manner as in Example (E-1) except that the polymer (D-A) used in the charge-transporting layer coating solution in Example (E-1) was replaced with a polymer indicated in Table 5. The results are shown in Table 5.

Comparative Example (E-8)

An electrophotographic photosensitive member was prepared and evaluated in the same manner as in Example (E-1)

except that the polymer (E-A) used in the charge-transporting layer coating solution in Example (E-1) was replaced with a compound (trade name: Alon GF300, manufactured by Toagosei Co., Ltd.). The results are shown in Table 5.

Example (E-14)

0.15 parts of the polymer (B-A) produced in Production Example (E-1) and 35 parts of 1,1,2,2,3,3,4-heptafluorocyclopentane (trade name: Zeorora-H, manufactured by Zeon Corporation) were dissolved in 35 parts of 1-propanol. After that, 3 parts of tetrafluoroethylene resin particles (trade name: Lubron L-2, manufactured by Daikin Industries, Ltd.) was added. Subsequently, the mixture was subjected three times to treatment with a high-pressure dispersing device (trade name: Microfluidizer M-110EH, manufactured by U.S. Microfluidics, Co., Ltd.) at a pressure of 58.8 MPa (600 kgf/cm$^2$) to be uniformly dispersed. The dispersed product was filtrated through a 10-μm polytetrafluoroethylene membrane filter under pressure, thereby preparing a dispersion liquid. The average particle size of the tetrafluoroethylene resin particles immediately after the dispersion was 0.18 μm.

Example (E-15)

A dispersion liquid of tetrafluoroethylene resin particles was prepared in the same manner as in Example (A-14) except that the polymer (E-A) used in the charge-transporting layer coating solution in Example (E-14) was replaced with the polymer (E-B). The average particle size of the tetrafluoroethylene resin particles immediately after the dispersion was 0.18 μm.

TABLE 5

| | | Repeating structural unit containing fluorine atom [molar ratio] | Particle size after dispersion [μm] | Initial image | Initial electrophotographic characteristics Vl [−V] | Vr [−V] | After extensive operation Vr(1K) [−V] |
|---|---|---|---|---|---|---|---|
| Example (E-1) | Polymer (E-A) | (1-6-2)[100] | 0.16 | A | 120 | 30 | 40 |
| Example (E-2) | Polymer (E-B) | (1-6-3)[100] | 0.17 | A | 120 | 30 | 40 |
| Example (E-3) | Polymer (E-C) | (1-6-10)[100] | 0.16 | A | 120 | 35 | 45 |
| Example (E-4) | Polymer (E-D) | (1-6-11)[100] | 0.17 | A | 120 | 35 | 45 |
| Example (E-5) | Polymer (E-E) | (1-6-2)[70]<br>(1-6-10)[30] | 0.17 | A | 125 | 35 | 45 |
| Example (E-6) | Polymer (E-F) | (1-6-2)[50]<br>(1-6-10)[50] | 0.18 | A | 125 | 35 | 45 |
| Example (E-7) | Polymer (E-G) | (1-6-2)[30]<br>(1-6-10)[70] | 0.17 | A | 125 | 35 | 45 |
| Example (E-8) | Polymer (E-H) | (E-f-3-b)[3]<br>(1-6-2)[67]<br>(1-6-10)[30] | 0.17 | A | 120 | 35 | 45 |
| Example (E-9) | Polymer (E-I) | (1-6-2)[30]<br>(1-6-10)[67]<br>(E-f-1-b)[3] | 0.17 | A | 120 | 35 | 45 |
| Example (E-10) | Polymer (E-A) | (1-6-2)[100] | 0.13 | A | 120 | 25 | 30 |
| Example (E-11) | Polymer (E-B) | (1-6-3)[100] | 0.13 | A | 120 | 25 | 30 |
| Example (E-12) | Polymer (E-A) | (1-6-2)[100] | 0.13 | A | 120 | 25 | 30 |
| Example (E-13) | Polymer (E-B) | (1-6-3)[100] | 0.13 | A | 120 | 25 | 30 |
| Comparative Example (E-1) | — | | 2.55 | C | 120 | 25 | 30 |
| Comparative Example (E-2) | BHT | | 2.35 | C | 135 | 45 | 75 |
| Comparative Example (E-3) | Polymer (E-J) | (E-f-1-b) [100] | 0.22 | B | 120 | 40 | 60 |
| Comparative Example (E-4) | Polymer (E-K) | (E-f-2-b) [100] | 0.28 | B | 140 | 45 | 70 |
| Comparative Example (E-5) | Polymer (E-L) | (E-f-3-b)[100] | 0.35 | B | 125 | 40 | 65 |
| Comparative Example (E-6) | Polymer (E-M) | (E-f-3-b)[30]<br>(1-6-2)[70] | 0.24 | B | 125 | 40 | 70 |
| Comparative Example (E-7) | Polymer (E-N) | (1-6-10)[70]<br>(E-f-1-b)[30] | 0.21 | A | 125 | 35 | 55 |
| Comparative Example (E-8) | Alon GF300 | | 0.21 | A | 125 | 35 | 55 |

As is evident from the above results, when making a comparison between Examples (E-1) to (E-13) of the present invention and Comparative Examples (E-1) and (E-2), it can be seen that fluorine-atom-containing resin particles can be dispersed so as to be provided with particle sizes almost up to those of primary particles, and as a result, an electrophotographic photosensitive member can be provided which suppresses image defects owing to poor dispersion.

In addition, when making a comparison between Examples (E-1) to (E-13) of the present invention and Comparative Examples (E-3) to (E-7), it has been found that fluorine-atom-containing resin particles can be dispersed so as to be provided with particle sizes almost up to those of primary particles, and the dispersion state can be stably retained. In particular, by making a comparison between Examples (E-1) to (E-13) and Comparative Example (E-7), the constitution of the present invention is considered to be superior in that fluorine-atom-containing resin particles can be made finer so as to be provided with dispersion particle sizes almost up to those of primary particles, and to be superior in dispersibility, dispersion stability, etc.

Further, when making a comparison between Examples (E-1) to (E-13) of the present invention and Comparative Example (E-8), it has been found that fluorine-atom-containing resin particles can be dispersed so as to be provided with particle sizes almost up to those of primary particles and the dispersed state can be stably retained, more than the case where the compound of Comparative Example (E-8) is used. Consequently, considering that fluorine-atom-containing resin particles can be made fine into dispersion particle sizes proximate to those of the primary particles, the constitution of the present invention may be superior in dispersibility, dispersion stability, etc.

This application claims the benefit of Japanese Patent Applications No. 2006-295883 filed on Oct. 31, 2006, No. 2006-295884 filed on Oct. 31, 2006, No. 2006-295887 filed on Oct. 31, 2006, No. 2006-295888 filed on Oct. 31, 2006, No. 2006-295891 filed on Oct. 31, 2006, and No. 2007-257113 filed on Oct. 1, 2007, which are hereby incorporated by reference in their entirety.

What is claimed is:

1. An electrophotographic photosensitive member comprising a support and a photosensitive layer formed on the support wherein the electrophotographic photosensitive member has a surface layer containing a polymer having repeating structural units each represented by the following formula (1):

(1)

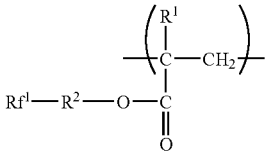

where $R^1$ represents a hydrogen atom or a methyl group, $R^2$ represents a single bond or a divalent group, and $Rf^1$ represents a monovalent group having at least one of a fluoroalkyl group and a fluoroalkylene group, and fluorine-atom-containing resin particles, wherein 70 to 100% by number of the repeating structural units each represented by the formula (1) in the polymer are represented by at least one of the following formulae (1-1) to (1-5):

(1-1)

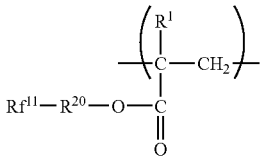

(1-2)

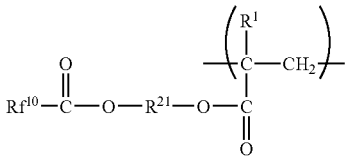

(1-3)

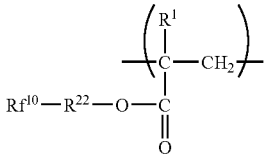

(1-4)

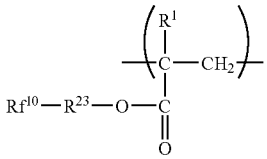

(1-5)

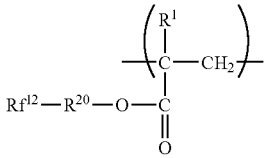

where $R^1$ represents a hydrogen atom or a methyl group, $R^{20}$ represents a single bond or an alkylene group, $R^{21}$ represents an alkylene group having a branched structure with a carbon-carbon bond, $R^{22}$ represents a —$R^{21}$— group or a —O—$R^{21}$— group, $R^{23}$ represents a —Ar— group, a —O—Ar— group or a —O—Ar—R— group where Ar represents an arylene group and R represents an alkylene group, $Rf^{10}$ represents a monovalent group having at least a fluoroalkyl group, $Rf^{11}$ represents a fluoroalkyl group having a branched structure with a carbon-carbon bond, and $Rf^{12}$ represents a fluoroalkyl group interrupted with oxygen.

2. An electrophotographic photosensitive member according to claim 1, wherein the polymer having the repeating structural units represented by the formula (1) further has repeating structural units each represented by the following formula (a):

(a)

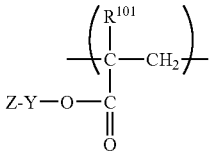

where $R^{101}$ represents a hydrogen atom or a methyl group, Y represents a divalent organic group, and Z represents a polymer unit.

3. An electrophotographic photosensitive member according to claim 2, wherein Z in the formula (a) is a polymer unit having a repeating structural unit represented by the following formula (b-1) or (b-2):

(b-1)

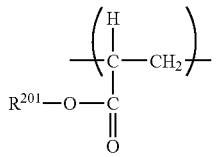

where $R^{201}$ represents an alkyl group;

(b-2)

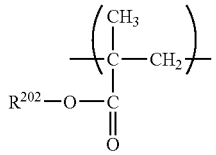

where $R^{202}$ represents an alkyl group.

4. An electrophotographic photosensitive member according to claim 2, wherein Y in the formula (a) is a divalent organic group having at least a structure represented by the following formula (c):

(c)

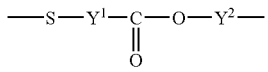

where $Y^1$ and $Y^2$ each independently represent an alkylene group.

5. An electrophotographic photosensitive member according to claim 1, wherein the polymer having the repeating structural units each represented by the formula (1) is synthesized by polymerization of compounds each represented by the following formula (3):

(3)

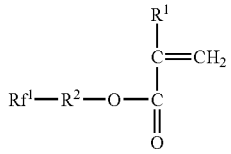

where $R^1$ represents a hydrogen atom or a methyl group, $R^2$ represents a single bond or a divalent group, and $Rf^1$ represents a monovalent group having at least one of a fluoroalkyl group and a fluoroalkylene group, wherein 70% to 100% by number of the compounds each represented by the formula (3) are represented by at least one of the following formulae (3-1) to (3-5):

(3-1)

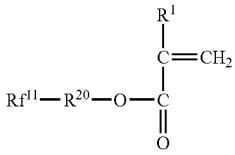

(3-2)

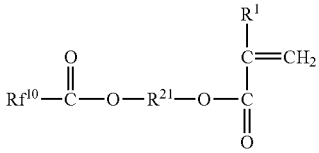

(3-3)

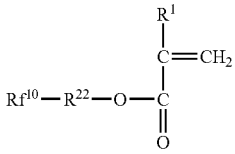

(3-4)

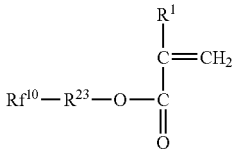

(3-5)

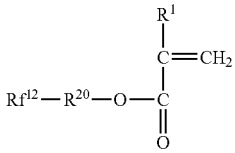

where $R^1$ represents a hydrogen atom or a methyl group, $R^{20}$ represents a single bond or an alkylene group, $R^{21}$ represents an alkylene group having a branched structure with a carbon-carbon bond, $R^{22}$ represents a —$R^{21}$— group or a —O—$R^{21}$— group, $R^{23}$ represents a —Ar— group, a —O—Ar— group or a —O—Ar—R— group where Ar represents an arylene group and R represents an alkylene group, $Rf^{10}$ represents a monovalent group having at least a fluoroalkyl group, $Rf^{11}$ represents a fluoroalkyl group having a branched structure with a carbon-carbon bond, and $Rf^{12}$ represents a fluoroalkyl group interrupted with oxygen.

6. An electrophotographic photosensitive member according to claim 2, wherein the polymer having the repeating structural units each represented by the formula (1) and the repeating structural units each represented by the formula (a) is synthesized by polymerization of compounds each represented by the following formula (3) and compounds each represented by the following formula (d):

(3)

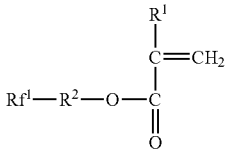

where $R^1$ represents a hydrogen atom or a methyl group, $R^2$ represents a single bond or a divalent group, and $Rf^1$ represents a monovalent group having at least one of a fluoroalkyl group and a fluoroalkylene group, (d)

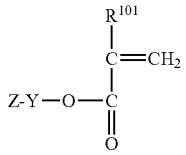

where $R^{101}$ represents a hydrogen atom or a methyl group, Y represents a divalent organic group, and Z represents a polymer unit, wherein 70 to 100% by number of the compounds each represented by the formula (3) are represented by at least one of the following formulae (3-1) to (3-5):

(3-1)

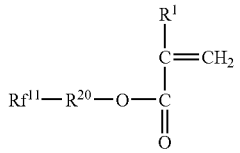

(3-2)

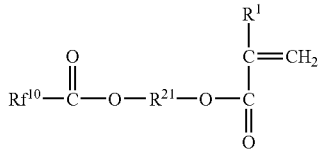

(3-3)

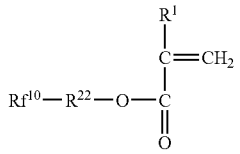

(3-4)

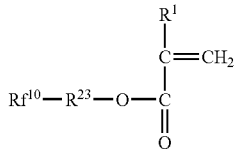

-continued (3-5)

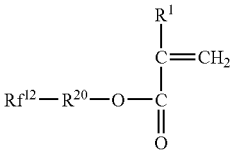

where $R^1$ represents a hydrogen atom or a methyl group, $R^{20}$ represents a single bond or an alkylene group, $R^{21}$ represents an alkylene group having a branched structure with a carbon-carbon bond, $R^{22}$ represents a —$R^{21}$— group or a —O—$R^{21}$— group, $R^{23}$ represents a —Ar— group, a —O—Ar— group or a —O—Ar—R— group where Ar represents an arylene group and R represents an alkylene group, $Rf^{10}$ represents a monovalent group having at least a fluoroalkyl group, $Rf^{11}$ represents a fluoroalkyl group having a branched structure with a carbon-carbon bond, and $Rf^{12}$ represents a fluoroalkyl group interrupted with oxygen.

7. An electrophotographic photosensitive member according to claim 1, wherein the fluorine-atom-containing resin particles comprise tetrafluoroethylene resin particles, trifluoroethylene resin particles, tetrafluoroethylene/propylene hexafluoride resin particles, vinyl fluoride resin particles, vinylidene fluoride resin particles, ethylene difluoride/ethylene dichloride resin particles, or particles of a copolymer of two or more of monomers constituting these resins.

8. A method of manufacturing the electrophotographic photosensitive member according to claim 1, which comprises a step of forming the surface layer of the electrophotographic photosensitive member by using a surface-layer coating solution containing the polymer having the repeating structural units each represented by the formula (1) and the fluorine-atom-containing resin particles.

9. A process cartridge which integrally supports the electrophotographic photosensitive member according to claim 1 and at least one unit selected from the group consisting of a charging unit, a developing unit and a cleaning unit, and is detachably mountable on a main body of an electrophotographic apparatus.

10. An electrophotographic apparatus which comprises the electrophotographic photosensitive member according to claim 1, a charging unit, an exposing unit, a developing unit and a transfer unit.

* * * * *